US007789640B2

(12) United States Patent
Uekawa

(10) Patent No.: US 7,789,640 B2
(45) Date of Patent: Sep. 7, 2010

(54) SCROLL FLUID MACHINE WITH A PIN SHAFT AND GROOVE FOR RESTRICTING ROTATION

(75) Inventor: Takashi Uekawa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 91 days.

(21) Appl. No.: 11/793,454

(22) PCT Filed: Dec. 16, 2005

(86) PCT No.: PCT/JP2005/023134

§ 371 (c)(1),
(2), (4) Date: Jun. 20, 2007

(87) PCT Pub. No.: WO2006/068044

PCT Pub. Date: Jun. 29, 2006

(65) Prior Publication Data

US 2008/0145253 A1 Jun. 19, 2008

(30) Foreign Application Priority Data

Dec. 21, 2004 (JP) ..... 2004-369119

(51) Int. Cl.
*F01C 1/02* (2006.01)
*F01C 21/00* (2006.01)
*F04C 18/02* (2006.01)

(52) U.S. Cl. ..... 418/55.3; 418/55.1; 74/86; 464/104

(58) Field of Classification Search ..... 418/55.1, 418/55.3; 74/86; 464/104
See application file for complete search history.

(56) References Cited

U.S. PATENT DOCUMENTS

| | | | | |
|---|---|---|---|---|
| 2,841,089 | A | 7/1958 | Jones | |
| 4,795,323 | A * | 1/1989 | Lessie | 418/55.3 |
| 5,165,878 | A | 11/1992 | Inagaki et al. | |
| 5,242,282 | A * | 9/1993 | Mitsunaga et al. | 418/55.3 |
| 5,318,424 | A | 6/1994 | Bush et al. | |
| 5,330,334 | A * | 7/1994 | Bush et al. | 418/55.3 |

FOREIGN PATENT DOCUMENTS

| | | | |
|---|---|---|---|
| EP | 461494 A1 | * | 12/1991 |
| JP | 59035601 A | * | 2/1984 |
| JP | 59-35601 U | | 3/1984 |
| JP | 59-96493 A | | 6/1984 |
| JP | 60-175793 A | | 9/1985 |
| JP | 02169885 A | * | 6/1990 |
| JP | 2-211392 A | | 8/1990 |
| JP | 2-218878 A | | 8/1990 |

(Continued)

*Primary Examiner*—Thomas E Denion
*Assistant Examiner*—Mary A Davis
(74) *Attorney, Agent, or Firm*—Birch, Stewart, Kolasch & Birch, LLP.

(57) ABSTRACT

A fixed scroll (60) is provided with a pin shaft portion (70) which is formed in a cylindrical shape. Formed in a movable scroll (50) is a slide groove (80) which extends in the radial direction of the movable scroll (50). The pin shaft portion (70) of the fixed scroll (60) is engaged into the slide groove (80) of the movable scroll (50). During orbital movement of the movable scroll (50), the pin shaft portion (70) slidingly contacts a side surface of the slide groove (80), whereby rotation of the movable scroll (50) is restricted.

11 Claims, 31 Drawing Sheets

FOREIGN PATENT DOCUMENTS

| | | | | |
|---|---|---|---|---|
| JP | 02227577 | A | * | 9/1990 |
| JP | 6-213176 | A | | 8/1994 |
| JP | 7-197890 | A | | 8/1995 |
| JP | 2004-19545 | A | | 1/2004 |
| JP | 2004-76602 | A | | 3/2004 |

* cited by examiner (A)

FIG. 28

| PIN DIAMETER (mm) | HERTZ STRESS (MPa) | EHL OIL FILM (μm) |
|---|---|---|
| 10 | 417 | 0.103 |
| 20 | 299 | 0.138 |
| — | DECREASED BY 28% | INCREASED BY 34% |

SCROLL FLUID MACHINE WITH A PIN SHAFT AND GROOVE FOR RESTRICTING ROTATION

TECHNICAL FIELD

The present invention generally relates to fluid machinery of the scroll type and more particularly to a mechanism for restricting rotation of a movable scroll in such a scroll fluid machine.

BACKGROUND ART

For many years, scroll fluid machines have been widely used as compressors for air conditioners. In a typical scroll fluid machine, a fixed scroll is provided with a spiral wrap and a movable scroll is also provided with a spiral wrap, wherein these fixed and movable side spiral wraps engage with each other to form fluid chambers. In this scroll fluid machine, the movable scroll performs orbital movement, in association with which the fluid chambers vary in volume. For example, in a scroll fluid machine which constitutes a compressor, the volume of a fluid chamber placed in the confined state is gradually decreased to thereby compress fluid in the fluid chamber.

In the above-described scroll fluid machine, it is required to restrict rotation of the movable scroll. As a mechanism for restricting rotation of the movable scroll, there is a widely used mechanism such as an Oldham ring mechanism disclosed in JP-A-2004-19545.

More specifically, in a scroll fluid machine employing an Oldham ring mechanism, a movable scroll is placed, through an Oldham ring (Oldham joint), on a housing. The housing is secured in position together with a fixed scroll. Two pairs of keys are formed on the Oldham ring such that they project therefrom. In other words, the Oldham ring is provided with a total of four keys, two of which are engaged into associated key grooves formed in the housing and the remaining two of which are engaged into associated key grooves formed in the movable scroll. And each of the keys of the Oldham ring slides along its associated key groove, whereby rotation of the movable scroll is controlled.

DISCLOSURE OF THE INVENTION

Problems that the Invention Intends to Solve

As described above, the four keys of the Oldham ring are engaged, respectively, into their corresponding key grooves. During orbital movement of the movable scroll, each of the four keys slides while being pressed against a sidewall of its associated key groove. To sum up, the keys of the Oldham ring come into sliding contact with the movable scroll and the housing which are provided with the key grooves. Therefore, the problem with employing an Oldham ring mechanism with a view to restricting rotation of the movable scroll is that sliding contact loss relatively increases because the four keys of the Oldham ring come into sliding contact with the movable scroll and the housing.

In addition, the Oldham ring is often somewhat smaller in size than the movable scroll. When the scroll fluid machine is in operation, the Oldham ring of relatively large size moves in association with revolution of the movable scroll. Consequently, if lubricating oil is collected on the periphery of the Oldham ring, this may result in relatively increased loss due to stirring up of the collected lubricating oil by the Oldham ring.

Bearing in mind the above-described problems, the present invention was devised. Accordingly, an object of the present invention is to achieve a reduction in loss in the scroll fluid machine and, more specifically, to attain a reduction in loss due to the mechanism for restricting rotation of the movable scroll.

Means for Solving the Problem

According to a first or a second aspect of the present invention, there is provided a fluid machine of the scroll type which comprises an orbiting scroll (50), a rotating shaft (20) which engages the orbiting scroll (50), and a non-orbiting member (69) which comprises at least a non-orbiting scroll (60), wherein the orbiting scroll (50) moves orbitally around the central axis of the rotating shaft (20).

More specifically, according to the first aspect of the present invention, a) the scroll fluid machine includes a pin shaft portion (70) which is mounted to the non-orbiting member (69), and the distance from the central axis of the pin shaft portion (70) to the central axis of the rotating shaft (20) is set longer than the radius of orbital movement of the orbiting scroll (50); b) the orbiting scroll (50) is provided with a slide groove (80) for engagement with the pin shaft portion (70); and c) rotation of the orbiting scroll (50) is restricted by sliding contact of a wall surface of the slide groove (80) and the pin shaft portion (70) during orbital movement of the orbiting scroll (50).

In addition, according to the second aspect of the present invention, a) the scroll fluid machine includes a pin shaft portion (70) which is mounted to the orbiting scroll (50), and the distance from the central axis of the pin shaft portion (70) to the central axis of the eccentric portion (22, 23) is set longer than the radius of orbital movement of the orbiting scroll (50); b) the non-orbiting member (69) is provided with a slide groove (80) for engagement with the pin shaft portion (70); and c) rotation of the orbiting scroll (50) is restricted by sliding contact of a wall surface of the slide groove (80) and the pin shaft portion (70) during orbital movement of the orbiting scroll (50).

According to a third or a fourth aspect of the present invention, there is provided a fluid machine of the scroll type which comprises an orbiting scroll (50), a non-orbiting scroll (60), a rotating shaft (20), and a housing member (45) in which a bearing (48) for supporting the rotating shaft (20) is mounted, wherein the rotating shaft (20) is provided with an eccentric portion (22, 23) which is eccentric relative to the axis of rotation of the rotating shaft (20), and the orbiting scroll (50) which engages the eccentric portion (22, 23) moves orbitally around the axis of rotation of the rotating shaft (20).

More specifically, according to the third aspect of the present invention, a) the non-orbiting scroll (60) and the housing member (45) together constitute a non-orbiting member (69); b) the scroll fluid machine includes a pin shaft portion (70) which is mounted to either one or both of the non-orbiting scroll (60) and the housing member (45) which together constitute the non-orbiting member (69), and the distance from the central axis of the pin shaft portion (70) to the central axis of the rotating shaft (20) is set longer than the radius of orbital movement of the orbiting scroll (50); c) the orbiting scroll (50) is provided with a slide groove (80) for engagement with the pin shaft portion (70); and d) rotation of the orbiting scroll (50) is restricted by sliding contact of a wall surface of the slide groove (80) and the pin shaft portion (70) during orbital movement of the orbiting scroll (50).

In addition, according to the fourth aspect of the present invention, a) the non-orbiting scroll (60) and the housing member (45) together constitute a non-orbiting member (69); b) the scroll fluid machine includes a pin shaft portion (70) which is mounted to the orbiting scroll (50), and the distance from the central axis of the pin shaft portion (70) to the central axis of the eccentric portion (22, 23) is set longer than the radius of orbital movement of the orbiting scroll (50); c) either one or both of the non-orbiting scroll (60) and the housing member (45) which together constitute the non-orbiting member (69) are provided with a slide groove (80) for engagement with the pin shaft portion (70); and d) rotation of the orbiting scroll (50) is restricted by sliding contact of a wall surface of the slide groove (80) and the pin shaft portion (70) during orbital movement of the orbiting scroll (50).

The present invention provides, as a fifth aspect according to either the first or the third aspect, a scroll fluid machine in which: a) the slide groove (80) is formed in a linear shape and b) the central line of the slide groove (80) is perpendicular to both the central axis of the pin shaft portion (70) and the central axis of the eccentric portion (22, 23).

The present invention provides, as a sixth aspect according to either the first or the third aspect, a scroll fluid machine in which: a) the slide groove (80) is formed in a linear shape and b) the central line of the slide groove (80) forms an acute angle with a straight line which is perpendicular to both the central axis of the pin shaft portion (70) and the central axis of the eccentric portion (22, 23).

The present invention provides, as a seventh aspect according to either the second or the fourth aspect, a scroll fluid machine in which: a) the slide groove (80) is formed in a linear shape and b) the central line of the slide groove (80) is perpendicular to both the central axis of the pin shaft portion (70) and the central axis of the rotating shaft (20).

The present invention provides, as an eighth aspect according to either the second or the fourth aspect, a scroll fluid machine in which: a) the slide groove (80) is formed in a linear shape and b) the central line of the slide groove (80) forms an acute angle with a straight line which is perpendicular to both the central axis of the pin shaft portion (70) and the central axis of the rotating shaft (20).

The present invention provides, as a ninth aspect according to the first aspect, a scroll fluid machine in which: a) the scroll fluid machine includes a housing member (45) which is provided with a bearing (48) for supporting the rotating shaft (20), and the housing member (45) constitutes, together with the non-orbiting scroll (60), the non-orbiting member (69) and b) the pin shaft portion (70) is mounted to either one or both of the housing member (45) and the non-orbiting scroll (60).

The present invention provides, as a tenth aspect according to either the first or the third aspect, a scroll fluid machine in which: a) the orbiting scroll (50) includes an orbiting end plate portion (51) which is shaped like a flat plate and a spiral orbiting wrap (52) which is mounted in a standing manner on the orbiting end plate portion (51) and b) the slide groove (80) is a concave groove which is open at a front surface of the orbiting end plate portion (51).

The present invention provides, as an eleventh aspect according to either the first or the third aspect, a scroll fluid machine in which: a) the orbiting scroll (50) includes an orbiting end plate portion (51) which is shaped like a flat plate and a spiral orbiting wrap (52) which is mounted in a standing manner on the orbiting end plate portion (51) and b) the slide groove (80) is a groove which passes completely through the orbiting end plate portion (51) in its thickness direction.

The present invention provides, as a twelfth aspect according to the second invention, a scroll fluid machine in which: a) the scroll fluid machine includes a housing member (45) which is provided with a bearing (48) for supporting the rotating shaft (20), and the housing member (45) constitutes, together with the non-orbiting scroll (60), the non-orbiting member (69) and (b) the slide groove (80) is formed in either one of the housing member (45) and the non-orbiting scroll (60).

The present invention provides, as a thirteenth aspect according to the second aspect, a scroll fluid machine in which: a) the scroll fluid machine includes a housing member (45) which is provided with a bearing (48) for supporting the rotating shaft (20), and the housing member (45) constitutes, together with the non-orbiting scroll (60), the non-orbiting member (69) and b) the slide groove (80) is formed in both of the housing member (45) and the non-orbiting scroll (60).

The present invention provides, as a fourteenth aspect according to either the first or the third aspect, a scroll fluid machine in which: a) the pin shaft portion (70) is formed in a columnar shape and firmly secured to the non-orbiting member (69) and b) the pin shaft portion (70) has a sliding contact surface (95), formed in a circular arc shape, for sliding contact with the wall surface of the slide groove (80).

The present invention provides, as a fifteenth aspect according to the fourteenth aspect, a scroll fluid machine in which the pin shaft portion (70) is shaped such that its portion nearer to the rotating shaft (20) than the sliding contact surface (95) which slidingly contacts the wall surface of the slide groove (80) is cut away.

The present invention provides, as a sixteenth aspect according to the fifteenth aspect, a scroll fluid machine in which: a) the orbiting scroll (50) includes an orbiting end plate portion (51) which is shaped like a flat plate and a spiral orbiting wrap (52) which is mounted in a standing manner on the orbiting end plate portion (51); b) the slide groove (80) is a groove which passes completely through the orbiting end plate portion (51) in its thickness direction; and c) the distance from an end of the slide groove (80) on the side of the orbiting wrap (52) to an outer side surface of the orbiting wrap (52) is longer than twice the radius of orbital movement of the orbiting wrap (52).

The present invention provides, as a seventeenth aspect according to the fifteenth aspect, a scroll fluid machine in which: a) the pin shaft portion (70) is firmly secured to the non-orbiting scroll (60) as the non-orbiting member (69); b) the orbiting scroll (50) includes an orbiting end plate portion (51) which is shaped like a flat plate and a spiral orbiting wrap (52) which is mounted in a standing manner on the orbiting end plate portion (51); c) the slide groove (80) is a concave groove which is open at a front surface of the orbiting end plate portion (51) on the side of the orbiting wrap (52); and d) the distance from an end of the slide groove (80) on the side of the orbiting wrap (52) to an outer side surface of the orbiting wrap (52) is longer than twice the radius of orbital movement of the orbiting wrap (52).

The present invention provides, as an eighteenth aspect according to either the second or the fourth aspect, a scroll fluid machine in which: a) the pin shaft portion (70) is formed in a columnar shape and firmly secured to the orbiting scroll (50) and b) the pin shaft portion (70) has a sliding contact surface (95), formed in a circular arc shape, for sliding contact with the wall surface of the slide groove (80).

The present invention provides, as a nineteenth aspect according to the eighteenth aspect, a scroll fluid machine in which the pin shaft portion (70) is shaped such that its portion nearer to the rotating shaft (20) than the sliding contact surface (95) which slidingly contacts the wall surface of the slide groove (80) is cut away.

The present invention provides, as a twentieth aspect according to either the first or the third aspect, a scroll fluid machine in which the pin shaft portion (70) is rotatably mounted to the non-orbiting member (69).

The present invention provides, as a twenty-first aspect according to either the second or the fourth aspect, a scroll fluid machine in which the pin shaft portion (70) is rotatably mounted to the orbiting scroll (50).

The present invention provides, as a twenty-second aspect according to the twentieth aspect, a scroll fluid machine in which the pin shaft portion (70) has a flat sliding contact surface (72) for sliding contact with the wall surface of the slide groove (80).

The present invention provides, as a twenty-third aspect according to the twenty-first aspect, a scroll fluid machine in which the pin shaft portion (70) has a flat sliding contact surface (72) for sliding contact with the wall surface of the slide groove (80).

The present invention provides, as a twenty-fourth aspect according to any one of the first to fourth aspects in which the pin shaft portion (70) is composed of a body member (73) which is formed in a columnar shape and a bush member (74) which is mounted to the body member (73) and which slidingly contacts the wall surface of the slide groove (80).

The present invention provides, as a twenty-fifth aspect according to either the first or the third aspect, a scroll fluid machine in which: a) the pin shaft portion (70) is composed of a body member (73) which is formed in a columnar shape and a bush member (74) which is mounted to the body member (73) and which slidingly contacts the wall surface of the slide groove (80) and b) the body member (73) is firmly secured to the non-orbiting member (69) and the bush member (74) is rotatably mounted to the body member (73).

The present invention provides, as a twenty-sixth aspect according to either the second or the fourth aspect, a scroll fluid machine in which: a) the pin shaft portion (70) is composed of a body member (73) which is formed in a columnar shape and a bush member (74) which is mounted to the body member (73) and which slidingly contacts the wall surface of the slide groove (80) and b) the body member (73) is firmly secured to the orbiting scroll (50) and the bush member (74) is rotatably mounted to the body member (73).

The present invention provides, as a twenty-seventh aspect according to either the first or the third aspect, a scroll fluid machine in which: a) the pin shaft portion (70) is composed of a body member (73) which is formed in a columnar shape and a bush member (74) which is mounted to the body member (73) and which slidingly contacts the wall surface of the slide groove (80) and b) the body member (73) is rotatably mounted to the non-orbiting member (69) and the bush member (74) is firmly secured to the body member (73).

The present invention provides, as a twenty-eighth aspect according to either the second or the fourth aspect, a scroll fluid machine in which: a) the pin shaft portion (70) is composed of a body member (73) which is formed in a columnar shape and a bush member (74) which is mounted to the body member (73) and which slidingly contacts the wall surface of the slide groove (80) and b) the body member (73) is rotatably mounted to the orbiting scroll (50) and the bush member (74) is firmly secured to the body member (73).

The present invention provides, as a twenty-ninth aspect according to the twenty-fifth aspect, a scroll fluid machine in which the bush member (74) has a flat sliding contact surface (75) for sliding contact with the wall surface of the slide groove (80).

The present invention provides, as a thirtieth aspect according to the twenty-sixth aspect, a scroll fluid machine in which the bush member (74) has a flat sliding contact surface (75) for sliding contact with the wall surface of the slide groove (80).

The present invention provides, as a thirty-first aspect according to the twenty-seventh aspect, a scroll fluid machine in which the bush member (74) has a flat sliding contact surface (75) for sliding contact with the wall surface of the slide groove (80).

The present invention provides, as a thirty-second aspect according to the twenty-eighth aspect, a scroll fluid machine in which the bush member (74) has a flat sliding contact surface (75) for sliding contact with the wall surface of the slide groove (80).

The present invention provides, as a thirty-third aspect according to either the first or the third aspect, a scroll fluid machine in which: a) the orbiting scroll (50) includes an orbiting end plate portion (51) which is shaped like a flat plate and a spiral orbiting wrap (52) which is mounted in a standing manner on the orbiting end plate portion (51) and b) in the orbiting end plate portion (51) the slide groove (80) is formed in the vicinity of an outer peripheral side end of the orbiting wrap (52).

The present invention provides, as a thirty-fourth aspect according to either the first or the third aspect, a scroll fluid machine in which: a) the orbiting scroll (50) includes an orbiting end plate portion (51) which is shaped like a flat plate and a spiral orbiting wrap (52) which is mounted in a standing manner on the orbiting end plate portion (51) and b) in the orbiting end plate portion (51) the slide groove (80) is formed at a position further ahead of an outer peripheral side end of the orbiting wrap (52) along a direction in which the orbiting wrap (52) elongates.

The present invention provides, as a thirty-fifth aspect according to either the second or the fourth aspect, a scroll fluid machine in which: a) the orbiting scroll (50) includes an orbiting end plate portion (51) which is shaped like a flat plate and a spiral orbiting wrap (52) which is mounted in a standing manner on the orbiting end plate portion (51) and b) in the orbiting end plate portion (51) the pin shaft portion (70) is arranged in the vicinity of an outer peripheral side end of the orbiting wrap (52).

The present invention provides, as a thirty-sixth aspect according to either the second or the fourth aspect, a scroll fluid machine in which: a) the orbiting scroll (50) includes an orbiting end plate portion (51) which is shaped like a flat plate and a spiral orbiting wrap (52) which is mounted in a standing manner on the orbiting end plate portion (51) and b) in the orbiting end plate portion (51) the pin shaft portion (70) is arranged at a position further ahead of an outer peripheral side end of the orbiting wrap (52) along a direction in which the orbiting wrap (52) elongates.

The present invention provides, as a thirty-seventh aspect according to any one of the first to fourth aspects, a scroll fluid machine in which: a) the orbiting scroll (50) is provided with a spiral orbiting wrap (52) of constant thickness and b) the non-orbiting scroll (60) is provided with a spiral non-orbiting wrap (63) which gradually repeatedly increases and decreases its thickness in a direction from an inner to an outer peripheral side end thereof.

The present invention provides, as a thirty-eighth aspect according to any one of the first to fourth aspects, a scroll fluid machine in which: a) the orbiting scroll (50) is provided with a spiral orbiting wrap (52) which gradually repeatedly increases and decreases its thickness in a direction from an inner to an outer peripheral side end thereof and b) the non-orbiting scroll (60) is provided with a spiral non-orbiting wrap (63) of constant thickness.

The present invention provides, as a thirty-ninth aspect according to any one of the first to fourth aspects, a scroll fluid machine in which: a) the orbiting scroll (50) is provided with a spiral orbiting wrap (52) which gradually repeatedly increases and decreases its thickness in a direction from an inner to an outer peripheral side end thereof and b) the non-orbiting scroll (60) is provided with a spiral non-orbiting wrap (63) which gradually repeatedly increases and decreases its thickness in a direction from an inner to an outer peripheral side end thereof.

The present invention provides, as a fortieth aspect according to any one of the first to fourth aspects, a scroll fluid machine in which: a) the non-orbiting scroll (60) is provided with a spiral non-orbiting wrap (63) and the orbiting scroll (50) is provided with a spiral orbiting wrap (52) and b) the non-orbiting wrap (63) has an outer peripheral side end which is elongated to near an outer peripheral side end of the orbiting wrap (52).

According to either a forty-first or a forty-second aspect of the present invention, there is provided a fluid machine of the scroll type which comprises a movable scroll (50), a crank (20) having an eccentric pin (22) for engagement with the movable scroll (50), and a fixed side member (69) which comprises at least a fixed scroll (60), wherein the movable scroll (50) moves orbitally around the central axis of the crank (20).

More specifically, according to the forty-first aspect of the present invention, a) the scroll fluid machine includes a pin shaft portion (70) which is mounted to the fixed side member (69), and the distance from the central axis of the pin shaft portion (70) to the central axis of the crank (20) is set longer than the radius of orbital movement of the movable scroll (50); b) the movable scroll (50) is provided with a slide groove (80) for engagement with the pin shaft portion (70); and c) rotation of the movable scroll (50) is restricted by sliding contact of a wall surface of the slide groove (80) and the pin shaft portion (70) during orbital movement of the movable scroll (50).

In addition, according to the forty-second aspect of the present invention, a) the scroll fluid machine includes a pin shaft portion (70) which is mounted to the movable scroll (50), and the distance from the central axis of the pin shaft portion (70) to the central axis of the eccentric pin (22) is set longer than the radius of orbital movement of the movable scroll (50); b) the fixed side member (69) is provided with a slide groove (80) for engagement with the pin shaft portion (70); and c) rotation of the movable scroll (50) is restricted by sliding contact of a wall surface of the slide groove (80) and the pin shaft portion (70) during orbital movement of the movable scroll (50).

The present invention provides, as a forty-third aspect according to the forty-first aspect, a scroll fluid machine in which: a) the slide groove (80) is formed in a linear shape and b) the central line of the slide groove (80) is perpendicular to both the central axis of the pin shaft portion (70) and the central axis of the eccentric pin (22).

The present invention provides, as a forty-fourth aspect according to the forty-first aspect, a scroll fluid machine in which: a) the slide groove (80) is formed in a linear shape and b) the central line of the slide groove (80) forms an acute angle with a straight line which is perpendicular to both the central axis of the pin shaft portion (70) and the central axis of the eccentric pin (22).

The present invention provides, as a forty-fifth aspect according to the forty-second aspect, a scroll fluid machine in which: a) the slide groove (80) is formed in a linear shape and b) the central line of the slide groove (80) is perpendicular to both the central axis of the pin shaft portion (70) and the central axis of the crank (20).

The present invention provides, as a forty-sixth aspect according to the forty-second aspect, a scroll fluid machine in which: a) the slide groove (80) is formed in a linear shape and b) the central line of the slide groove (80) forms an acute angle with a straight line which is perpendicular to both the central axis of the pin shaft portion (70) and the central axis of the crank (20).

The present invention provides, as a forty-seventh aspect according to the forty-first aspect, a scroll fluid machine in which: a) the scroll fluid machine includes a housing member (45) which is provided with a bearing (48) for supporting the crank (20), and the housing member (45) constitutes, together with the fixed scroll (60), the fixed side member (69) and b) the pin shaft portion (70) is mounted to either one or both of the housing member (45) and the fixed scroll (60).

The present invention provides, as a forty-eighth aspect according to the forty-first aspect, a scroll fluid machine in which: a) the movable scroll (50) includes a movable side end plate portion (51) which is shaped like a flat plate and a spiral movable side wrap (52) which is mounted in a standing manner on the movable side end plate portion (51) and b) the slide groove (80) is a concave groove which is open at a front surface of the movable side end plate portion (51).

The present invention provides, as a forty-ninth aspect according to the forty-first aspect, a scroll fluid machine in which: a) the movable scroll (50) includes a movable side end plate portion (51) which is shaped like a flat plate and a spiral movable side wrap (52) which is mounted in a standing manner on the movable side end plate portion (51) and b) the slide groove (80) is a groove which passes completely through the movable side end plate portion (51) in its thickness direction.

The present invention provides, as a fiftieth aspect according to the forty-second aspect, a scroll fluid machine in which: a) the scroll fluid machine includes a housing member (45) which is provided with a bearing (48) for supporting the crank (20), and the housing member (45) constitutes, together with the fixed scroll (60), the fixed side member (69) and b) the slide groove (80) is formed in either one of the housing member (45) and the fixed scroll (60).

The present invention provides, as a fifty-first aspect according to the forty-second aspect, a scroll fluid machine in which: a) the scroll fluid machine includes a housing member (45) which is provided with a bearing (48) for supporting the crank (20), and the housing member (45) constitutes, together with the fixed scroll (60), the fixed side member (69) and b) the slide groove (80) is formed in both of the housing member (45) and the fixed scroll (60).

The present invention provides, as a fifty-second aspect according to the forty-first aspect, a scroll fluid machine in which the pin shaft portion (70) is formed in a cylindrical shape and firmly secured to the fixed side member (69).

The present invention provides, as a fifty-third aspect according to the forty-second aspect, a scroll fluid machine in which the pin shaft portion (70) is formed in a cylindrical shape and firmly secured to the movable scroll (50).

The present invention provides, as a fifty-fourth aspect according to the forty-first aspect, a scroll fluid machine in which the pin shaft portion (70) is rotatably mounted to the fixed side member (69).

The present invention provides, as a fifty-fifth aspect according to the forty-second aspect, a scroll fluid machine in which the pin shaft portion (70) is rotatably mounted to the movable scroll (50).

The present invention provides, as a fifty-sixth aspect according to either the fifty-fourth or the fifty-fifth aspect, a scroll fluid machine in which the pin shaft portion (70) has a flat sliding contact surface (72) for sliding contact with the wall surface of the slide groove (80).

The present invention provides, as a fifty-seventh aspect according to either the forty-first or the forty second aspect, a scroll fluid machine in which the pin shaft portion (70) is composed of a body member (73) which is formed in a columnar shape and a bush member (74) which is mounted to the body member (73) and which slidingly contacts the wall surface of the slide groove (80).

The present invention provides, as a fifty-eighth aspect according to the forty-first aspect, a scroll fluid machine in which: a) the pin shaft portion (70) is composed of a body member (73) which is formed in a columnar shape and a bush member (74) which is mounted to the body member (73) and which slidingly contacts the wall surface of the slide groove (80) and b) the body member (73) is firmly secured to the fixed side member (69) and the bush member (74) is rotatably mounted to the body member (73).

The present invention provides, as a fifty-ninth aspect according to the forty-second aspect, a scroll fluid machine in which: a) the pin shaft portion (70) is composed of a body member (73) which is formed in a columnar shape and a bush member (74) which is mounted to the body member (73) and which slidingly contacts the wall surface of the slide groove (80) and b) the body member (73) is firmly secured to the movable scroll (50) and the bush member (74) is rotatably mounted to the body member (73).

The present invention provides, as a sixtieth aspect according to the forty-first aspect, a scroll fluid machine in which: a) the pin shaft portion (70) is composed of a body member (73) which is formed in a columnar shape and a bush member (74) which is mounted to the body member (73) and which slidingly contacts the wall surface of the slide groove (80) and b) the body member (73) is rotatably mounted to the fixed side member (69) and the bush member (74) is firmly secured to the body member (73).

The present invention provides, as a sixty-first aspect according to the forty-second aspect, a scroll fluid machine in which: a) the pin shaft portion (70) is composed of a body member (73) which is formed in a columnar shape and a bush member (74) which is mounted to the body member (73) and which slidingly contacts the wall surface of the slide groove (80) and b) the body member (73) is rotatably mounted to the movable scroll (50) and the bush member (74) is firmly secured to the body member (73).

The present invention provides, as a sixty-second aspect according to any one of the fifty-eighth to sixty-first aspects, a scroll fluid machine in which the bush member (74) has a flat sliding contact surface (75) for sliding contact with the wall surface of the slide groove (80).

The present invention provides, as a sixty-third aspect according to the forty-first aspect, a scroll fluid machine in which: a) the movable scroll (50) includes a movable side end plate portion (51) which is shaped like a flat plate and a spiral movable side wrap (52) which is mounted in a standing manner on the movable side end plate portion (51) and b) in the movable side end plate portion (51) the slide groove (80) is formed in the vicinity of an outer peripheral side end of the movable side wrap (52).

The present invention provides, as a sixty-fourth aspect according to the forty-second aspect, a scroll fluid machine in which: a) the movable scroll (50) includes a movable side end plate portion (51) which is shaped like a flat plate and a spiral movable side wrap (52) which is mounted in a standing manner on the movable side end plate portion (51) and b) in the movable side end plate portion (51) the pin shaft portion (70) is arranged in the vicinity of an outer peripheral side end of the movable side wrap (52).

The present invention provides, as a sixty-fifth aspect according to either the forty-first or the forty-second aspect, a scroll fluid machine in which: a) the movable scroll (50) is provided with a spiral movable side wrap (52) of constant thickness and b) the fixed scroll (60) is provided with a spiral fixed side wrap (63) which gradually repeatedly increases and decreases its thickness in a direction from an inner to an outer peripheral side end thereof.

The present invention provides, as a sixty-sixth aspect according to either the forty-first or the forty-second aspect, a scroll fluid machine in which: a) the movable scroll (50) is provided with a spiral movable side wrap (52) which gradually repeatedly increases and decreases its thickness in a direction from an inner to an outer peripheral side end thereof and b) the fixed scroll (60) is provided with a spiral fixed side wrap (63) of constant thickness.

The present invention provides, as a sixty-seventh aspect according to either the forty-first or the forty-second aspect, a scroll fluid machine in which: a) the movable scroll (50) is provided with a spiral movable side wrap (52) which gradually repeatedly increases and decreases its thickness in a direction from an inner to an outer peripheral side end thereof and b) the fixed scroll (60) is provided with a spiral fixed side wrap (63) which gradually repeatedly increases and decreases its thickness in a direction from an inner to an outer peripheral side end thereof.

The present invention provides, as a sixty-eighth aspect according to either the forty-first or the forty-second aspect, a scroll fluid machine in which: a) the fixed scroll (60) is provided with a spiral fixed side wrap (63) and the movable scroll (50) is provided with a spiral movable side wrap (52) and b) the fixed side wrap (63) has an outer peripheral side end which is elongated to near an outer peripheral side end of the movable side wrap (52).

Working

In each of the first to fourth aspects of the present invention, the orbiting scroll (50) engages the rotating shaft (20). Upon rotation of the rotating shaft (20), the orbiting scroll (50) orbitally moves around the central axis of the rotating shaft (20). The radius of orbital movement of the orbiting scroll (50) becomes equal to the amount of eccentricity of the eccentric portion (22, 23), i.e., the distance between the central axis of the rotating shaft (20) and the central axis of the eccentric portion (22, 23), in the rotating shaft (20).

In addition, in the scroll fluid machine (10) of each of the first and second aspects of the present invention, at least the non-orbiting scroll (60) is provided as a non-orbiting member (69). In addition to the non-orbiting scroll (60), the scroll fluid machine (10) may be provided with another member as a non-orbiting member (69). Besides, in the scroll fluid machine (10) of each of the third and fourth aspects of the present invention, the non-orbiting scroll (60) and the housing member (45) are provided as non-orbiting members (69).

In the first aspect of the present invention, the non-orbiting member (69) is provided with the pin shaft portion (70) and the slide groove (80) which engages the pin shaft portion (70) is formed in the orbiting scroll (50). In addition, in the third aspect of the present invention, the pin shaft portion (70) is provided in either one or both of the non-orbiting scroll (60) which constitutes the non-orbiting member (69) and the housing member (45), and the slide groove (80) for engagement with the pin shaft portion (70) is formed in the orbiting scroll (50).

In the non-orbiting member (69) of each of the first and third aspects, the pin shaft portion (70) is arranged such that the distance from its central axis to the central axis of the rotating shaft (20) becomes longer than the radius of orbital movement of the orbiting scroll (50). Consequently, the orbiting scroll (50) revolves, with the slide groove (80) formed therein in engagement with the pin shaft portion (70). During orbital movement of the orbiting scroll (50), the wall surface of the slide groove (80) slidingly contacts the pin shaft portion (70), and the orbiting scroll (50) in which the slide groove (80) is formed is guided by the pin shaft portion (70). And, the orbiting scroll (50) is guided by the pin shaft portion (70) which engages the slide groove (80), thereby restricting rotation of the orbiting scroll (50). It should be noted, however, that the orbiting scroll (50) is not completely prevented from rotating, in other words the orbiting scroll (50) is allowed to rotate to some extent.

In the second aspect of the present invention, the orbiting scroll (50) is provided with the pin shaft portion (70) and the slide groove (80) which engages the pin shaft portion (70) is formed in the non-orbiting member (69). In addition, in the fourth aspect of the present invention, the orbiting scroll (50) is provided with the pin shaft portion (70), and the slide groove (80) which engages the pin shaft portion (70) is formed in either one or both of the non-orbiting scroll (60) and the housing (45) which together constitute the non-orbiting member (69).

In the orbiting scroll (50) of each of the second and fourth aspects of the present invention, the pin shaft portion (70) is arranged such that the distance from its central axis to the central axis of the eccentric portion (22, 23) becomes longer than the radius of orbital movement of the orbiting scroll (50). As a result, the orbiting scroll (50) revolves, with the pin shaft portion (70) formed therein in engagement with the slide groove (80). During orbital movement of the orbiting scroll (50), the side surface of the slide groove (80) slidingly contacts the pin shaft portion (70), and the pin shaft portion (70) provided in the orbiting scroll (50) is guided by the slide groove (80). And, the orbiting scroll (50) provided with the pin shaft portion (70) is guided by the slide groove (80), thereby restricting rotation of the orbiting scroll (50). It should be noted, however, that the orbiting scroll (50) is not completely prevented from rotating, in other words the orbiting scroll (50) is allowed to rotate to some extent.

In each of the fifth and sixth aspects of the present invention, the slide groove (80) formed in the orbiting scroll (50) has a linear shape. The slide groove (80) has a flat side surface which slidingly contacts the pin shaft portion (70).

In the fifth aspect of the present invention, the central line of the slide groove (80) lies perpendicular to both the central axis of the pin shaft portion (70) and the central axis of the eccentric portion (22, 23). Stated another way, in the present aspect, the angle formed between a straight line which is perpendicular to both the central axis of the pin shaft portion (70) and the central axis of the eccentric portion (22, 23) and the central line of the slide groove (80) is zero degrees.

On the other hand, in the sixth aspect of the present invention, the central line of the slide groove (80) forms an acute angle with a straight line which lies perpendicular to both the central axis of the pin shaft portion (70) and the central axis of the eccentric portion (22, 23). Stated another way, in the present aspect, the angle formed between the straight line which is perpendicular to both the central axis of the pin shaft portion (70) and the central axis of the eccentric portion (22, 23) and the central line of the slide groove (80) falls below 90 degrees.

In each of the seventh and eighth aspects of the present invention, the slide groove (80) formed in the non-orbiting member (69) has a linear shape. The slide groove (80) has a flat side surface which slidingly contacts the pin shaft portion (70).

In the seventh aspect of the present invention, the central line of the slide groove (80) lies perpendicular to both the central axis of the pin shaft portion (70) and the central axis of the rotating shaft (20). Stated another way, in the present aspect, the angle formed between a straight line which is perpendicular to both the central axis of the pin shaft portion (70) and the central axis of the rotating shaft (20) and the central line of the slide groove (80) is zero degrees.

On the other hand, in the eighth aspect of the present invention, the central line of the slide groove (80) forms an acute angle with a straight line which lies perpendicular to both the central axis of the pin shaft portion (70) and the central axis of the rotating shaft (20). Stated another way, in the present aspect, the angle formed between the straight line which is perpendicular to both the central axis of the pin shaft portion (70) and the central axis of the rotating shaft (20) and the central line of the slide groove (80) falls below 90 degrees.

In the ninth aspect of the present invention, the scroll fluid machine (10) is provided with the housing member (45) as the non-orbiting member (69). In the scroll fluid machine (10), the non-orbiting scroll (60) and the housing member (45) together constitute the non-orbiting member (69). The pin shaft portion (70) is mounted to either one or both of the housing member (45) and the non-orbiting scroll (60). In other words, the pin shaft portion (70) may be mounted either to only the housing member (45) or to only the non-orbiting scroll (60). In addition, it may be arranged such that one end of the pin shaft portion (70) is attached to the housing member (45) while the other end thereof is attached to the non-orbiting scroll (60). Furthermore, the housing member (45) and the non-orbiting scroll (60) may be each provided with the pin shaft portion (70) at their opposed positions.

In the tenth aspect of the present invention, the slide groove (80) is formed in the orbiting end plate portion (51) of the orbiting scroll (50). The slide groove (80) is formed in a concave groove shape and is open at a surface of the orbiting end plate portion (51). In other words, the slide groove (80) is a groove with a bottom which is open at the front surface on which the orbiting wrap (52) is mounted in a standing manner or at the back surface opposite to the orbiting wrap (52).

In the eleventh aspect of the present invention, the slide groove (80) is formed in the orbiting end plate portion (51) of the orbiting scroll (50). The slide groove (80) is a groove which passes completely through the orbiting end plate portion (51) in its thickness direction. In other words, the slide groove (80) is a groove formed by grooving a portion of the orbiting end plate portion (51).

In each of the twelfth and thirteenth aspects of the present invention, the scroll fluid machine (10) is provided with the housing member (45) as the non-orbiting member (69). In the scroll fluid machine (10), the non-orbiting scroll (60) and the housing member (45) together constitute the non-orbiting member (69). In the twelfth aspect of the present invention, the slide groove (80) is formed in either one of the housing member (45) and the non-orbiting scroll (60). On the other hand, in the thirteenth aspect of the present invention, the slide groove (80) is formed in both of the housing member (45) and the non-orbiting scroll (60).

In the fourteenth aspect of the present invention, the pin shaft portion (70) formed in a columnar shape is firmly secured to the non-orbiting member (69). In other words, the pin shaft portion (70) is mounted by press fitting or some like technique to the non-orbiting member (69) so that its relative movement with respect to the non-orbiting member (69) is forbidden. In the columnar pin shaft portion (70), a portion of its side surface which slidingly contacts the wall surface of the slide groove (89) is a circular arc surface, in other words the sliding contact surface (95) is a circular arc surface. By sliding contact of the sliding contact surface (95) which is a circular arc surface with the wall surface of the slide groove (80), rotation of the orbiting scroll (50) is restricted.

In the fifteenth aspect of the present invention, the pin shaft portion (70) is formed in a shape with a cutaway portion. More specifically, the pin shaft portion (70) is shaped such that its portion nearer to the rotating shaft (20) than the sliding contact surface (95) which slidingly contacts the wall surface of the slide groove (80) (i.e., the portion nearer to the center of the orbiting and non-orbiting scrolls (50, 60) than the sliding contact surface (95)) is cut away.

In the sixteenth aspect of the present invention, the slide groove (80) passes completely through the orbiting end plate portion (51). In addition, in the seventeenth aspect of the present invention, the slide groove (80) is formed in a concave groove shape and is formed in a front surface of the orbiting end plate portion (51) on the side of the orbiting wrap (52). In other words, in the orbiting scroll (50) of each of these aspects of the present invention, the slide groove (80) is open at the front surface of the orbiting end plate portion (51) on the side of the orbiting wrap (52). In addition, in each of these aspects of the present invention, an end of the slide groove (80) on the side of the orbiting wrap (52) is located at a position spaced more than a distance of twice the radius of orbital movement of the orbiting wrap (52) apart from the outer side surface on the side of the orbiting wrap (52).

In the eighteenth aspect of the present invention, the pin shaft portion (70) formed in a columnar shape is firmly secured to the orbiting scroll (50). In other words, the pin shaft portion (70) is mounted by press fitting or some like technique to the orbiting scroll (50) so that its relative movement with respect to the orbiting scroll (50) is forbidden. In the columnar pin shaft portion (70), a portion of its side surface which slidingly contacts the wall surface of the slide groove (89) is a circular arc surface, in other words the sliding contact surface (95) is a circular arc surface. By sliding contact of the sliding contact surface (95) which is a circular arc surface with the wall surface of the slide groove (80), rotation of the orbiting scroll (50) is restricted.

In the nineteenth aspect of the present invention, the pin shaft portion (70) is formed in a shape with a cutaway portion. More specifically, the pin shaft portion (70) is shaped such its portion nearer to the rotating shaft (20) than the sliding contact surface (95) which slidingly contacts the wall surface of the slide groove (80) (i.e., the portion nearer to the center of the orbiting and non-orbiting scrolls (50, 60) than the sliding contact surface (95)) is cut away.

In the twentieth aspect of the present invention, the pin shaft portion (70) mounted to the non-orbiting member (69) is rotatable relative to the non-orbiting member (69). In addition, in the twenty-first aspect of the present invention, the pin shaft portion (70) mounted to the orbiting scroll (50) is rotatable relative to the orbiting scroll (50). In other words, in these aspects of the present invention, the pin shaft portion (70) is allowed to rotate when it slidingly contacts the side surface of the slide groove (80).

In each of the twenty-second and twenty-third aspects of the present invention, the pin shaft portion (70) has the sliding contact surface (72) which is a flat surface. During orbital movement of the orbiting scroll (50), the sliding contact surface (72) of the pin shaft portion (70) slidingly contacts the side surface of the slide groove (80) while simultaneously the pin shaft portion (70) rotates. A force for restricting rotation of the orbiting scroll (50) acts on the sliding contact surface (72) of the pin shaft portion (70).

In each of the twenty-fourth to twenty-eighth aspects of the present invention, the pin shaft portion (70) is made up of the body member (73) and the bush member (74). In the pin shaft portion (70), the body member (73) is formed in a columnar shape, and the bush member (74) is mounted to the body member (73). The bush member (74) of the pin shaft portion (70) slidingly contacts the wall surface of the slide groove (80).

In the twenty-fourth aspect of the present invention, the body member (73) is mounted to the member to which the pin shaft portion (70) is to be mounted. In other words, when employing the arrangement that the pin shaft portion (70) is mounted to the non-orbiting member (69), the body member (73) is mounted to the non-orbiting member (69), while when employing the arrangement that the pin shaft portion (70) is mounted to the orbiting scroll (50), the orbiting scroll (50) is mounted to the non-orbiting member (69).

In the twenty-fifth aspect of the present invention, the body member (73) formed in a columnar shape is firmly secured to the non-orbiting member (69). In other words, the body member (73) is mounted by means of press fitting or some like technique to the non-orbiting member (69) so that its relative movement with respect to the non-orbiting member (69) is forbidden. On the other hand, in the twenty-sixth aspect of the present invention, the body member (73) formed in a columnar shape is firmly secured to the orbiting scroll (50). In other words, the body member (73) is mounted by means of press fitting or some like technique to the orbiting scroll (50) so that its relative movement with respect to the orbiting scroll (50) is forbidden. In each of the twenty-fifth and twenty-sixth aspects of the present invention, the bush member (74) is rotatably mounted to the body member (73). During orbital movement of the orbiting scroll (50), the bush member (74) slidingly contacts the side wall of the slide groove (80) and is allowed to rotate.

In the twenty-seventh aspect of the present invention, the body member (73) formed in a columnar shape is mounted to the non-orbiting member (69). The body member (73) is rotatable relative to the non-orbiting member (69). In the twenty-eighth aspect of the present invention, the body member (73) formed in a columnar shape is mounted to the orbiting scroll (50). The body member (73) is rotatable relative to the orbiting scroll (50). In each of the twenty-seventh and twenty-eighth aspects of the present invention, the bush member (74) is firmly secured to the body member (73). In other words, the bush member (74) is mounted by means of press fitting or some like technique to the body member (73) so that its relative movement with respect to the body member (73) is forbidden. The bush member (74) firmly secured to the body member (73) is rotatable together with the body member (73).

In each of the twenty-ninth to thirty-second aspects of the present invention, the bush member (74) has the sliding contact surface (75) which is a flat surface. During orbital movement of the orbiting scroll (50), the sliding contact surface (75) of the bush member (74) slidingly contacts the side surface of the slide groove (80). A force for restricting rotation of the orbiting scroll (50) acts on the sliding contact surface (75) of the bush member (74).

In the thirty-third aspect of the present invention, the slide groove (80) is formed in the orbiting end plate portion (51) of the orbiting scroll (50). In the orbiting end plate portion (51), the slide groove (80) is arranged in the vicinity of the outer peripheral side end of the orbiting wrap (52). And, the slide groove (80) formed in the orbiting scroll (50) engages the pin shaft portion (70) mounted to the non-orbiting member (69).

In the thirty-fourth aspect of the present invention, the slide groove (80) is formed in the orbiting end plate portion (51) of the orbiting scroll (50). In the orbiting end plate portion (51), the slide groove (80) is formed at a position further ahead of the outer peripheral side end of the orbiting wrap (52).

In the thirty-fifth aspect of the present invention, the pin shaft portion (70) is mounted to the orbiting end plate portion (51) of the orbiting scroll (50). In the orbiting end plate portion (51), the pin shaft portion (70) is arranged in the vicinity of the outer peripheral side end of the orbiting wrap (52). And, the pin shaft portion (70) mounted to the orbiting scroll (50) engages the slide groove (80) formed in the non-orbiting member (69).

In the thirty-sixth aspect of the present invention, the pin shaft portion (70) is mounted to the orbiting end plate portion (51) of the orbiting scroll (50). In the orbiting end plate portion (51), the pin shaft portion (70) is provided at a position further ahead of the outer peripheral side end of the orbiting wrap (52).

In the thirty-seventh aspect of the present invention, the orbiting wrap (52) is of constant thickness. In other words, the orbiting wrap (52) has the same shape as its counterpart in a scroll fluid machine of the general type whose movable scroll is completely forbidden to rotate. On the other hand, the non-orbiting wrap (63) is shaped such that it is gradually repeatedly increased and decreased in thickness in the direction from the inner to the outer peripheral side end thereof.

In the thirty-eighth aspect of the present invention, the non-orbiting wrap (63) is of constant thickness. In other words, the non-orbiting wrap (63) has the same shape as its counterpart in a scroll fluid machine of the general type machine whose movable scroll is completely forbidden to rotate. On the other hand, the orbiting wrap (52) is shaped such that it is gradually repeatedly increased and decreased in thickness in the direction from the inner to the outer peripheral side end thereof.

In the thirty-ninth aspect of the present invention, the orbiting wrap (52) is shaped such that it is gradually repeatedly increased and decreased in thickness in the direction from the inner to the outer peripheral side end thereof.

In the fortieth aspect of the present invention, the outer peripheral side end of the non-orbiting wrap (63) is elongated to near the outer peripheral side end of the orbiting wrap (52). In other words, the length from the inner to the outer peripheral side end of the non-orbiting wrap (63) is longer than the length from the inner to the outer peripheral side end of the orbiting wrap (52). In a scroll fluid machine of the general type, fluid chambers (41) are formed in pairs on the inner and outer peripheral sides of the orbiting wrap (52). In the scroll fluid machine (10) of the present aspect, the non-orbiting wrap (63) is longer than the orbiting wrap (52), and the fluid chamber (41) defined on the outer peripheral side of the orbiting wrap (52) has a greater maximum volume than the fluid chamber (41) defined on the inner peripheral side of the orbiting wrap (52).

In each of the forty-first and forty-second aspects of the present invention, the movable scroll (50) engages the eccentric pin (22) of the crank (20). Upon rotation of the crank (20), the movable scroll (50) moves orbitally around the central axis of the crank (20). The radius of orbital movement of the movable scroll (50) becomes equal to the amount of eccentricity of the eccentric pin (22), i.e., the distance between the central axis of the crank (20) and the central axis of the eccentric pin (22), in the crank (20). In addition, in the scroll fluid machine (10) of each of these aspects of the present invention, at least the fixed scroll (60) is provided as the fixed side member (69). The scroll fluid machine (10) is, in addition to the fixed scroll (60), provided with another member as the fixed side member (69).

In the forty-first aspect of the present invention, the fixed side member (69) is provided with the pin shaft portion (70), and the slide groove (80) which engages the pin shaft portion (70) is formed in the movable scroll (50). In the fixed side member (69), the pin shaft portion (70) is arranged such that the distance from its central axis to the central axis of the crank (20) is longer than the radius of orbital movement of the movable scroll (50). Consequently, the movable scroll (50) revolves, with the slide groove (80) formed therein in engagement with the pin shaft portion (70). During orbital movement of the movable scroll (50), the side surface of the slide groove (80) slidingly contacts the pin shaft portion (70), and the movable scroll (50) in which the slide groove (80) is formed is guided by the pin shaft portion (70). And, the movable scroll (50) is guided by the pin shaft portion (70) which engages the slide groove (80), thereby restricting rotation of the movable scroll (50). It should be noted, however, that the movable scroll (50) is not completely prevented from rotating in the present aspect, in other words the movable scroll (50) is allowed to rotate to some extent.

In the forty-second aspect of the present invention, the movable scroll (50) is provided with the pin shaft portion (70), and the slide groove (80) which engages the pin shaft portion (70) is formed in the fixed side member (69). In the movable scroll (50), the pin shaft portion (70) is arranged such that the distance from its central axis to the central axis of the eccentric pin (22) is longer than the radius of orbital movement of the movable scroll (50). Consequently, the movable scroll (50) revolves, with the pin shaft portion (70) formed therein in engagement with the slide groove (80). During orbital movement of the movable scroll (50), the pin shaft portion (70) slidingly contacts the side surface of the slide groove (80), and the pin shaft portion (70) provided in the movable scroll (50) is guided by the slide groove (80). And, the movable scroll (50) provided with the pin shaft portion (70) is guided by the slide groove (80), thereby restricting rotation of the movable scroll (50). It should be noted, however, that the movable scroll (50) is not completely prevented from rotating in the present aspect, in other words the movable scroll (50) is allowed to rotate to some extent.

In each of the forty-third and forty-fourth aspects of the present invention, the slide groove (80) which is formed in the movable scroll (50) is formed in a linear shape. The slide groove (80) has a flat side surface, and the side surface of the slide groove (80) slidingly contacts the pin shaft portion (70).

In the forty-third aspect of the present invention, the central line of the slide groove (80) lies perpendicular to both the central axis of the pin shaft portion (70) and the central axis of the eccentric pin (22). In other words, in the present aspect, the angle formed between a straight line which is perpendicular to both the central axis of the pin shaft portion (70) and the central axis of the eccentric pin (22) and the central line of the slide groove (80) is zero degrees.

On the other hand, in the forty-fourth aspect of the present invention, the central line of the slide groove (80) forms an acute angle with a straight line which is perpendicular to both the central axis of the pin shaft portion (70) and the central axis of the eccentric pin (22). In other words, in the present aspect, the angle formed between the straight line which is perpendicular to both the central axis of the pin shaft portion (70) and the central axis of the eccentric pin (22) and the central line of the slide groove (80) falls below 90 degrees.

In each of the forty-fifth and forty-sixth aspects of the present invention, the slide groove (80) which is formed in the fixed side member (69) is formed in a linear shape. The slide groove (80) has a flat side surface, and the side surface of the slide groove (80) slidingly contacts the pin shaft portion (70).

In the forty-fifth aspect of the present invention, the central line of the slide groove (80) lies perpendicular to both the central axis of the pin shaft portion (70) and the central axis of the crank (20). In other words, the angle formed between the straight line which is perpendicular to both the central axis of the pin shaft portion (70) and the central axis of the crank (20) and the central line of the slide groove (80) is zero degrees.

On the other hand, in the forty-sixth aspect of the present invention, the central line of the slide groove (80) forms an acute angle with a straight line which is perpendicular to both the central axis of the pin shaft portion (70) and the central axis of the crank (20). In other words, in the present aspect, the angle formed between the straight line which is perpendicular to both the central axis of the pin shaft portion (70) and the central axis of the crank (20) and the central line of the slide groove (80) falls below 90 degrees.

In the forty-seventh aspect of the present invention, the scroll fluid machine (10) is provided with the housing member (45) as the fixed side member (69). In the scroll fluid machine (10), the fixed scroll (60) and the housing member (45) together constitute the fixed side member (69). The pin shaft portion (70) is mounted to either one or both of the housing member (45) and the fixed scroll (60). In other words, the pin shaft portion (70) may be mounted either to only the housing member (45) or to only the fixed scroll (60). In addition, it may be arranged such that one end of the pin shaft portion (70) is attached to the housing member (45) while the other end thereof is attached to the fixed scroll (60). Furthermore, the housing member (45) and the fixed scroll (60) may be each provided with the pin shaft portion (70) at their opposed positions.

In the forty-eighth aspect of the present invention, the slide groove (80) is formed in the movable side end plate portion (51) of the movable scroll (50). The slide groove (80) is formed in a concave groove shape and is open at a front surface of the movable side end plate portion (51). In other words, the slide groove (80) is a groove with a bottom which is open at the front surface on which the movable side wrap (52) is mounted in a standing manner or at the back surface opposite to the movable side wrap (52).

In the forty-ninth aspect of the present invention, the slide groove (80) is formed in the movable side end plate portion (51) of the movable scroll (50). The slide groove (80) is a groove which passes completely through the movable side end plate portion (51) in its thickness direction. In other words, the slide groove (80) is a groove formed by grooving a portion of the movable side end plate portion (51).

In each of the fiftieth and fifty-first aspects of the present invention, the scroll fluid machine (10) is provided with the housing member (45) as the fixed side member (69). In the scroll fluid machine (10), the fixed scroll (60) and the housing member (45) together constitute the fixed side member (69). In the fiftieth aspect of the present invention, the slide groove (80) is formed in either one of the housing member (45) and the fixed scroll (60). On the other hand, in the fifty-first aspect of the present invention, the slide groove (80) is formed in both of the housing member (45) and the fixed scroll (60).

In the fifty-second aspect of the present invention, the pin shaft portion (70) formed in a cylindrical shape is firmly secured to the fixed side member (69). In other words, the pin shaft portion (70) is mounted by means of press fitting or some like technique to the fixed side member (69) so that its relative movement with respect to the fixed side member (69) is forbidden. In addition, in the fifty-third aspect of the present invention, the pin shaft portion (70) formed in a cylindrical shape is firmly secured to the movable scroll (50). In other words, the pin shaft portion (70) is mounted by means of press fitting or some like technique to the movable scroll (50) so that its relative movement with respect to the movable scroll (50) is forbidden. And, in each of these aspects of the present invention, the side surface of the pin shaft portion (70) formed in a cylindrical shape, i.e., the curved surface of the pin shaft portion (70), slidingly contacts the side surface of the slide groove (80).

In the fifty-fourth aspect of the present invention, the pin shaft portion (70) mounted to the fixed side member (69) is rotatable relative to the fixed side member (69). In addition, in the fifty-fifth aspect of the present invention, the pin shaft portion (70) mounted to the movable scroll (50) is rotatable relative to the movable scroll (50). In other words, in each of these aspects of the present invention, the pin shaft portion (70) is allowed to rotate when it slidingly contacts the side surface of the slide groove (80).

In the fifty-sixth aspect of the present invention, the pin shaft portion (70) has the sliding contact surface (72) which is a flat surface. During orbital movement of the movable scroll (50), the sliding contact surface (72) of the pin shaft portion (70) slidingly contacts the side surface of the slide groove (80) while simultaneously the pin shaft portion (70) rotates. A force for restricting rotation of the movable scroll (50) acts on the sliding contact surface (72) of the pin shaft portion (70).

In each of the fifty-seventh to sixty-first aspects of the present invention, the pin shaft portion (70) is made up of the body member (73) and the bush member (74). In the pin shaft portion (70), the body member (73) is formed in a columnar shape, and the bush member (74) is mounted to the body member (73). The bush member (74) of the pin shaft portion (70) slidingly contacts the wall surface of the slide groove (80).

In the fifty-seventh aspect of the present invention, the body member (73) is mounted to the member to which the pin shaft portion (70) is to be mounted. In other words, when employing the arrangement that the pin shaft portion (70) is mounted to the fixed side member (69), the body member (73) is mounted to the fixed side member (69), while, when employing the arrangement that the pin shaft portion (70) is mounted to the movable scroll (50), the movable scroll (50) is mounted to the fixed side member (69).

In the fifty-eighth aspect of the present invention, the body member (73) formed in a columnar shape is firmly secured to the fixed side member (69). In other words, the body member (73) is mounted by means of press fitting or some like technique to the fixed side member (69) so that its relative movement with respect to the fixed side member (69) is forbidden. On the other hand, in the fifty-ninth aspect of the present invention, the body member (73) formed in a columnar shape is firmly secured to the movable scroll (50). In other words, the body member (73) is mounted by means of press fitting or some like technique to the movable scroll (50) so that its relative movement with respect to the movable scroll (50) is forbidden. In each of these aspects of the present invention, the bush member (74) is rotatably mounted to the body member (73). During orbital movement of the movable scroll (50), the bush member (74) slidingly contacts the side wall of the slide groove (80) and is allowed to rotate.

In the sixtieth aspect of the present invention, the body member (73) formed in a columnar shape is mounted to the fixed side member (69). The body member (73) is rotatable relative to the fixed side member (69). In the sixty-first aspect of the present invention, the body member (73) formed in a columnar shape is mounted to the movable scroll (50). The body member (73) is rotatable relative to the movable scroll (50). In each of the sixtieth and sixty-first aspects of the present invention, the bush member (74) is firmly secured to the body member (73). In other words, the bush member (74) is mounted by means of press fitting or some like technique to the body member (73) so that its relative movement with respect to the body member (73) is forbidden. The bush member (74) firmly secured to the body member (73) is rotatable together with the body member (73).

In the sixty-second aspect of the present invention, the bush member (74) has the sliding contact surface (75) which is a flat surface. During orbital movement of the movable scroll (50), the sliding contact surface (75) of the bush member (74) slidingly contacts the side surface of the slide groove (80). A force for restricting rotation of the movable scroll (50) acts on the sliding contact surface (75) of the bush member (74).

In the sixty-third aspect of the present invention, the slide groove (80) is formed in the movable side end plate portion (51) of the movable scroll (50). In the movable side end plate portion (51), the slide groove (80) is arranged in the vicinity of the outer peripheral side end of the movable side wrap (52). And, the slide groove (80) formed in the movable scroll (50) engages the pin shaft portion (70) mounted to the fixed side member (69).

In the sixty-fourth aspect of the present invention, the pin shaft portion (70) is mounted to the movable side end plate portion (51) of the movable scroll (50). In the movable side end plate portion (51), the pin shaft portion (70) is arranged in the vicinity of the outer peripheral side end of the movable side wrap (52). And, the pin shaft portion (70) mounted to the movable scroll (50) engages the slide groove (80) formed in the fixed side member (69).

In the sixty-fifth aspect of the present invention, the movable side wrap (52) is of constant thickness. In other words, the movable side wrap (52) has the same shape as its counterpart in a scroll fluid machine of the general type whose movable scroll is completely forbidden to rotate. On the other hand, the fixed side wrap (63) is shaped such that it is gradually repeatedly increased and decreased in thickness in the direction from the inner to the outer peripheral side end thereof.

In the sixty-sixth aspect of the present invention, the fixed side wrap (63) is of constant thickness. In other words, the fixed side wrap (63) has the same shape as its counterpart in a scroll fluid machine of the general type whose movable scroll is completely forbidden to rotate. On the other hand, the movable side wrap (52) is shaped such that it is gradually repeatedly increased and decreased in thickness in the direction from the inner to the outer peripheral side end thereof.

In the sixty-seventh aspect of the present invention, the movable side wrap (52) is shaped such that it is gradually repeatedly increased and decreased in thickness in the direction from the inner to the outer peripheral side end thereof. In addition, the fixed side wrap (63) is also shaped such that it is gradually repeatedly increased and decreased in thickness in the direction from the inner to the outer peripheral side end thereof.

In the sixty-eighth aspect of the present invention, the outer peripheral side end of the fixed side wrap (63) is elongated to near the outer peripheral side end of the movable side wrap (52). In other words, the length from the inner to the outer peripheral side end of the fixed side wrap (63) is longer than the length from the inner to the outer peripheral side end of the movable side wrap (52). In a scroll fluid machine of the general type, fluid chambers (41) are formed in pairs on the inner and outer peripheral sides of the movable side wrap (52). In the scroll fluid machine (10) of the present aspect, the fixed side wrap (63) is longer than the movable side wrap (52), and the fluid chamber (41) defined on the outer peripheral side of the movable side wrap (52) has a greater maximum volume than the fluid chamber (41) defined on the inner peripheral side of the movable side wrap (52).

ADVANTAGEOUS EFFECTS OF THE INVENTION

In each of the first to fourth aspects of the present invention, by sliding contact between the pin shaft portion (70) and the side surface of the slide groove (80), rotation of the orbiting scroll (50) is restricted. In other words, orbital movement of the orbiting scroll (50) is restricted by means of such a comparatively simple mechanism that the pin shaft portion (70) relatively slides along the slide groove (80). Consequently, in comparison with the case of employing an Oldham ring mechanism of the general type as a mechanism for movable scroll's rotation restriction, the number of sliding places necessary for restricting rotation of the orbiting scroll (50) can be reduced, thereby making it possible to reduce friction loss associated with sliding contact between the members. Therefore, in accordance with these aspects of the present invention, it becomes possible to reduce friction loss occurring when restricting rotation of the orbiting scroll (50), and power loss in the scroll fluid machine (10) can be reduced.

In addition to the above, in each of the first to fourth aspects of the present invention, rotation of the orbiting scroll (50) is restricted by sliding contact between the pin shaft portion (70) and the side surface of the slide groove (80), and there is no need to employ a member of relatively large size such as an Oldham ring in order that rotation of the orbiting scroll (50) may be restricted. Contrary to the case where power loss conventionally occurs also due to stirring up of lubricating oil during movement of an Oldham ring of relatively large size, loss due to stirring up of lubricating oil by such a member can be reduced in accordance with these aspects of the present invention. Also in this point, power loss in the scroll fluid machine (10) is reduced.

In each of the fourteenth and eighteenth aspects of the present invention, the pin shaft portion (70) formed in a columnar shape is provided with the sliding contact surface (95) composed of a circular arc surface, and the sliding contact surface (95) is brought into sliding contact with the wall surface of the slide groove (80), thereby restricting rotation of the orbiting scroll (50). Accordingly, it becomes possible to restrict rotation of the orbiting scroll (50) by engagement of the pin shaft portion (70) formed of a single member into the slide groove (80), and the scroll fluid machine (10) has a simplified configuration.

In each of the fifteenth and nineteenth aspects of the present invention, the pin shaft portion (70) is shaped such that its portion nearer to the center of the orbiting and non-orbiting scrolls (50, 60) than the sliding contact surface (95) is cut away.

The condition of lubrication for the case where sliding contact is established between the sliding contact surface (95) of the pin shaft portion (70) and the wall surface of the slide groove (80) becomes severe as the curvature radius of the sliding contact surface (95) of the pin shaft portion (70) is decreased. In order to make sure that troubles such as seizing are avoided by providing lubrication in this part, the curvature radius of the sliding contact surface (95) of the pin shaft portion (70) is preferably made as long as possible. However, if the curvature radius of the sliding contact surface (95) is increased by thickening the entire pin shaft portion (70), this may cause the wraps of the orbiting and non-orbiting scrolls (50, 60) to interfere with the pin shaft portion (70).

On the contrary, the pin shaft portion (70) in each of the fifteenth and nineteenth aspects of the present invention is formed in such a shape that its portion situated on the central side of the orbiting and non-orbiting scrolls (50, 60) is cut away. In the orbiting and non-orbiting scrolls (50, 60), their wraps are formed on the central side. Therefore, in accordance with these aspects of the present invention, in addition to preventing the wraps of the orbiting and non-orbiting scrolls (50, 60) from interfering with the pin shaft portion (70), it becomes possible to improve the state of lubrication by increasing the curvature radius of the sliding contact surface (95) of the pin shaft portion (70).

In each of the sixteenth and seventeenth aspects of the present invention, the slide groove (80) is open at the front surface of the orbiting end plate portion (51) on the side of the orbiting wrap (52). In addition, in these aspects of the present invention, the distance from the end of the slide groove (80) on the side of the orbiting wrap (52) to the outer side surface of the orbiting wrap (52) is longer than twice the radius of orbital movement of the orbiting wrap (52).

In the scroll fluid machine (10), the wrap of the orbiting scroll (50) and the wrap of the non-orbiting scroll (60) come to engage with each other to form the fluid chamber (41). And, when the wrap inner peripheral surface of the non-orbiting scroll (60) reaches the slide groove (80) during orbital movement of the orbiting scroll (50), the fluid chamber (41) fluidly communicates with the slide groove (80) and, as a result, fluid within the fluid chamber (41) leaks into the slide groove (80).

However, in each of the sixteenth and seventeenth aspects of the present invention, it is arranged such that the end of the slide groove (80) on the side of the orbiting wrap (52) is spaced more than a distance of twice the radius of orbital movement of the orbiting wrap (52) apart from the outer side surface of the orbiting wrap (52). Consequently, in these aspects of the present invention, during orbital movement of the orbiting wrap (52), the wrap inner peripheral surface of the non-orbiting scroll (60) never reaches anywhere outside the end of the slide groove (80) on the side of the orbiting wrap (52). Therefore, in accordance with these aspects of the present invention, it becomes possible to prevent fluid from leaking into the slide groove (80) from the fluid chamber (41), thereby making it possible to prevent the scroll fluid machine (10) from undergoing a drop in efficiency.

In each of the twenty-second and twenty-third aspects of the present invention, the pin shaft portion (70) capable of rotation is provided with the sliding contact surface (72) which is a flat surface, and a force for restricting rotation of the orbiting scroll (50) acts on the sliding contact surface (72) of the pin shaft portion (70). Consequently, it becomes possible to reduce 0 acting on the sliding contact surface (72) of the pin shaft portion (70) and on the side surface of the slide groove (80) during orbital movement of the orbiting scroll (50), thereby making it possible to improve the state of lubrication between the sliding contact surface (72) of the pin shaft portion (70) and the side surface of the slide groove (80). Therefore, in accordance with these aspects of the present invention, it is possible to ensure lubrication between the sliding contact surface (72) of the pin shaft portion (70) and the side surface of the slide groove (80), and the reliability of the scroll fluid machine (10) is ensured by reducing the possibility of occurrence of troubles such as seizing, wear et cetera.

In each of the twenty-fourth to twenty-eighth aspects of the present invention, the bush member (74) as a separate body from the body member (73) is brought into sliding contact with the side surface of the slide groove (80). Therefore, in accordance with these aspects of the present invention, it becomes possible to form the body member (73) and the bush member (74) with different materials, thereby making it possible to achieve improvement in reliability by forming the bush member (74) with a material superior in sliding contact performance, lubrication performance et cetera.

In each of the twenty-ninth to thirty-second aspects of the present invention, the bush member (74) is provided with the sliding contact surface (75) which is a flat surface, and a force for restricting rotation of the orbiting scroll (50) acts on the sliding contact surface (75) of the bush member (74). Consequently, it becomes possible to reduce contact stress acting on the bush member (74) of the pin shaft portion (70) and on the side surface of the slide groove (80) during orbital movement of the orbiting scroll (50), thereby making it possible to improve the state of lubrication between the sliding contact surface (75) of the bush member (74) and the side surface of the slide groove (80). Therefore, in accordance with these aspects of the present invention, it is ensured that lubrication between the sliding contact surface (75) of the bush member (74) and the side surface of the slide groove (80) is carried out without fail, and the reliability of the scroll fluid machine (10) is ensured by reducing the possibility of occurrence of troubles such as seizing, wear et cetera.

In the thirty-seventh aspect of the present invention, the orbiting wrap (52) has the same shape as its counterpart in a scroll fluid machine of the general type whose movable scroll is completely forbidden to rotate. Consequently, it becomes possible to allow application of movable scrolls intended for scroll fluid machinery of the general type, and the scroll fluid machine (10) according to the present aspect is less expensive to manufacture than conventional ones.

In the thirty-eighth aspect of the present invention, the non-orbiting wrap (63) has the same shape as its counterpart in a scroll fluid machine of the general type whose orbiting scroll is completely forbidden to rotate. Consequently, it becomes possible to allow application of fixed scrolls intended for scroll fluid machinery of the general type, and the scroll fluid machine (10) according to the present aspect is less expensive to manufacture than conventional ones.

In the thirty-ninth aspect of the present invention, both of the orbiting wrap (52) and the non-orbiting wrap (63) are shaped such that they are gradually increased and decreased in thickness in the direction from the inner to the outer peripheral side end thereof. Consequently, it becomes possible to hold the range of variation in the thickness of each of the orbiting wrap (52) and the non-orbiting wrap (63) to a minimum. Therefore, in accordance with the present aspect, it becomes possible to hold the rigidity deterioration of the orbiting and non-orbiting wraps (52, 63) due to thickness variation to a minimum, and it further becomes possible to secure the efficiency of the scroll fluid machine (10) by inhibiting fluid leakage due to deformation of the orbiting and non-orbiting wraps (52, 63).

In the fortieth aspect of the present invention, the fluid chamber (43) defined on the inner peripheral side of the orbiting wrap (52) differs in maximum volume from the fluid chamber (42) defined on the outer peripheral side of the orbiting wrap (52). In the scroll fluid machine (10) of the present aspect, the orbiting scroll (50) is not completely forbidden to rotate. And, if the orbiting scroll (50) is permitted to rotate during its orbital movement, the maximum volume of each of the fluid chambers (42, 43) has a different value from the case where the orbiting scroll (50) is completely forbidden to rotate. Therefore, in accordance with the present aspect, in the case of employing such a configuration that the orbiting wrap (52) and the non-orbiting wrap (63) have different lengths, it becomes possible to reduce the difference in maximum volume between the fluid chamber (43) defined on the inner peripheral side of the orbiting wrap (52) and the fluid chamber (42) defined on the outer peripheral side of the orbiting wrap (52).

In each of the forty-first and forty-second aspects of the present invention, by sliding contact between the pin shaft portion (70) and the side surface of the slide groove (80), rotation of the movable scroll (50) is restricted. In other words, orbital movement of the movable scroll (50) is restricted by means of such a comparatively simple mechanism that the pin shaft portion (70) relatively slides along the slide groove (80). Consequently, in comparison with the case of employing an Oldham ring mechanism of the general type as a mechanism for movable scroll's rotation restriction, the number of sliding places necessary for restricting rotation of the movable scroll (50) can be reduced, thereby making it possible to reduce friction loss associated with sliding contact between the members. Therefore, in accordance with these aspects of the present invention, it becomes possible to reduce friction loss occurring when restricting rotation of the movable scroll (50), and power loss in the scroll fluid machine (10) can be reduced.

In addition to the above, in each of the forty-first and forty-second aspects of the present invention, rotation of the movable scroll (50) is restricted by sliding contact between the pin shaft portion (70) and the side surface of the slide groove (80), and there is no need to employ a member of relatively large size such as an Oldham ring in order that rotation of the movable scroll (50) may be restricted. Contrary to the case where power loss conventionally occurs also due to stirring up of lubricating oil during movement of an Oldham ring of relatively large size, loss due to stirring up of lubricating oil by such a member can be reduced in accordance with these aspects of the present invention. Also in this point, power loss in the scroll fluid machine (10) is reduced.

In the fifty-sixth aspect of the present invention, the pin shaft portion (70) capable of rotation is provided with the sliding contact surface (72) which is a flat surface, and a force for restricting rotation of the movable scroll (50) acts on the sliding contact surface (72) of the pin shaft portion (70). Consequently, it becomes possible to reduce contact stress acting on the sliding contact surface (72) of the pin shaft portion (70) and on the side surface of the slide groove (80) during orbital movement of the movable scroll (50), thereby making it possible to improve the state of lubrication between the sliding contact surface (72) of the pin shaft portion (70) and the side surface of the slide groove (80). Therefore, in accordance with these aspects of the present invention, it is possible to ensure lubrication between the sliding contact surface (72) of the pin shaft portion (70) and the side surface of the slide groove (80), and the reliability of the scroll fluid machine (10) is secured by reducing the possibility of occurrence of troubles such as seizing, wear et cetera.

In each of the fifty-seventh to sixty-first aspects of the present invention, the bush member (74) as a separate body from the body member (73) is brought into sliding contact with the side surface of the slide groove (80). Therefore, in accordance with these aspects of the present invention, it becomes possible to form the body member (73) and the bush member (74) with different materials, thereby making it possible to achieve improvement in reliability by forming the bush member (74) with a material superior in sliding contact performance, lubrication performance et cetera.

In the sixty-second aspect of the present invention, the bush member (74) is provided with the sliding contact surface (75) which is a flat surface, and a force for restricting rotation of the movable scroll (50) acts on the sliding contact surface (75) of the bush member (74). Consequently, it becomes possible to reduce contact stress acting on the bush member (74) of the pin shaft portion (70) and on the side surface of the slide groove (80) during orbital movement of the movable scroll (50), thereby making it possible to improve the state of lubrication between the sliding contact surface (75) of the bush member (74) and the side surface of the slide groove (80). Therefore, in accordance with the present aspect, it is ensured that lubrication between the sliding contact surface (75) of the bush member (74) and the side surface of the slide groove (80) is carried out without fail, and the reliability of the scroll fluid machine (10) is secured by reducing the possibility of occurrence of troubles such as seizing, wear et cetera.

In the sixty-fifth aspect of the present invention, the movable side wrap (52) has the same shape as its counterpart in a scroll fluid machine of the general type whose movable scroll is completely forbidden to rotate. Consequently, it becomes possible to allow application of movable scrolls intended for scroll fluid machinery of the general type, and the scroll fluid machine (10) according to the present aspect is less expensive to manufacture than conventional ones.

In the sixty-sixth aspect of the present invention, the fixed side wrap (63) has the same shape as its counterpart in a scroll fluid machine of the general type whose movable scroll is completely forbidden to rotate. Consequently, it becomes possible to allow application of fixed scrolls intended for scroll fluid machinery of the general type, and the scroll fluid machine (10) according to the present aspect is less expensive to manufacture than conventional ones.

In the sixty-seventh aspect of the present invention, both of the movable side wrap (52) and the fixed side wrap (63) are shaped such that they are gradually increased and decreased in thickness in the direction from the inner to the outer peripheral side end thereof. Consequently, it becomes possible to hold the range of variation in the thickness of each of the movable side wrap (52) and the fixed side wrap (63) to a minimum. Therefore, in accordance with the present aspect, it becomes possible to hold the rigidity deterioration of the movable and fixed side wraps (52, 63) due to thickness variation to a minimum, and it further becomes possible to secure the efficiency of the scroll fluid machine (10) by inhibiting fluid leakage due to deformation of the movable and fixed side wraps (52, 63).

In the sixty-eighth aspect of the present invention, the fluid chamber (43) defined on the inner peripheral side of the movable side wrap (52) differs in maximum volume from the fluid chamber (42) defined on the outer peripheral side of the movable side wrap (52). In the scroll fluid machine (10) of the present aspect, the movable scroll (50) is not completely forbidden to rotate. And, if the movable scroll (50) is permitted to rotate during its orbital movement, the maximum volume of each of the fluid chambers (42, 43) has a different value from the case where the movable scroll (50) is completely forbidden to rotate. Therefore, in accordance with the present aspect, in the case of employing such a configuration that the movable side wrap (52) and the fixed side wrap (63) have different lengths, it becomes possible to reduce the difference in maximum volume between the fluid chamber (43) defined on the inner peripheral side of the movable side wrap (52) and the fluid chamber (42) defined on the outer peripheral side of the movable side wrap (52).

BRIEF DESCRIPTION OF THE DRAWINGS

In the accompanying drawings:

FIG. 28 is a table showing trial calculation values for the Hertz stress and the EHL oil film thickness when the diameter of the pin member is 10 mm and when the diameter of the pin member is 20 mm;

REFERENCE NUMERALS IN THE DRAWINGS

Figure 1:
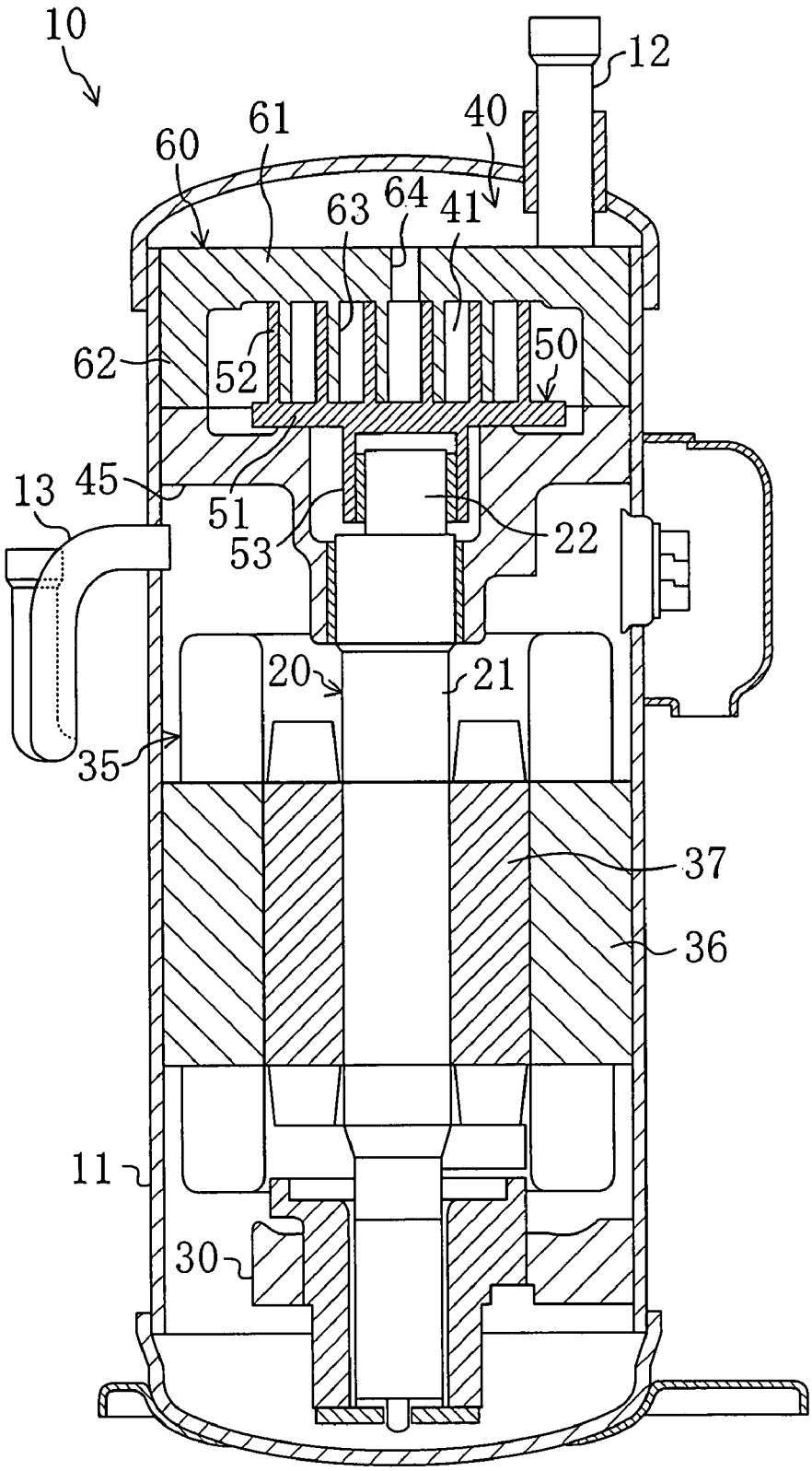
FIG. 1 is a longitudinal sectional view of a scroll compressor according to a first embodiment of the present invention.

10 scroll compressor (scroll fluid machine)
20 driving shaft (rotating shaft, crank)
22 eccentric shaft portion (eccentric portion, eccentric pin)
23 eccentric tubular portion (eccentric portion)
45 housing (housing member)
48 lower portion (bearing)
50 movable scroll (orbiting scroll)
51 movable side end plate portion (orbiting end plate portion)
52 movable side wrap (orbiting wrap)
60 fixed scroll (non-orbiting scroll)
63 fixed side wrap (non-orbiting wrap)
69 fixed side member
70 pin shaft portion
71 columnar pin
72 sliding contact surface
73 body member
74 bush member
75 sliding contact surface
80 slide groove
90 pin member
95 sliding contact surface

BEST EMBODIMENT MODE FOR CARRYING OUT THE INVENTION

In the following, preferred embodiments of the present invention will be described in detail with reference to the accompanying drawings.

First Embodiment

Description is now made in regard to a first embodiment of the present invention. A scroll compressor (10) of the present embodiment is formed by a fluid machine of the scroll type according to the present invention. The scroll compressor (10) is disposed in a refrigerant circuit of a refrigeration apparatus and is used to compress gas refrigerant.

Overall Configuration of the Scroll Compressor

As shown in FIG. 1, the scroll compressor (10) is of a so-called hermetic type. The scroll compressor (10) includes a casing (11) which is shaped like a longitudinally elongated, circular cylindrical hermetic container. Arranged in a bottom to top order within the casing (11) are a lower bearing member (30), an electric motor (35), and a compression mechanism (40). In addition, the casing (11) contains a driving shaft (20) which vertically extends therein.

Attached to the top of the casing (11) is a suction pipe (12). The suction pipe (12) is connected at its terminal end to the compression mechanism (40). A discharge pipe (13) is attached to the body of the casing (11). The discharge pipe (13) has a terminal end which is open between the electric motor (35) and the compression mechanism (40) in the casing (11).

The driving shaft (20) has a main shaft portion (21) and an eccentric shaft portion (22) which is an eccentric portion. The driving shaft (20) constitutes a rotating shaft. The main shaft portion (21) is formed such that its upper end has a somewhat greater diameter. The central axis of the main shaft portion (21) is the central axis of the rotating shaft, i.e., the axis of rotation of the rotating shaft. The eccentric shaft portion (22) is formed in a cylindrical shape having a smaller diameter than the main shaft portion (21). The eccentric shaft portion (22) is mounted in a standing manner on an upper end surface of the main shaft portion (21). The eccentric shaft portion (22) is eccentric relative to the main shaft portion (21), and constitutes an eccentric pin. In other words, the central axis of the eccentric shaft portion (22) is in parallel with the central axis of the main shaft portion (21) and is spaced a predetermined distance away from the central axis of the main shaft portion (21). The driving shaft (20) serves not only as a rotating shaft, but it also serves as a crank. In addition, the eccentric shaft portion (22) serves not only as an eccentric portion, but it also serves as an eccentric pin.

Formed in the driving shaft (20) is an oil supply passageway (not shown) which vertically extends therein. In addition, the main shaft portion (21) is provided, at its lower end, with a centrifugal pump. Refrigeration oil, drawn up from the bottom of the casing (11) by the centrifugal pump, is supplied through the oil supply passageway of the driving shat (20) to the components (for example, the compression mechanism (40)).

The lower bearing member (30) is firmly secured in position in the vicinity of the lower end of the body of the casing (11). A slide bearing is formed centrally in the lower bearing member (30). The slide bearing rotatably supports the lower end of the main shaft portion (21).

The electric motor (35) is composed of a stator (36) and a rotor (37). The stator (36) is firmly secured to the body of the casing (11). The rotor (37) is firmly secured to the main shaft portion (21) of the driving shaft (20).

The compression mechanism (40) includes a movable scroll (50) serving as an orbiting scroll, a fixed scroll (60) servings as a non-orbiting scroll, and a housing (45) serving as a housing member. In the compression mechanism (40), the fixed scroll (60) has a fixed side wrap (63) and the movable scroll (50) has a movable side wrap (52), and the fixed side wrap (63) and the movable side wrap (52) engage with each other to thereby form a compression chamber (41) which is a fluid chamber.

Figure 2:
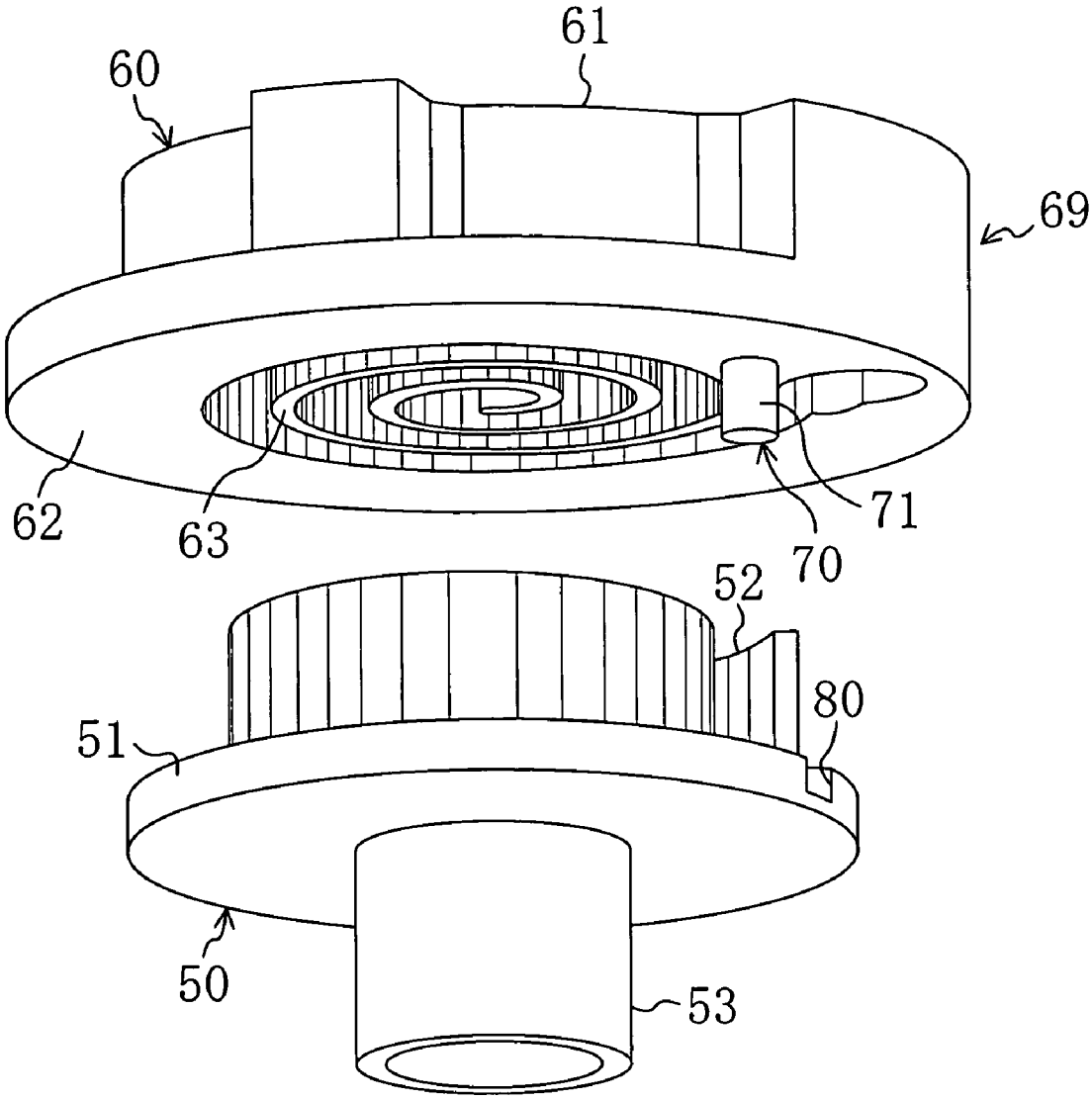
FIG. 2 is a perspective view, as viewed obliquely from below, of a fixed scroll and a movable scroll according to the first embodiment.
Figure 3:
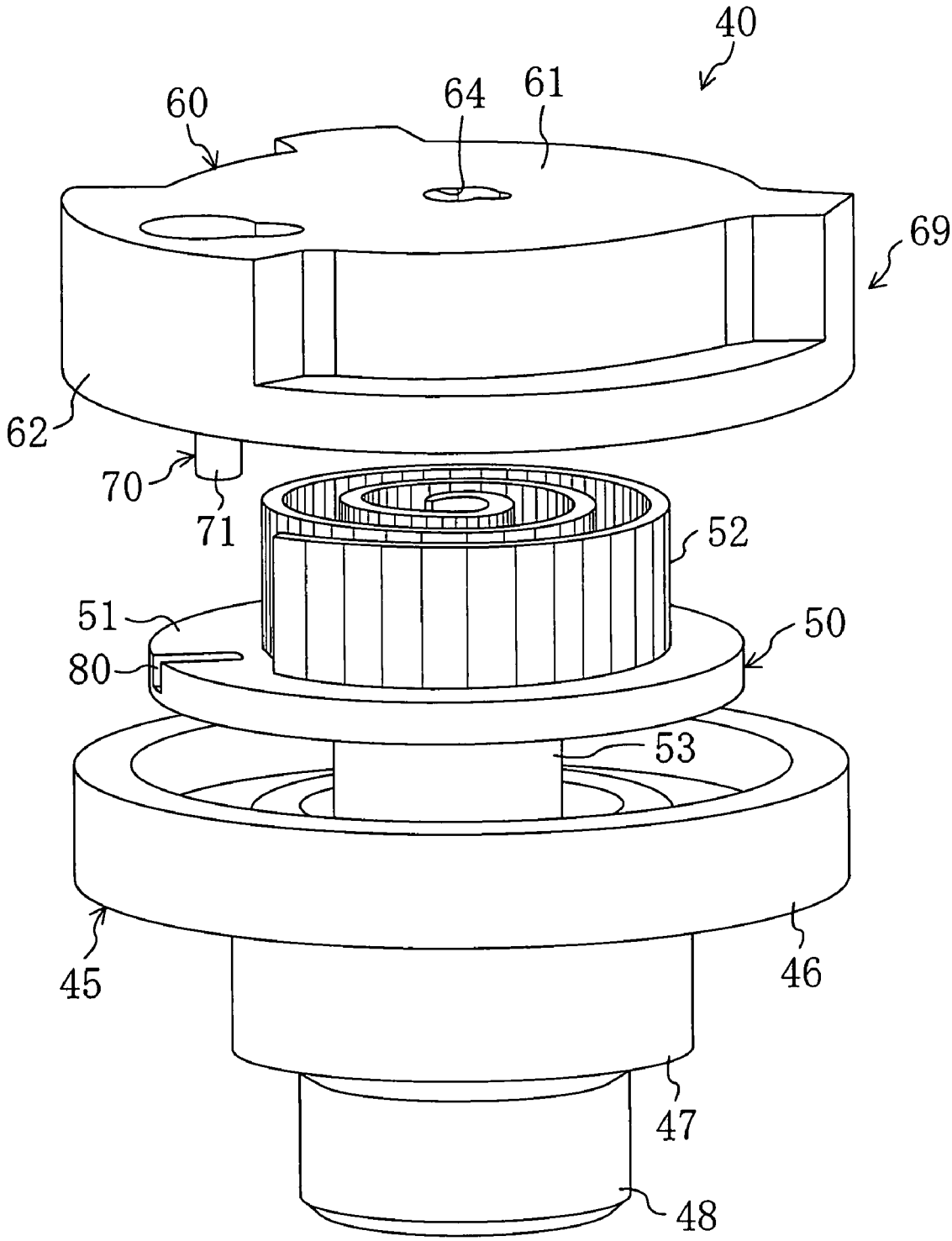
FIG. 3 is a perspective view, as viewed obliquely from above, of a fixed scroll, a movable scroll, and a housing in the first embodiment.

As shown in FIG. 2 and FIG. 3, the movable scroll (50) is provided with a movable side end plate portion (51) serving as an orbiting end plate portion, the movable side wrap (52) servings as an orbiting wrap, and a projected tubular portion (53).

The movable side end plate portion (51) is shaped like a somewhat thick circular disk. The movable side wrap (52) is projectingly formed on a front surface (upper surface in each of FIGS. 1 to 3) of the movable side end plate portion (51) and the projected tubular portion (53) is projectingly formed on a back surface (lower surface in each of FIGS. 1 to 3) of the movable side end plate portion (51). In addition, a slide groove (80) is formed in the movable side end plate portion (51). The slide groove (80) will be described later.

The movable side wrap (52) is formed in a standing manner on the upper surface of the movable side end plate portion (51). The movable side wrap (52) is formed integrally with the movable side end plate portion (51). The movable side wrap (52) is formed in a spiral wall shape of constant height. The movable side wrap (52) will be described later.

The projected tubular portion (53) is formed in a cylindrical shape and is arranged substantially centrally in the back surface of the movable side end plate portion (51). The eccentric shaft portion (22) of the driving shaft (20) is inserted into the projected tubular portion (53). In other words, the eccentric shaft portion (22) of the driving shaft (20) is in engagement with the movable scroll (50). Upon rotation of the driving shaft (20), the movable scroll (50) in engagement with the eccentric shaft portion (22) moves orbitally around the central axis of the main shaft portion (21). At that time, the radius of orbital movement of the movable scroll (50) corresponds to the distance between the central axis of the eccentric shaft portion (22) and the central axis of the main shaft portion (21), i.e., the amount of eccentricity of the eccentric shaft portion (22).

The fixed scroll (60) is firmly secured to the body of the casing (11). The fixed scroll (60) is provided with a fixed side end plate portion (61) serving as a non-orbiting end plate portion, a rim portion (62), and the fixed side wrap (63). In addition, the fixed scroll (60) is further provided with a pin shaft portion (70). The pin shaft portion (70) will be described later.

The fixed side end plate portion (61) is shaped like a somewhat thick circular disk. A discharge opening (64) is formed centrally in the fixed side end plate portion (61). The discharge opening (64) passes completely though the fixed side end plate portion (61).

The rim portion (62) is shaped like a wall extending downwardly from a peripheral portion of the fixed side end plate portion (61). The lower end of the rim portion (62) is projected outwardly over its entire circumference. In addition, the rim portion (62) has three outwardly projected circumferential portions.

The fixed side wrap (63) is formed in a standing manner on a lower surface of the fixed side end plate portion (61). The fixed side wrap (63) is formed integrally with the fixed side end plate portion (61). The fixed side wrap (63) is formed in a spiral wall shape of constant height. The fixed side wrap (63) will be described later.

The housing (45) is firmly secured to the body of the casing (11). The housing (45) is composed of an upper portion (46), an intermediate portion (47), and a lower portion (48) (see FIG. 3). The upper portion (46) is formed in a dish shape. The intermediate portion (47) is formed in a cylindrical shape having a smaller diameter than the upper portion (46) and is projected downwardly from a lower surface of the upper portion (46). The lower portion (48) is formed in a cylindrical shape having a smaller diameter than the intermediate portion (47) and is projected downwardly from a lower surface of the intermediate portion (47). The main shaft portion (21) of the driving shaft (20) is inserted into the lower portion (48). The lower portion (48) serves as a slide bearing for supporting the driving shaft (20).

As described above, in the compression mechanism (40), the fixed scroll (60) and the housing (45) are firmly secured to the casing (11). In other words, the fixed scroll (60) and the housing (45) are arranged in the same coordinate system. In the compression mechanism (40), the fixed scroll (60) and the housing (45) together constitute a non-orbiting member (69). Note that the non-orbiting member (69) formed by the fixed scroll (60) and the housing (45) is a fixed side member as well.

In the compression mechanism (40), the movable scroll (50) is housed within a space enclosed by the fixed scroll (60) and the housing (45). The movable scroll (50) is placed on the upper portion (46) of the housing (45). The back surface of the movable side end plate portion (51) slidingly contacts the bottom surface of the upper portion (46). In addition, the projected tubular portion (53) is situated inside the intermediate portion (47) of the housing (45).

Configuration of the Pin Shaft Portion and the Slide Groove

As described above, the slide groove (80) is formed in the movable scroll (50) and the fixed scroll (60) is provided with the pin shaft portion (70). In the compression mechanism (40), by causing the pin shaft portion (70) to engage the slide groove (80) at the same time as the movable scroll (50) moves orbitally around the central axis of the main shaft portion (21), rotation of the movable scroll (50) is restricted.

In the first place, the slide groove (80) and the pin shaft portion (70) are concretely described in regard to their configuration with reference to FIG. 2 and FIG. 3.

In the movable side end plate portion (51), the slide groove (80) is formed in the vicinity of an outer peripheral side end of the movable side wrap (52). More specifically, the slide groove (80) is provided at a position further ahead of the outer peripheral side end of the movable side wrap (52) along the spiral direction thereof. The slide groove (80) is a straight concave groove of constant width and substantially extends in the radial direction of the movable side end plate portion (51). The slide groove (80) is open not only at the front surface of the movable side end plate portion (51) (upper surface in FIGS. 2 and 3) but also at the outer peripheral surface of the movable side end plate portion (51). In other words, the slide groove (80) is a concave groove with a bottom which does not pass completely through the movable side end plate portion (51), in other words the slide groove (80) is not open at the back surface of the movable side end plate portion (51).

In the fixed scroll (60), the pin shaft portion (70) is provided such that it projects from the lower surface of the rim portion (62). The pin shaft portion (70) is arranged at a position facing the slide groove (80) of the movable scroll (50) in the lower surface of the rim portion (62).

The pin shaft portion (70) is formed by a single columnar pin (71) which is formed in a cylindrical shape. The columnar pin (71) has an outer diameter slightly smaller than the width of the slide groove (80). The columnar pin (71) has a base end (upper end in FIGS. 2 and 3) which is embedded in the rim portion (62) of the fixed scroll (60). More specifically, the rim portion (62) is provided with a pre-formed hole into which the columnar pin (71) is inserted, and the columnar pin (71) is press fitted into the pre-formed hole. In other words, the columnar pin (71) constituting the pin shaft portion (70) is firmly secured to the fixed scroll (60), so that its relative movement with respect to the fixed scroll (60) is forbidden. On the other hand, the tip of the columnar pin (71) (lower end in FIGS. 2 and 3) is engaged into the slide groove (80) of the movable scroll (50). In other words, the columnar pin (71) constituting the pin shaft portion (70) is in engagement with the slide groove (80).

Figure 4:
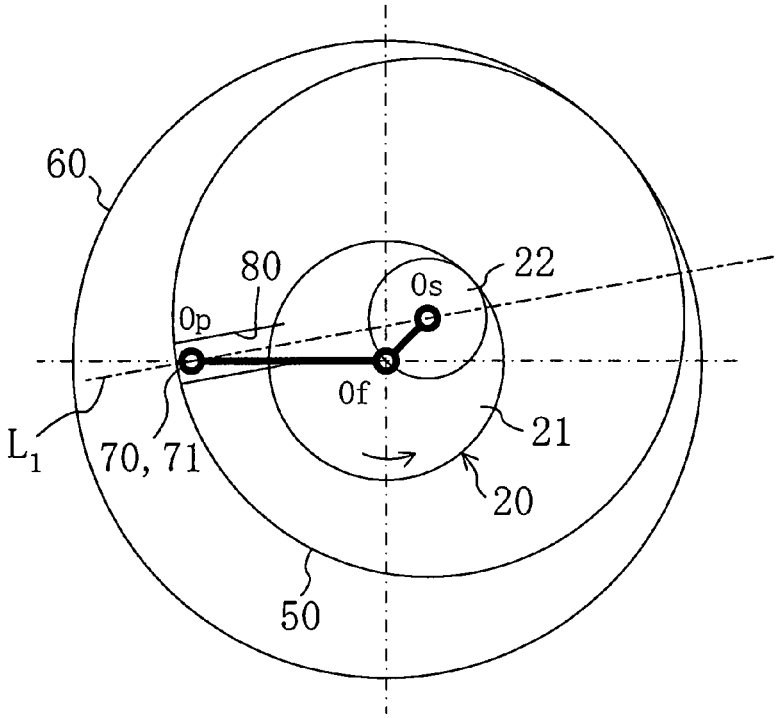
FIG. 4 is a schematic configuration diagram of a compression mechanism in the first embodiment.

Referring next to FIG. 4, the slide groove (80) and the pin shaft portion (70) will be described in regard to their arrangement and shape. FIG. 4 represents a positional relationship between the central axis of each of the main shaft portion (21), the eccentric shaft portion (22), and the columnar pin (71) and the slide groove (80) on a plane which is perpendicular to the central axis of the main shaft portion (21). In FIG. 4, "Of" is the central axis position of the main shaft portion (21); "Os" is the central axis position of the eccentric shaft portion (22); "Op" is the central axis position of the columnar pin (71) constituting the pin shaft portion (70); and "$L_1$" is the widthwise central line of the slide groove (80).

As described above, the movable scroll (50) orbitally moves around the central axis of the main shaft portion (21). In FIG. 4, the radius of orbital movement of the movable scroll (50) is represented as the length of a segment OfOs. In addition, the distance between the central axis of the columnar pin (71) and the central axis of the main shaft portion (21) is represented as the length of a segment OpOf. And, as shown in FIG. 4, the segment OpOf is longer than the segment OfOs. In other word, in the fixed scroll (60), the columnar pin (71) constituting the pin shaft portion (70) is arranged such that the distance between the central axis of the columnar pin (71) and the central axis of the main shaft portion (21) is longer than the radius of orbital movement of the movable scroll (50).

The columnar pin (71) constituting the pin shaft portion (70) has an outer diameter approximately corresponding to the width of the slide groove (80). Consequently, in FIG. 4, the central axis position, Op, of the columnar pin (71) lies on the central line, $L_1$, of the slide groove (80), and the central axis of the columnar pin (71) is perpendicular to the central line of the slide groove (80). In addition, as shown in FIG. 4, the central axis position, Os, of the eccentric shaft portion (22) lies on the central line, $L_1$, of the slide groove (80), and the central axis of the eccentric shaft portion (22) is also perpendicular to the central line of the slide groove (80). Therefore, the central line of the slide groove (80) is perpendicular to both the central axis of the eccentric shaft portion (22) and the central axis of the columnar pin (71) constituting the pin shaft portion (70). In other words, in the movable scroll (50), the slide groove (80) is formed such that its central line is perpendicular to both the central axis of the eccentric shaft portion (22) and the central axis of the columnar pin (71).

Configuration of the Movable and Fixed Side Wraps

Figure 5:
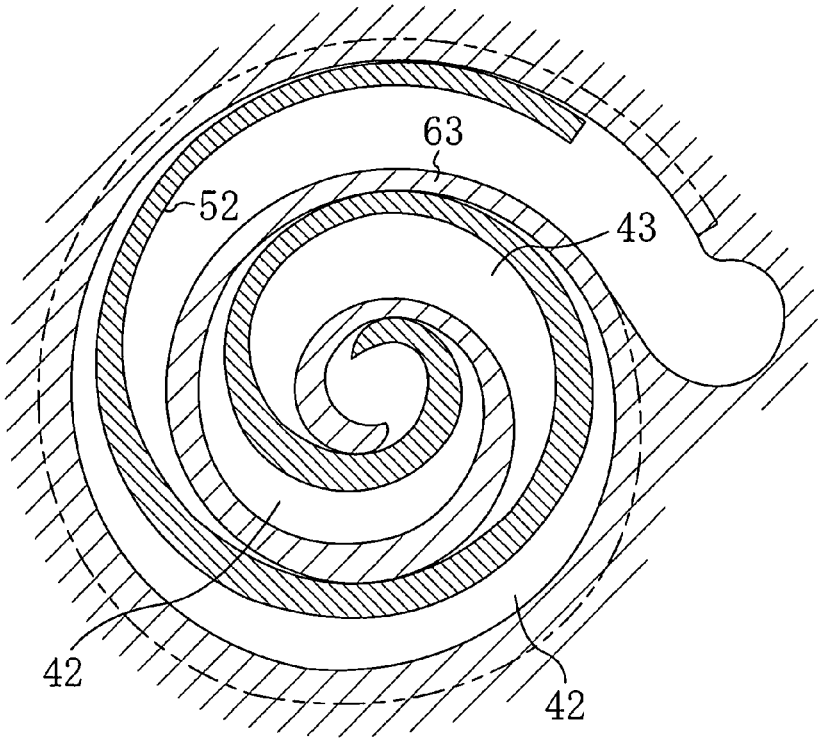
FIG. 5 is a chief portion cross sectional view showing a transverse cross section of the compression mechanism of the first embodiment.

Description will be made in regard to the movable side wrap (52) and the fixed side wrap (63) with reference to FIG. 5.

As described above, the movable side wrap (52) and the fixed side wrap (63) are each formed in a spiral wall shape. The scroll compressor (10) of the present embodiment employs a so-called asymmetrical spiral configuration, and the fixed side wrap (63) and the movable side wrap (52) differ from each other in the number of turns. More specifically, the fixed side wrap (63) is longer than the movable side wrap (52) by about a half turn. The outer peripheral side end of the fixed side wrap (63) is situated in the vicinity of the outer peripheral side end of the movable side wrap (52). In addition, the outermost peripheral portion of the fixed side wrap (63) is integral with the rim portion (62) (see FIG. 2).

As described above, the movable side wrap (52) and the fixed side wrap (63) are made to engage with each other to thereby form a plurality of compression chambers (41). These plural compression chambers (41) include an A-chamber (42) facing the outer side surface of the movable side wrap (52) (outside wrap surface) and a B-chamber (43) facing the inner side surface of the movable side wrap (52) (inside wrap surface). In the present embodiment, since the number of turns of the fixed side wrap (63) is larger than the number of turns of the movable side wrap (52), the A-chamber (42) is greater in maximum volume than the B-chamber (43).

In the scroll compressor (10) of the present embodiment, the movable scroll (50) is different from a movable scroll in a scroll compressor of the general type. More specifically, in the scroll compressor of the general type which employs an Oldham ring mechanism or some like mechanism, the movable scroll is completely forbidden to rotate. On the other hand, in the scroll compressor (10) of the present embodiment, the movable scroll (50) is allowed to rotate to some extent, as will be described below.

In the present embodiment, the movable side wrap (52) and the fixed side wrap (63) are varied in thickness, whereby the shape of each of the movable and fixed side wraps (52, 63) is matched to movement of the movable scroll (50). More specifically, the inner and outer side surfaces of the movable side wrap (52) and the inner and outer side surfaces of the fixed side wrap (63), i.e., all the wrap surfaces, are shaped differently from scroll fluid machines of the general type. The movable side wrap (52) of the present embodiment is provided with a first portion the thickness of which gradually increases from the inner to the outer peripheral side end and a second portion the thickness of which gradually decreases from the inner to the outer peripheral side, wherein the first and second portions are alternately formed. Likewise, the fixed side wrap (63) of the present embodiment is provided with a first portion the thickness of which gradually increases from the inner to the outer peripheral side end and a second portion the thickness of which gradually decreases from the inner to the outer peripheral side, wherein the first and second portions are alternately formed. The inner side surface of the fixed side wrap (63) becomes an enveloping surface for the outer side surface of the movable side wrap (52) while on the other hand the outer side surface of the fixed side wrap (63) becomes an enveloping surface for the inner side surface of the movable side wrap (52).

Running Operation

In the first place, description will be made in regard to a refrigerant compressing operation in the scroll compressor (10). As described above, the scroll compressor (10) of the present embodiment is arranged in the refrigerant circuit of the refrigeration apparatus. The scroll compressor (10) draws low pressure gas refrigerant from an evaporator and compresses the same to high pressure. Then, the scroll compressor (10) delivers the post-compression, high pressure gas refrigerant to a condenser.

More specifically, rotational power produced by the electric motor (35) is transmitted to the movable scroll (50) by the driving shaft (20). The movable scroll (50) which engages the eccentric shaft portion (22) of the driving shaft (20) orbitally moves around the central axis of the main shaft portion (21). At that time, the columnar pin (71) constituting the pin shaft portion (70) engages the slide groove (80), whereby rotation of the movable scroll (50) is restricted.

Low pressure gas refrigerant which is drawn into the scroll compressor (10) passes through the suction pipe (12) and flows into the compression mechanism (40). This gas refrigerant is drawn into the compression chambers (41) from the outer peripheral side of the movable side wrap (52) and from the outer peripheral side of the fixed side wrap (63). As the movable scroll (50) performs orbital movement, the volume of the compression chambers (41) in the confined state gradually decreases, and the gas refrigerant in the compressor (41) is gradually compressed to high pressure. The gas refrigerant now at high pressure by compression passes through the discharge opening (64) and is discharged to an upper space of the compression mechanism (40). The gas refrigerant discharged out of the compression mechanism (40) passes through a passageway (not shown in the drawing), flows into a lower space of the compression mechanism (40), and is discharged out of the casing (11) by way of the discharge pipe (13).

Next, description will be made in regard to the movement of the movable scroll (50) with reference to FIG. 6. By the terms "clockwise rotation" and "counterclockwise rotation" as used in the description are meant, respectively, "clockwise rotation" and "counterclockwise rotation" in FIG. 6.

Figure 6:
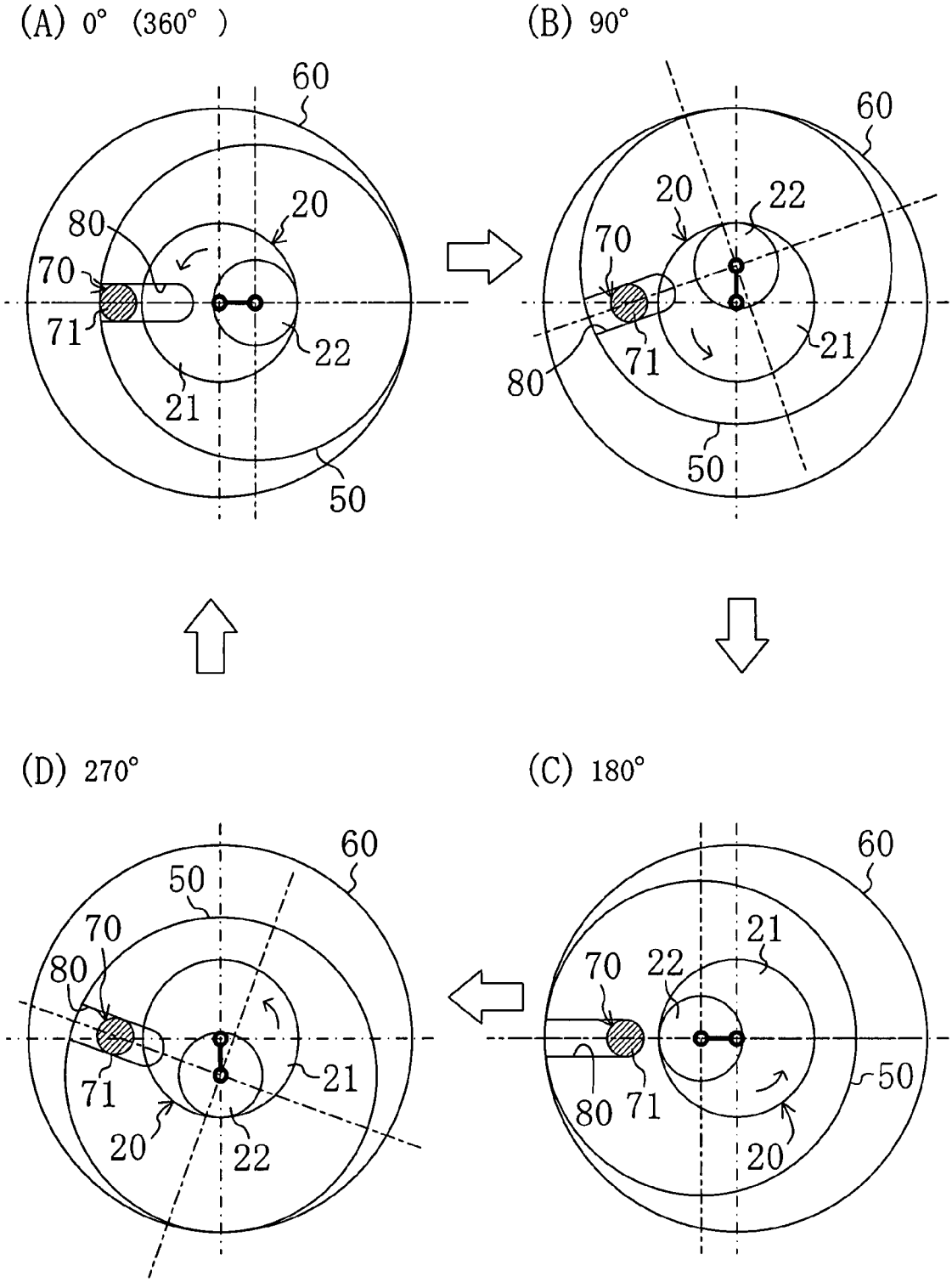
FIG. 6 is a schematic configuration diagram of the compression mechanism illustrating the movement of a movable scroll in the first embodiment.

As shown in FIG. 6, the angle of rotation of the driving shaft (20) is zero degrees at the point of time when the central axis of the columnar pin (71) constituting the pin shaft portion (70), the central axis of the driving shaft (20), and the central axis of the eccentric shaft portion (22) are arranged, in that order, in a straight line. FIG. 6(A) shows a state of the driving shaft (20) when its rotation angle is at 0 or 360 degrees. FIG. 6(B) shows another state of the driving shaft (20) when its rotation angle is at 90 degrees. FIG. 6(C) shows yet another state of the driving shaft (20) when its rotation angle is at 180 degrees. FIG. 6(D) shows still another state of the driving shaft (20) when its rotation angle is at 270 degrees.

When the driving shaft (20) rotates counterclockwise, the movable scroll (50) orbitally moves around the central axis of the main shaft portion (21). At the point of time when the rotation angle of the driving shaft (20) reaches 180 degrees, the central axis of the eccentric shaft portion (22) lies between the central axis of the columnar pin (71) and the central axis of the driving shaft (20) (see FIG. 6(C)), during which the side surface of the slide groove (80) slidingly contacts the side surface of the columnar pin (71), thereby restricting rotation of the movable scroll (50).

More specifically, as the rotation angle of the driving shaft (20) increases from zero degrees, the movable scroll (50) rotates counterclockwise. Thereafter, when the rotation angle of the driving shaft (20) reaches a predetermined value, the movable scroll (50) starts rotating clockwise. At the point of time when the rotation angle of the driving shaft (20) reaches 180 degrees, the rotation angle of the movable scroll (50) becomes zero degrees, as in when the rotation angle of the driving shaft (20) is at zero degrees.

When the driving shaft (20) continues to rotate counterclockwise to reach a rotation angle of 360 degrees, the rotational angle of the driving shaft (20) returns to the same state as when the rotation angle of the driving shaft (20) is at zero degrees (see FIG. 6(A)). During all that time, the side surface of the slide groove (80) slidingly contacts the side surface of the columnar pin (71), whereby rotation of the movable scroll (50) is restricted.

More specifically, as the rotation angle of the driving shaft (20) increases from 180 degrees, the movable scroll (50) rotates clockwise. Thereafter, when the rotation angle of the driving shaft (20) reaches a predetermined value, the movable scroll (50) starts rotating counterclockwise. At the point of time when the rotation angle of the driving shaft (20) reaches 360 degrees, the rotation angle of the movable scroll (50) becomes zero degrees, as in when the rotation angle of the driving shaft (20) is at zero degrees.

Advantageous Effects of the First Embodiment

In the first embodiment of the present invention, by sliding contact between the columnar pin (71) constituting the pin shaft portion (70) and the side surface of the slide groove (80), rotation of the movable scroll (50) is restricted. In other words, orbital movement of the movable scroll (50) is restricted by means of such a comparatively simple mechanism that the pin shaft portion (70) relatively slides along the slide groove (80). Consequently, in comparison with the case of employing an Oldham ring mechanism of the general type as a mechanism for movable scroll's rotation restriction, the number of sliding places necessary for restricting rotation of the movable scroll (50) can be reduced, thereby making it possible to reduce friction loss associated with sliding contact between the members.

Figure 7:
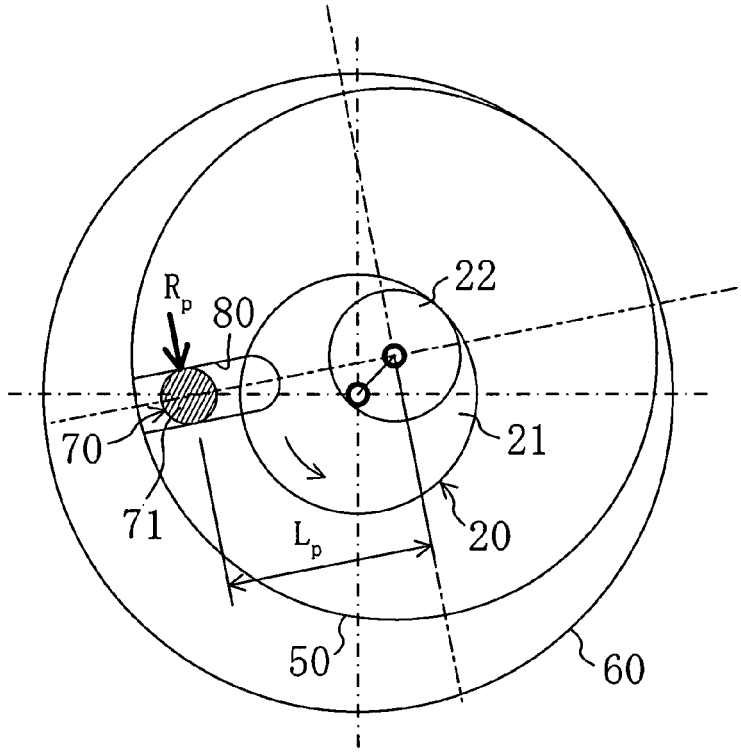
FIG. 7(A) is a schematic configuration diagram of the compression mechanism of the first embodiment and FIG. 7(B) is a schematic configuration diagram of a conventional compression mechanism.
Figure 7:
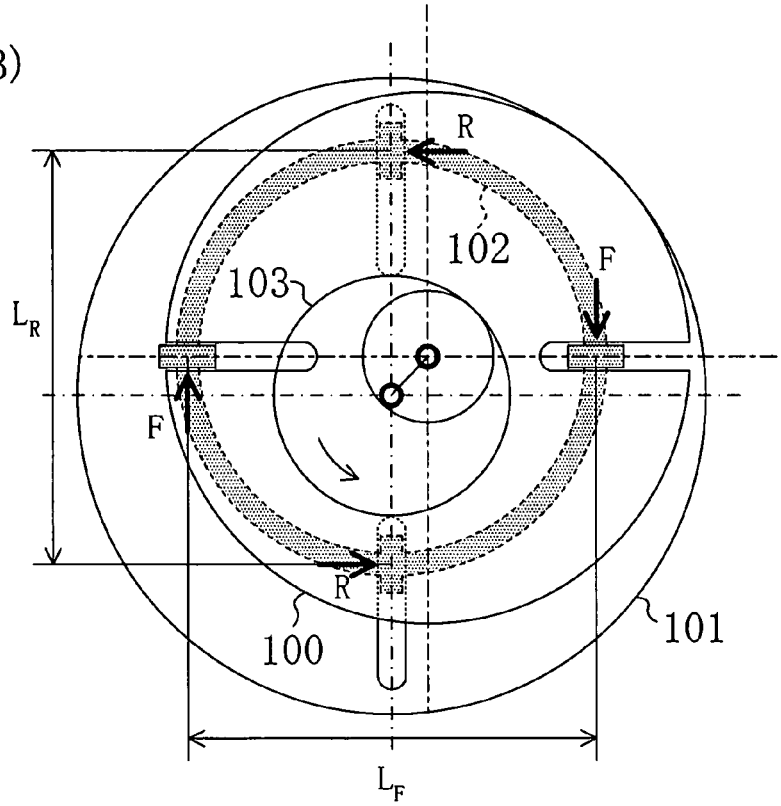

Description will be made in regard to this point with reference to FIG. 7.

Referring to FIG. 7(B), there is shown a scroll compressor of the general type which employs an Oldham ring mechanism for restricting rotation of a movable scroll (100). The following expression represents the friction loss, $W_O$, produced between the movable scroll (100) (or a housing (101)) and an Oldham ring (102) during one rotation of a driving shaft (103) in the scroll compressor of the general type.

$$W_O=2\cdot(F\cdot\mu\cdot 4L_{or})+2\cdot(F\cdot\mu\cdot 4L_{or})=2\mu(M/L_F+M/L_R)\cdot 4L_{or}$$

where:

F: key groove reactive force on the side of the movable scroll

R: key groove reactive force on the side of the housing

μ: friction coefficient of the Oldham ring key and the key groove $L_F$: distance between the keys engaging with the movable scroll $L_R$: distance between the keys engaging with the housing $L_{or}$: amount of eccentricity of the eccentric portion in the driving shaft M: rotation moment of the movable scroll If $L_F=L_R=L_O$, then the friction loss, $W_O$, is represented by the following expression.

$$W_O=4\mu(M/L_O)\cdot 4L_{or} \qquad \text{Expression 1}$$

FIG. 7(A) shows the scroll compressor (10) of the present embodiment. The following expression represents the friction loss, $W_P$, produced between the columnar pin (71) constituting the pin shaft portion (70) and the slide groove (80) during one rotation of the driving shaft (20).

$$W_P=R'\cdot\mu 4L_{or}=\mu(M/L_P)\cdot 4L_{or}$$

where:

R': reactive force that the slide groove exerts on the columnar pin

μ: friction coefficient of the columnar pin and the slide groove $L_P$: distance between the central axis of the columnar pin and the shaft center of the eccentric portion $L_{or}$: amount of eccentricity of the eccentric portion in the driving shaft M: rotation moment of the movable scroll Generally, it is conceivable that $L_O$ is approximately equal to $2L_P$ in the scroll compressor (10) of the present embodiment. If $L_O=2L_P$, then the friction loss, $W_P$, is represented by the following expression.

$$W_P=2\mu(M/L_O)\cdot 4L_{or} \qquad \text{Expression 2}$$

From Expressions 1 and 2, $W_P=\frac{1}{2}\cdot W_O$. In other words, friction loss, produced by the mechanism for restricting rotation of the movable scroll (50) in the scroll compressor (10) of the present embodiment, becomes half of that of a scroll compressor of the general type employing an Oldham ring mechanism. Therefore, in accordance with the present embodiment, it becomes possible to reduce friction loss produced when restricting rotation of the movable scroll to approximately half, whereby power loss in the scroll compressor (10) is reduced.

In addition, in the scroll compressor (10) of the present embodiment, rotation of the movable scroll (50) is restricted by sliding contact of the slide groove (80) formed in the movable scroll (50) with the pin shaft portion (70). That is, in the scroll compressor (10), the movable scroll (50) is the only member which moves in the compression mechanism (40), and it becomes possible to restrict rotation of the movable scroll (50) without employing a member of relatively large size such as an Oldham ring.

Contrary to the case where power loss conventionally occurs also due to stirring up of lubricating oil during movement of an Oldham ring of relatively large size, loss due to stirring up of lubricating oil by such a member can be reduced in accordance with the present embodiment. Also in this point, power loss in the scroll compressor (10) is reduced.

The scroll compressor (10) of the present embodiment employs such an asymmetrical spiral configuration that the number of turns of the fixed side wrap (63) is larger than the number of turns of the movable side wrap (52), and the maximum volume of the A-chamber (42) is greater than the maximum volume of the B-chamber (43). In the scroll compressor (10), the movable scroll (50) is not completely forbidden to rotate. In the case where the movable scroll (50) is allowed to rotate to some extent, it becomes possible to reduce the maximum volume of the A-chamber (42) to thereby increase the maximum volume of the B-chamber (43) when compared to the case where the movable scroll (50) is completely forbidden to rotate. Therefore, in accordance with the present embodiment, it becomes possible to reduce the difference in maximum volume between the A-chamber (42) and the B-chamber (43) in the case of employing a so-called asymmetrical spiral configuration. As a result, it becomes possible to inhibit variation in torque necessary to drive the movable scroll (50), thereby making it possible to reduce vibration of the scroll compressor (10).

In addition, in the scroll compressor (10) of the present embodiment, the columnar pin (71) constituting the pin shaft portion (70) is mounted to the fixed scroll (60), thereby making it possible to relatively easily ensure accuracy of the position of the columnar pin (71) and the fixed side wrap (63). Therefore, in accordance with the present embodiment, the gap between the movable side wrap (52) and the fixed side wrap (63) is controlled without fail, thereby inhibiting gas refrigerant leakage from the compression chamber (41), and the scroll compressor (10) is improved in efficiency.

First Variation of the First Embodiment

Figure 8:
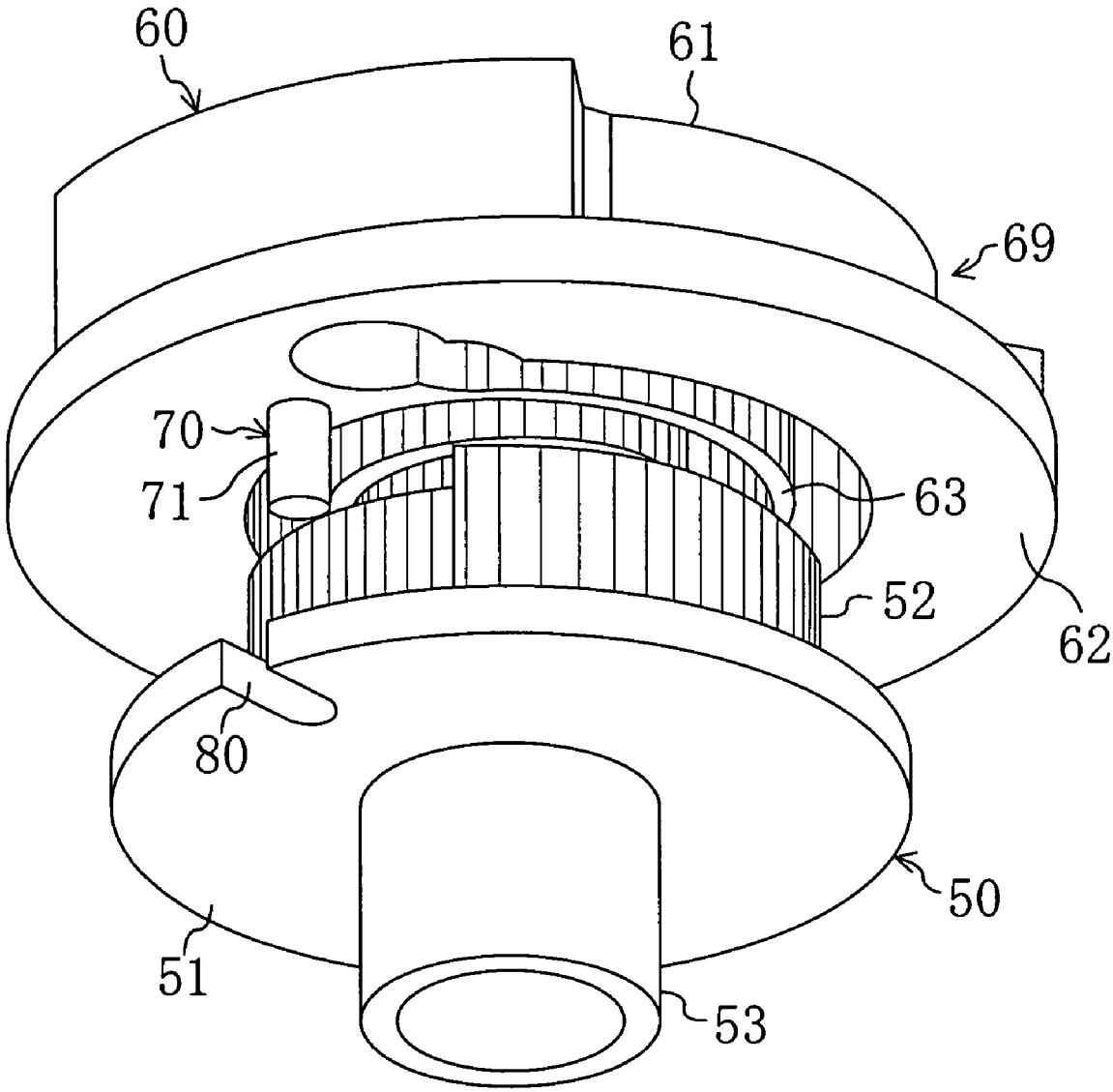
FIG. 8 is a perspective view, as viewed obliquely from below, of a fixed scroll and a movable scroll in a first variation of the first embodiment.

As shown in FIG. 8, in the present embodiment, the slide groove (80) may pass completely through the movable side end plate portion (51) of the movable side wrap (52). In this case, the slide groove (80) is formed by cutting away a portion of the movable side end plate portion (51) from its outer peripheral surface towards the center.

Second Variation of the First Embodiment

Figure 9:
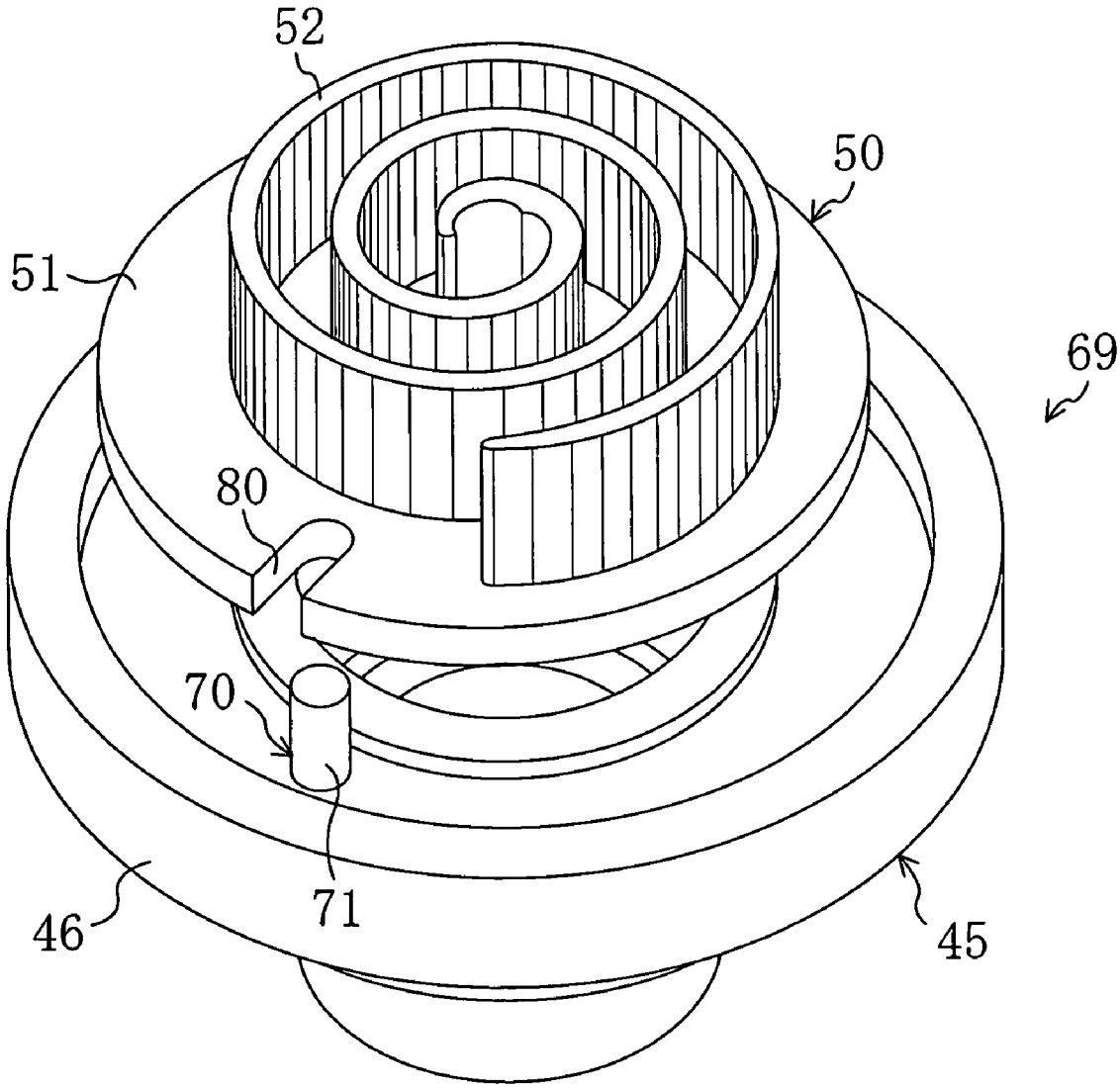
FIG. 9 is a perspective view, as viewed obliquely from above, of a fixed scroll and a housing in a second variation of the first embodiment.

As shown in FIG. 9, in the present embodiment, the columnar pin (71) constituting the pin shaft portion (70) may be mounted to the housing (45). In the present variation, the slide groove (80) passes completely through the movable side end plate portion (51) of the movable side wrap (52), as in the first variation. In addition, the slide groove (80) may be formed in a concave groove shape which is open at the back surface of the movable side end plate portion (51) (lower surface in FIG. 8).

In the housing (45), the columnar pin (71) is mounted such that it projects upwardly from the bottom surface of the upper portion (46). The columnar pin (71) has a base end (lower end in FIG. 9) which is embedded into the bottom surface of the upper portion (46). More specifically, the bottom surface of the upper portion (46) is provided with a preformed hole into which the columnar pin (71) is inserted, and the columnar pin (71) is press fitted into the hole. In other words, the columnar pin (71) constituting the pin shaft portion (70) is firmly secured to the housing (45) and is therefore forbidden to make a relative movement with respect to the housing (45). On the other hand, the columnar pin (71) has a projected end (upper end in FIG. 9) which is engaged into the slide groove (80) of the movable scroll (50).

In the present variation, the columnar pin (71) constituting the pin shaft portion (70) is mounted to the housing (45), thereby making it possible to relatively easily ensure accuracy of the position of the movable side wrap (52) and the fixed side wrap (63). Therefore, in accordance with the present variation, the gap between the movable side wrap (52) and the fixed side wrap (63) is controlled without fail, thereby inhibiting gas refrigerant leakage from the compression chamber (41), and the scroll compressor (10) is improved in efficiency.

Third Variation of the First Embodiment

Figure 10:
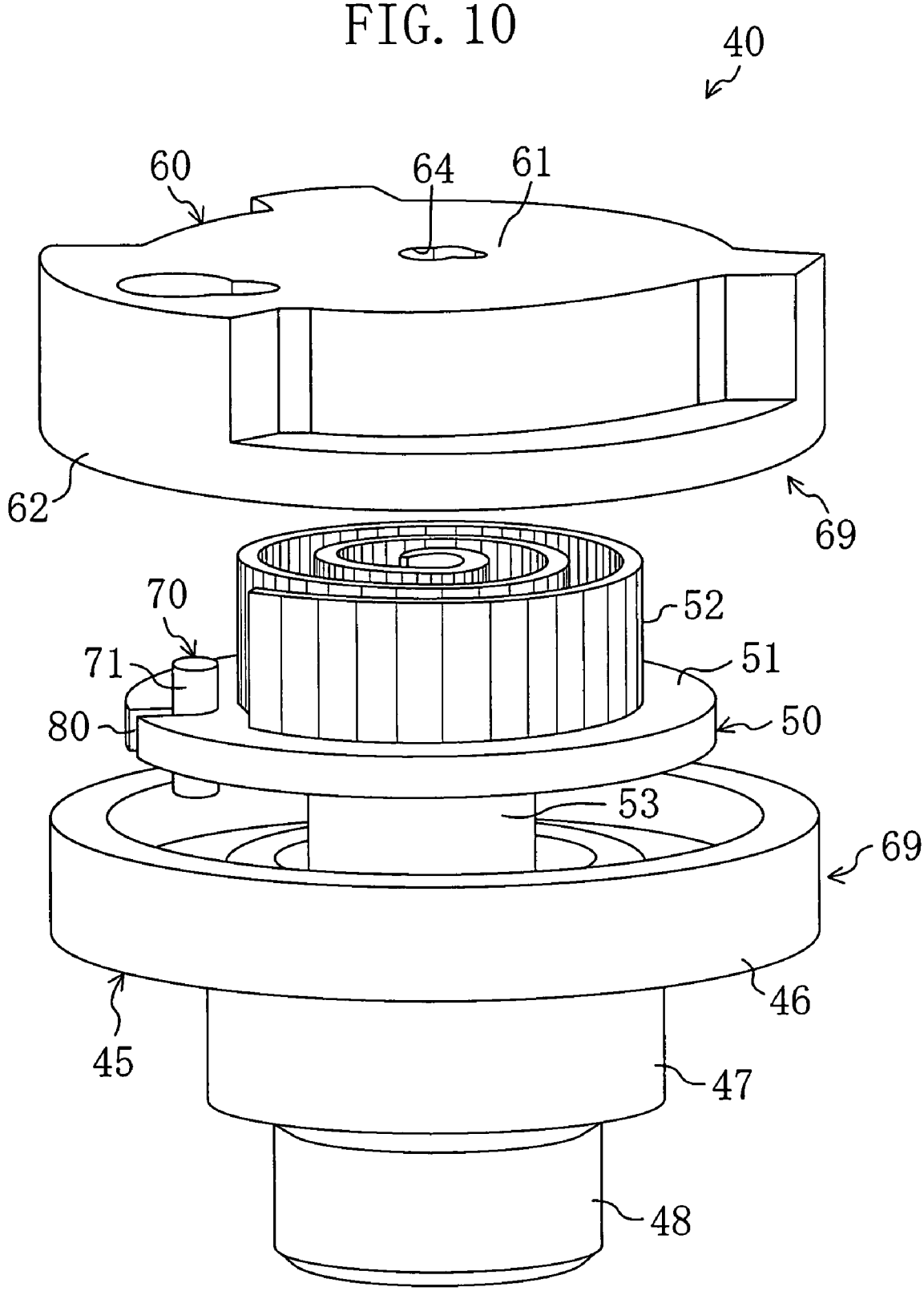
FIG. 10 is a perspective view, as viewed obliquely from above, of a fixed scroll, a movable scroll, and a housing in a third variation of the first embodiment.

In the present embodiment, as shown in FIG. 10, the single columnar pin (71) constituting the pin shaft portion (70) may be attached to both the fixed scroll (60) and the housing (45). That is, in such an arrangement, the upper end of the columnar pin (71) in the figure is press fitted into the fixed scroll (60) while on the other hand the lower end thereof in the figure is press fitted into the housing (45). The axial (vertical) central portion of the columnar pin (71) slidingly contacts the side surface of the slide groove (80).

In the present variation, one end of the columnar pin (71) constituting the pin shaft portion (70) is supported by the fixed scroll (60) and the other end thereof is supported by the housing (45). This therefore makes it possible to reduce the amount of deformation of the columnar pin (71), and the columnar pin (71) and the slide groove (80) are inhibited from undergoing partial wear due to deformation of the columnar pin (71).

Fourth Variation of the First Embodiment

Figure 11:
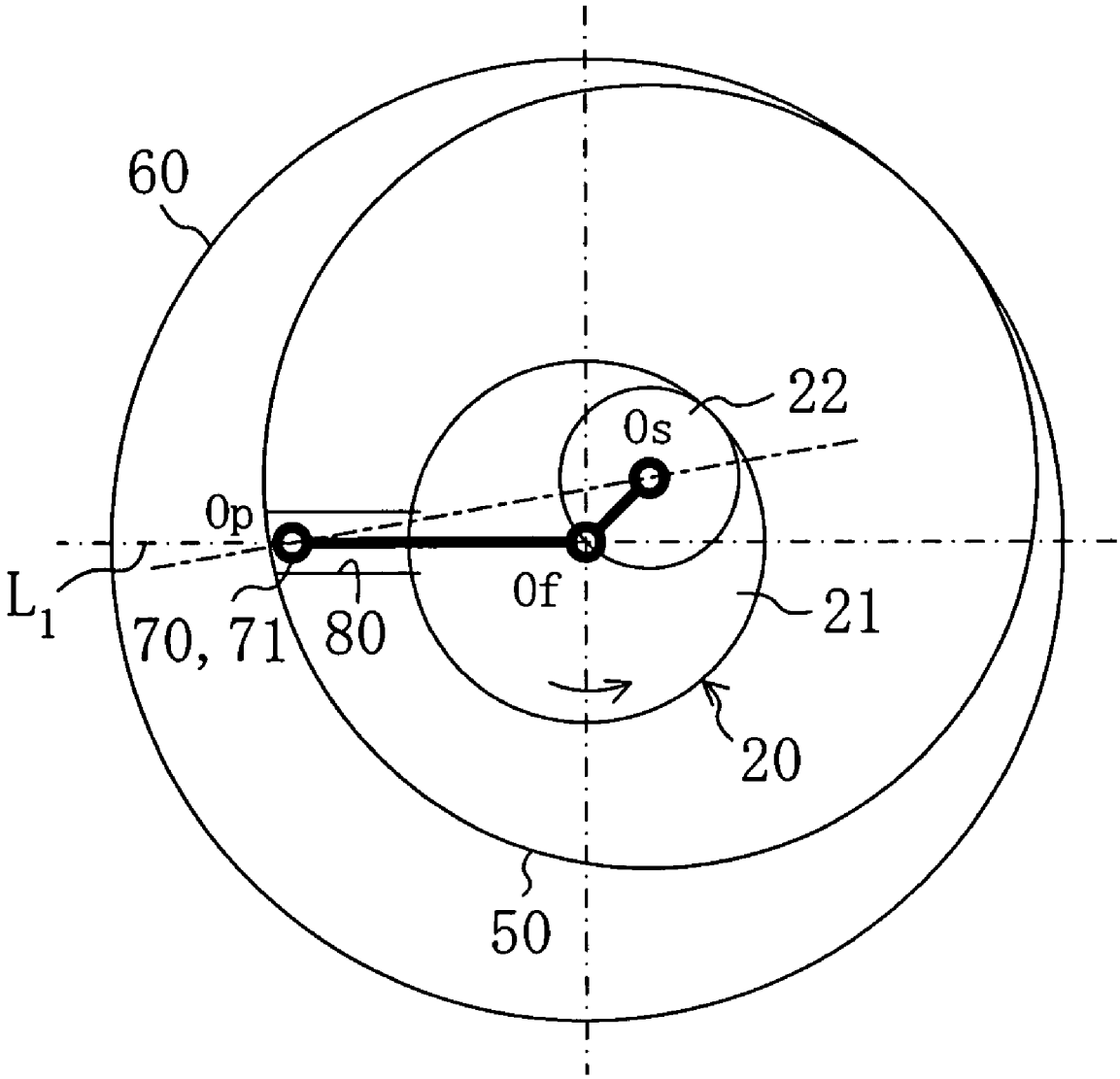
FIG. 11 is a schematic configuration diagram of a compression mechanism in a fourth variation of the first embodiment.

In the present embodiment, as shown in FIG. 11, the central line, $L_1$, of the slide groove (80) may form a predetermined acute angle with a straight line which is perpendicular to both the central axis of the eccentric shaft portion (22) and the central axis of the columnar pin (71).

Referring now to FIG. 11 which corresponds to FIG. 4, the central axis position of the main shaft portion 21 is indicated by "Of"; the central axis position of the eccentric shaft portion (22) is indicated by "Os"; the central axis position of the columnar pin (71) constituting the pin shaft portion (70) is indicated by "Op"; and the widthwise central line of the slide groove (80) is indicated by "$L_1$". The straight line which is perpendicular to both the central axis of the eccentric shaft portion (22) and the central axis of the columnar pin (71) is a straight line OpOs which passes through both the central axis position, Os, of the eccentric shaft portion (22) and the central axis position, Op, of the columnar pin (71) in the figure. In the present variation, the angle formed between the central line, $L_1$, of the slide groove (80) and the straight line OpOs falls below 90 degrees.

In accordance with the present variation, it becomes possible to reduce the rotation angle of the movable scroll (50) to a further extent in comparison with the case where the central line of the slide groove (80) is perpendicular to both the central axis of the eccentric shaft portion (22) and the central axis of the columnar pin (71). Consequently, it becomes possible to reduce variation in the thickness of each of the movable and fixed side wraps (52, 63) associated with rotation of the movable scroll (50), thereby facilitating ensuring the rigidity of the movable side wrap (52) and the fixed side wrap (63).

Second Embodiment of the Present Invention

Description will be made in regard to a second embodiment of the present invention. The second embodiment is a modification of the first embodiment in that the compression mechanism (40) is modified in configuration. Here, in regard to the scroll compressor (10) of the present embodiment, the difference from the first embodiment will be described below.

Figure 12:
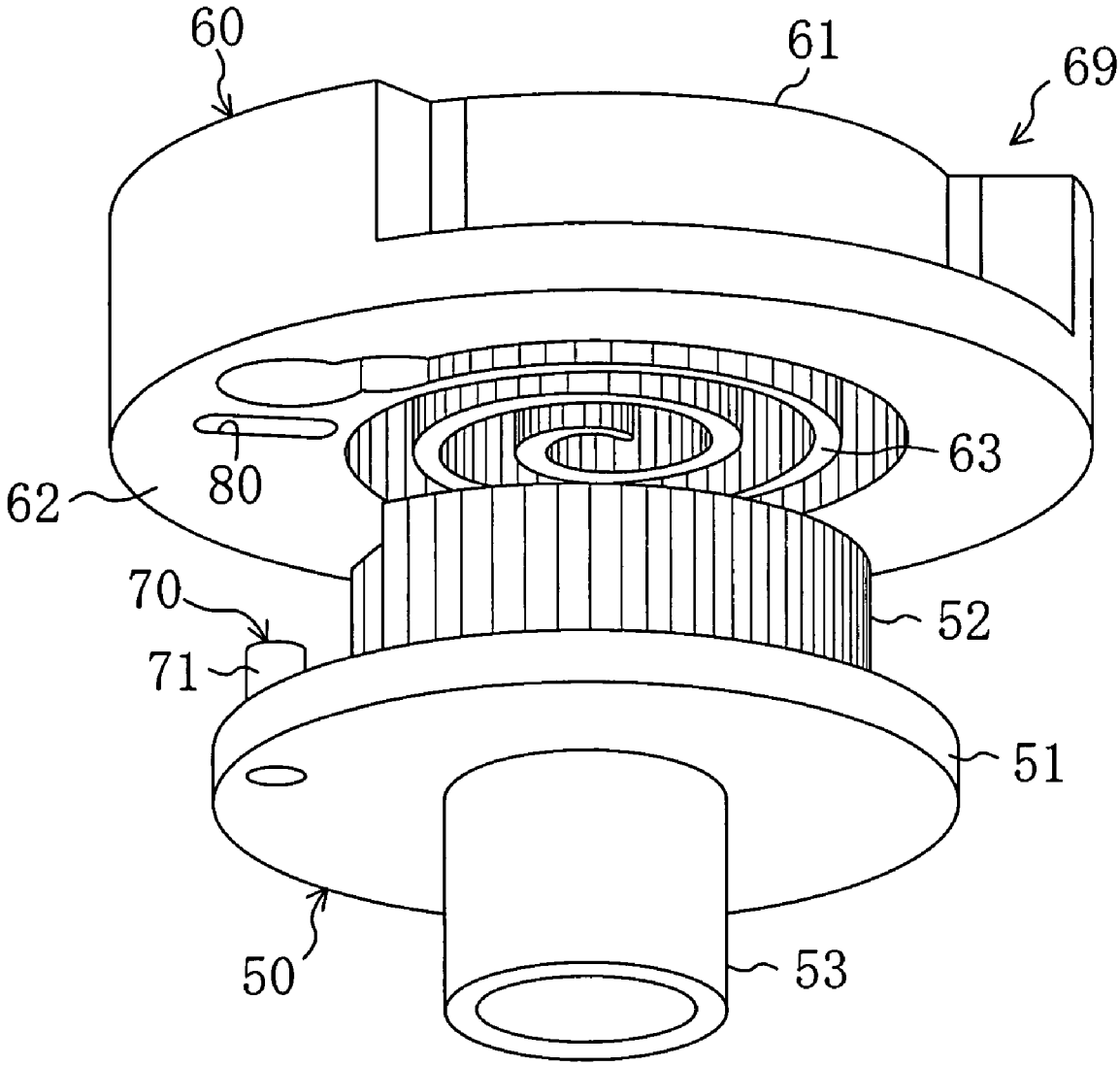
FIG. 12 is a perspective view, as viewed obliquely from below, of a fixed scroll and a movable scroll in a second embodiment of the present invention.

As shown in FIG. 12, in the compression mechanism (40) of the present embodiment, the columnar pin (71) constituting the pin shaft portion (70) is mounted to the movable scroll (50), and the slide groove (80) is formed in the fixed scroll (60).

In the first place, the configuration of the slide groove (80) and the pin shaft portion (70) is concretely described with reference to FIG. 12.

In the movable side end plate portion (51), the columnar pin (71) constituting the pin shaft portion (70) is mounted such that it projects on the side of the front surface (upper surface in FIG. 12) of the movable side end plate portion (51). In addition, in the movable side end plate portion (51), the columnar pin (71) is arranged in the vicinity of the outer peripheral side end of the movable side wrap (52). More specifically, the columnar pin (71) is provided at a position further ahead of the outer peripheral side end of the movable side wrap (52) along the spiral direction thereof.

The base end of the columnar pin (71) (lower end in FIG. 12) is embedded into the movable side end plate portion (51). More specifically, the movable side end plate portion (51) is provided with a preformed hole into which the columnar pin (71) is inserted, and the columnar pin (71) is press fitted into the hole. In other words, the columnar pin (71) constituting the pin shaft portion (70) is firmly secured to the movable side end plate portion (51) and is therefore forbidden to make a relative movement with respect to the movable scroll (50).

In the fixed scroll (60), the slide groove (80) is formed at a position facing the columnar pin (71) of the movable scroll (50). The slide groove (80) is a straight concave groove of constant width and is open at the lower surface of the rim portion (62). In addition, the slide groove (80) extends in approximately the radial direction of the fixed scroll (60). The projected end of the columnar pin (71) (upper end in FIG. 12) is engaged into the slide groove (80), in other words the columnar pin (71) constituting the pin shaft portion (70) engages the slide groove (80).

Figure 13:
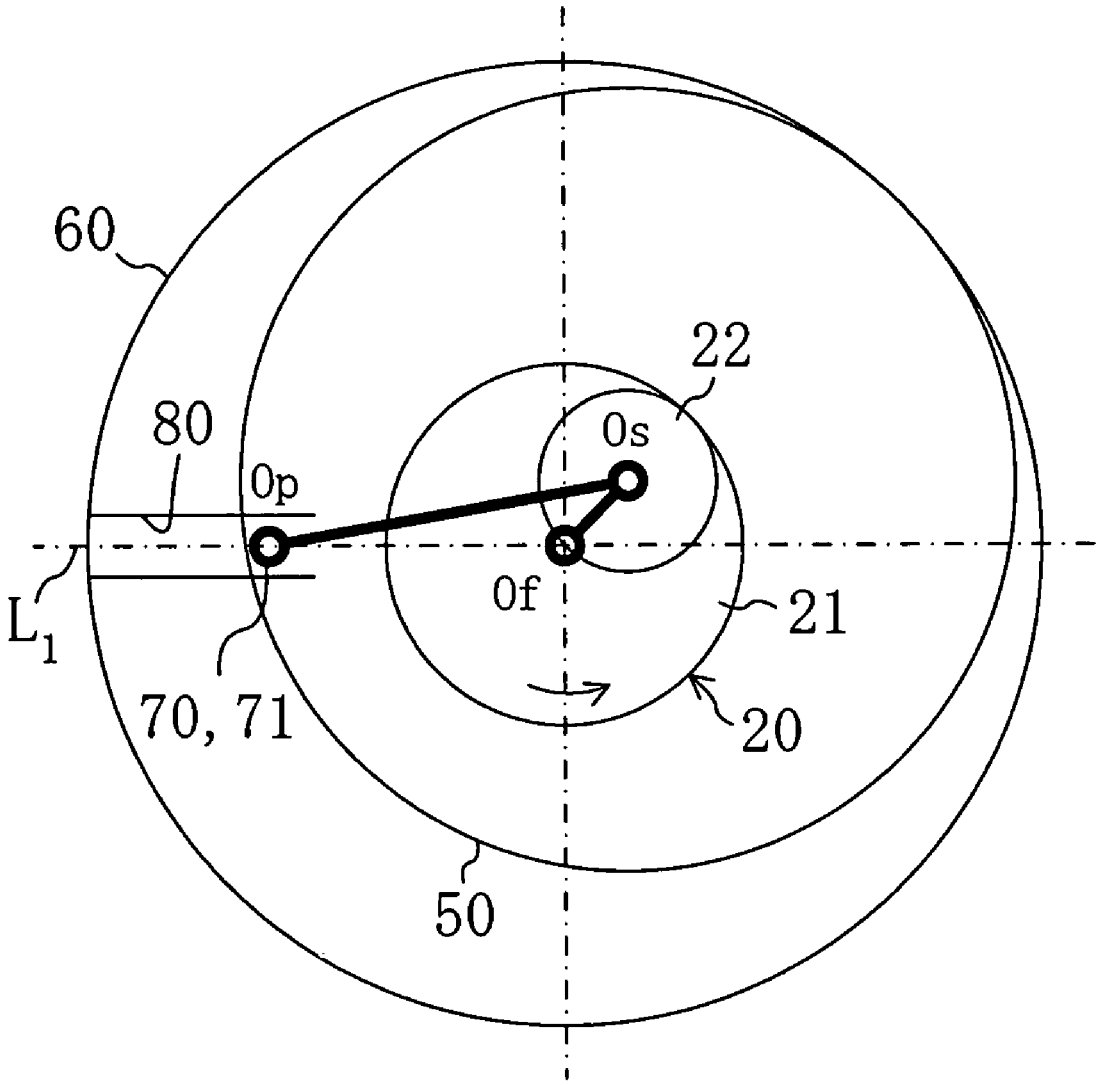
FIG. 13 is a schematic configuration diagram of a compression mechanism of the second embodiment.

Referring next to FIG. 13, the slide groove (80) and the pin shaft portion (70) will be described in regard to their arrangement and shape. FIG. 13 represents a positional relationship between the central axis of each of the main shaft portion (21), the eccentric shaft portion (22), and the columnar pin (71) and the slide groove (80) on a plane which is perpendicular to the central axis of the main shaft portion (21). In FIG. 13, "Of" is the central axis position of the main shaft portion (21); "Os" is the central axis position of the eccentric shaft portion (22); "Op" is the central axis position of the columnar pin (71) constituting the pin shaft portion (70); and "$L_1$" is the widthwise central line of the slide groove (80).

As described above, the movable scroll (50) orbitally moves around the central axis of the main shaft portion (21). In FIG. 13, the radius of orbital movement of the movable scroll (50) is represented as the length of a segment OfOs. In addition, the distance between the central axis of the columnar pin (71) and the central axis of the eccentric shaft portion (22) is represented as the length of a segment OpOs. And, as shown in FIG. 13, the segment OpOs is longer than the segment OfOs. In other word, in the fixed scroll (60), the columnar pin (71) constituting the pin shaft portion (70) is arranged such that the distance between the central axis of the columnar pin (71) and the central axis of the eccentric shaft portion (22) is longer than the radius of orbital movement of the movable scroll (50).

The columnar pin (71) constituting the pin shaft portion (70) has an outer diameter slightly smaller than the width of the slide groove (80). Consequently, in FIG. 13, the central axis position, Op, of the columnar pin (71) lies on the central line, $L_1$, of the slide groove (80), and the central axis of the columnar pin (71) is perpendicular to the central line of the slide groove (80). In addition, as shown in FIG. 13, the central axis position, Of, of the main shaft portion (21) lies on the central line, $L_1$, of the slide groove (80), and the central axis of the main shaft portion (21) is also perpendicular to the central line of the slide groove (80). Therefore, the central line of the slide groove (80) is perpendicular to both the central axis of the main shaft portion (21) and the central axis of the columnar pin (71) constituting the pin shaft portion (70). In other words, in the fixed scroll (60), the slide groove (80) is formed such that its central line is perpendicular to both the central axis of the main shaft portion (21) and the central axis of the columnar pin (71).

Running Operation

In the scroll compressor (10) of the present embodiment, the movable scroll (50) operates in approximately the same way as the movable scroll (50) of the first embodiment. In other words, the movable scroll (50) orbitally moves around the central axis of the main shaft portion (21) while simultaneously it rotates about the central axis of the eccentric shaft portion (22) within a predetermined angle range. In the scroll compressor (10) of the present embodiment, however, the columnar pin (71) mounted to the movable scroll (50) engages the slide groove (80) formed in the fixed scroll (60). The columnar pin (71) of the movable scroll (50) is guided by the slide groove (80), and rotation of the movable scroll (50) is restricted by sliding contact of the columnar pin (71) with the side surface of the slide groove (80).

Advantageous Effects of the Second Embodiment

In accordance with the present embodiment, friction loss occurring when rotation of the movable scroll (50) is restricted is reduced, and loss due to stirring up of lubricating oil by a member such as an Oldham ring is reduced, as in the first embodiment. Consequently, power loss in the scroll compressor (10) is reduced.

In addition, in accordance with the present embodiment, the movable scroll (50) is allowed to rotate to some extent, thereby making it possible to reduce the difference in maximum volume between the A-chamber (42) and the B-chamber (43). Consequently, vibration of the scroll compressor (10) can be reduced.

In addition, in the scroll compressor (10) of the present embodiment, the slide groove (80) is formed in the fixed scroll (60), thereby making it possible to relatively easily ensure accuracy of the position of the slide groove (80) and the fixed side wrap (63). Therefore, in accordance with the present embodiment, the gap between the movable side wrap (52) and the fixed side wrap (63) is controlled without fail, thereby inhibiting gas refrigerant leakage from the compression chamber (41), and the scroll compressor (10) is improved in efficiency.

First Variation of the Second Embodiment

Figure 14:
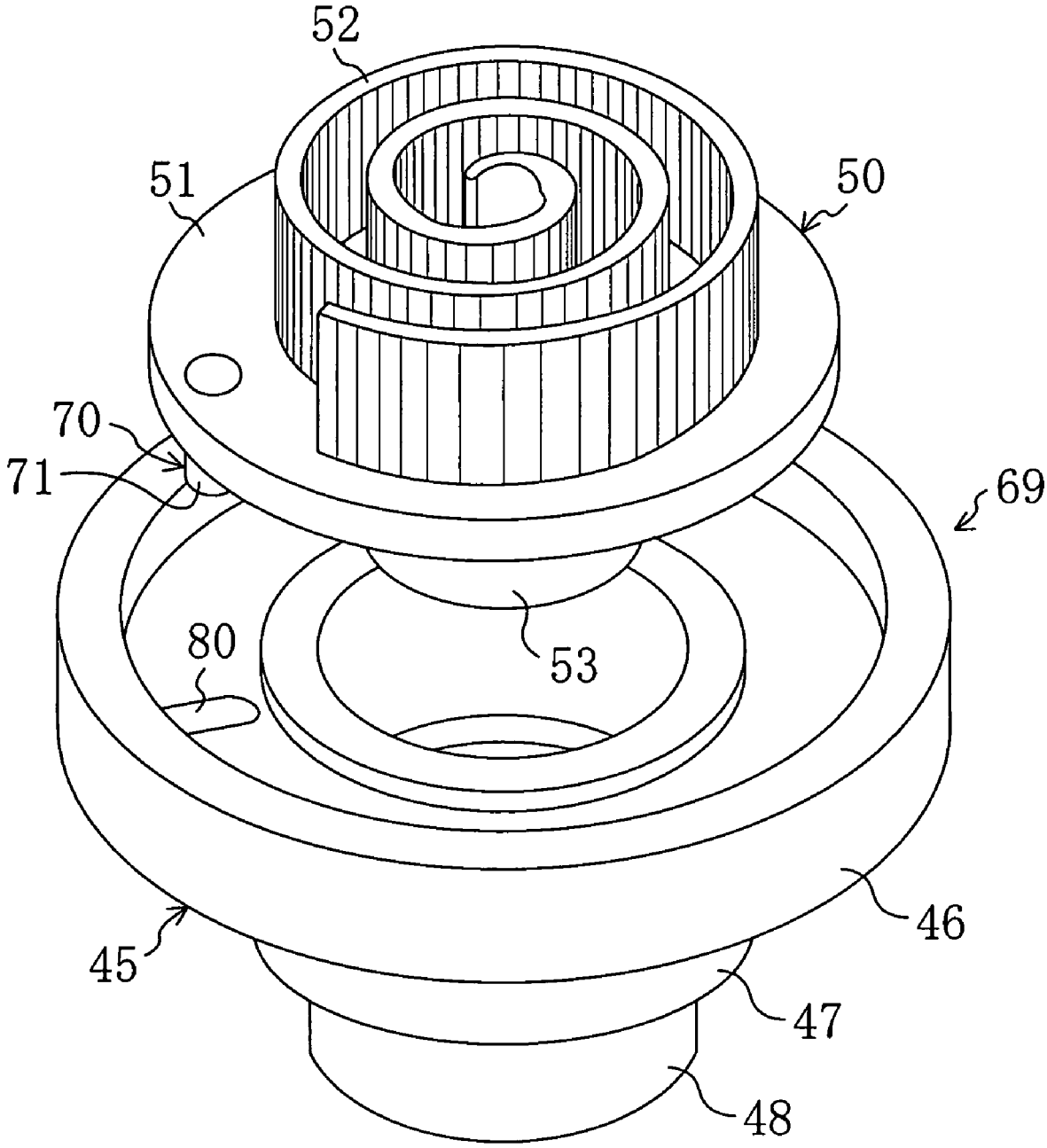
FIG. 14 is a perspective view, as viewed obliquely from above, of a fixed scroll and a housing in a first variation of the second embodiment.

In the present embodiment, as shown in FIG. 14, the slide groove (80) may be formed in the housing (45). More specifically, the slide groove (80) of the present variation is formed in the upper portion (46) of the housing (45). The slide groove (80) is a concave groove which is open at the upper surface of the bottom of the upper portion (46). In the present variation, the columnar pin (71) constituting the pin shaft portion (70) projects on the side of the back surface (lower surface in FIG. 14) of the movable side end plate portion (51). The upper end of the columnar pin (71) is press fitted into a hole which is preformed in the movable side end plate portion (51) while the lower end thereof is engaged into the slide groove (80).

In the present variation, the slide groove (80) is formed in the housing (45), thereby making it possible to relatively easily ensure accuracy of the position of the main shaft portion (21) supported by the housing (45) and the slide groove (80). Therefore, in accordance with the present variation, the gap between the movable side wrap (52) and the fixed side wrap (63) is controlled without fail, thereby inhibiting gas refrigerant leakage from the compression chamber (41), and the scroll compressor (10) is improved in efficiency.

Second Variation of the Second Embodiment

Figure 15:
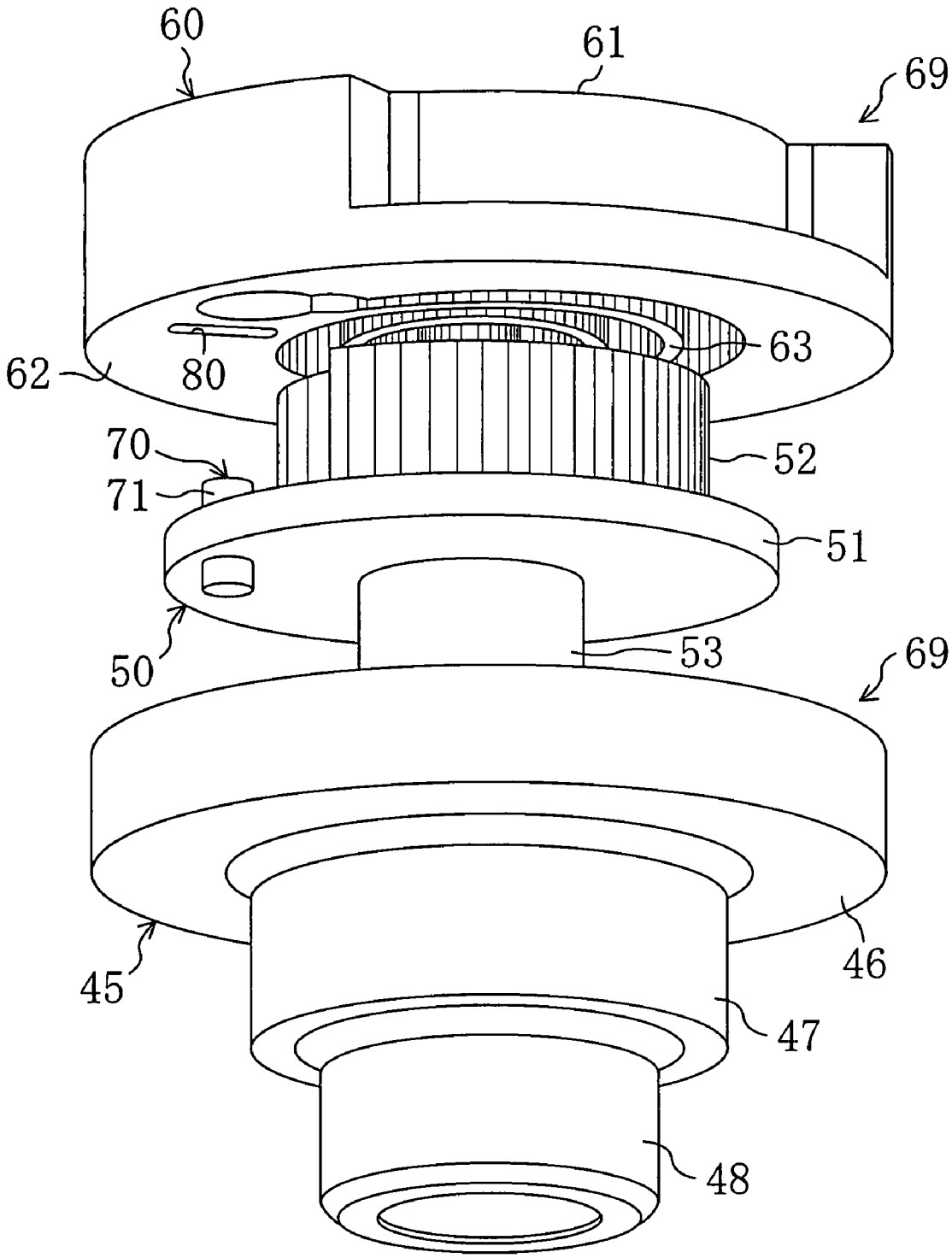
FIG. 15 is a perspective view, as viewed obliquely from below, of a fixed scroll, a movable scroll, and a housing in a second variation of the second embodiment.
Figure 16:
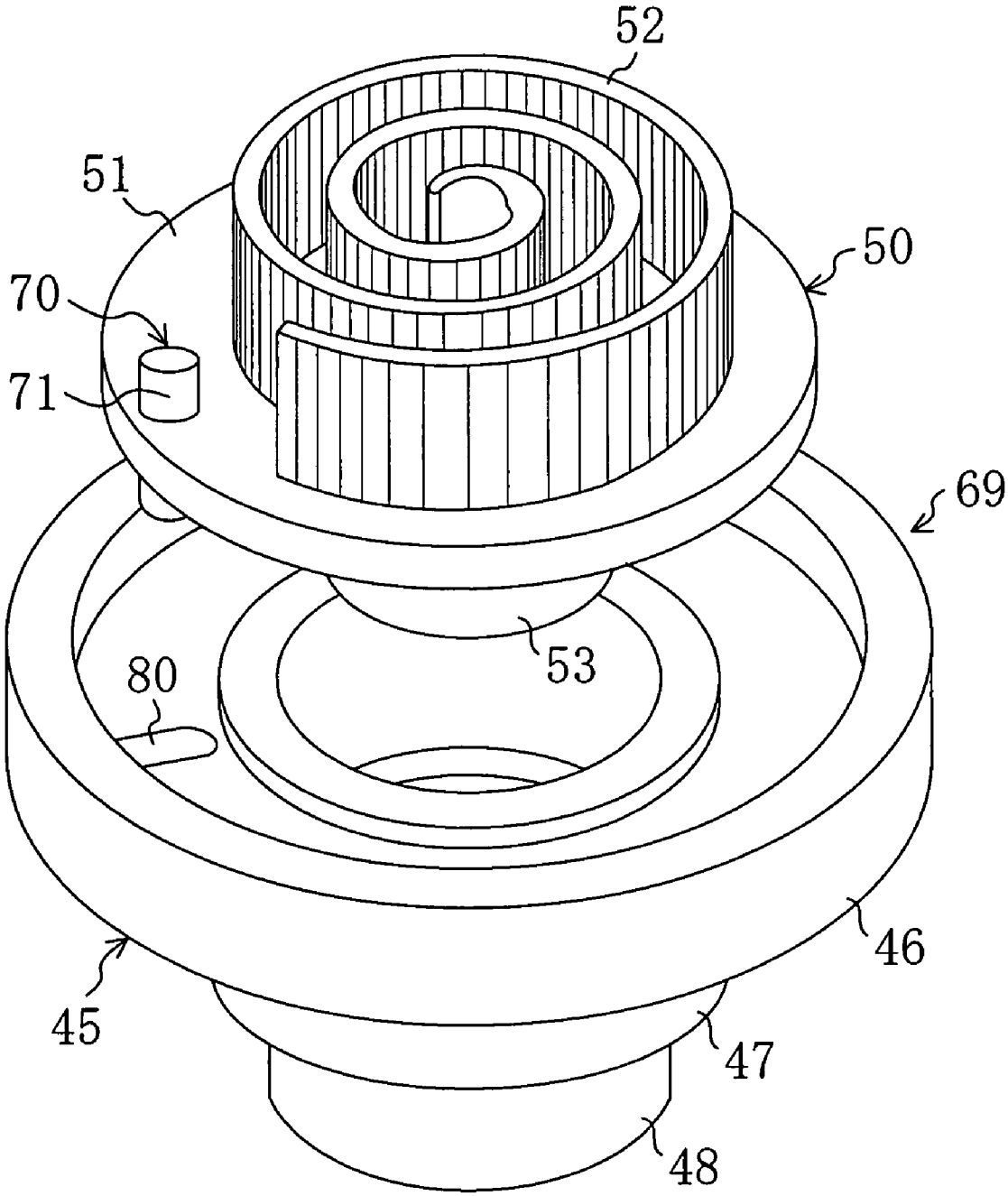
FIG. 16 is a perspective view, as viewed obliquely from above, of a fixed scroll and a housing of the second variation of the second embodiment.

In the present embodiment, as shown in FIG. 15 and FIG. 16, the slide groove (80) may be formed in both the fixed scroll (60) and the housing (45). The slide groove (80) formed in the housing (45) is a concave groove which is open at the upper surface of the bottom of the upper portion (46). In the present variation, the columnar pin (71) constituting the pin shaft portion (70) projects not only on the side of the front surface (upper surface in FIGS. 15 and 16) but also on the side of the back surface (lower surface in FIGS. 15 and 16) of the movable side end plate portion (51). In other words, the columnar pin (71) passes completely through the movable side end plate portion (51). The upper end of the columnar pin (71) is engaged into the slide groove (80) of the fixed scroll (60) while the lower end thereof is engaged into the slide groove (80) of the housing (45).

In the present variation, the upper end of the columnar pin (71) constituting the pin shaft portion (70) slidingly contacts the slide groove (80) of the fixed scroll (60) while the lower end thereof slidingly contacts the slide groove (80) of the housing (45). This therefore makes it possible to reduce the amount of deformation of the columnar pin (71), and it become possible to inhibit the columnar pin (71) and the slide grooves (80) from undergoing partial wear due to deformation of the columnar pin (71).

Third Variation of the Second Embodiment

Figure 17:
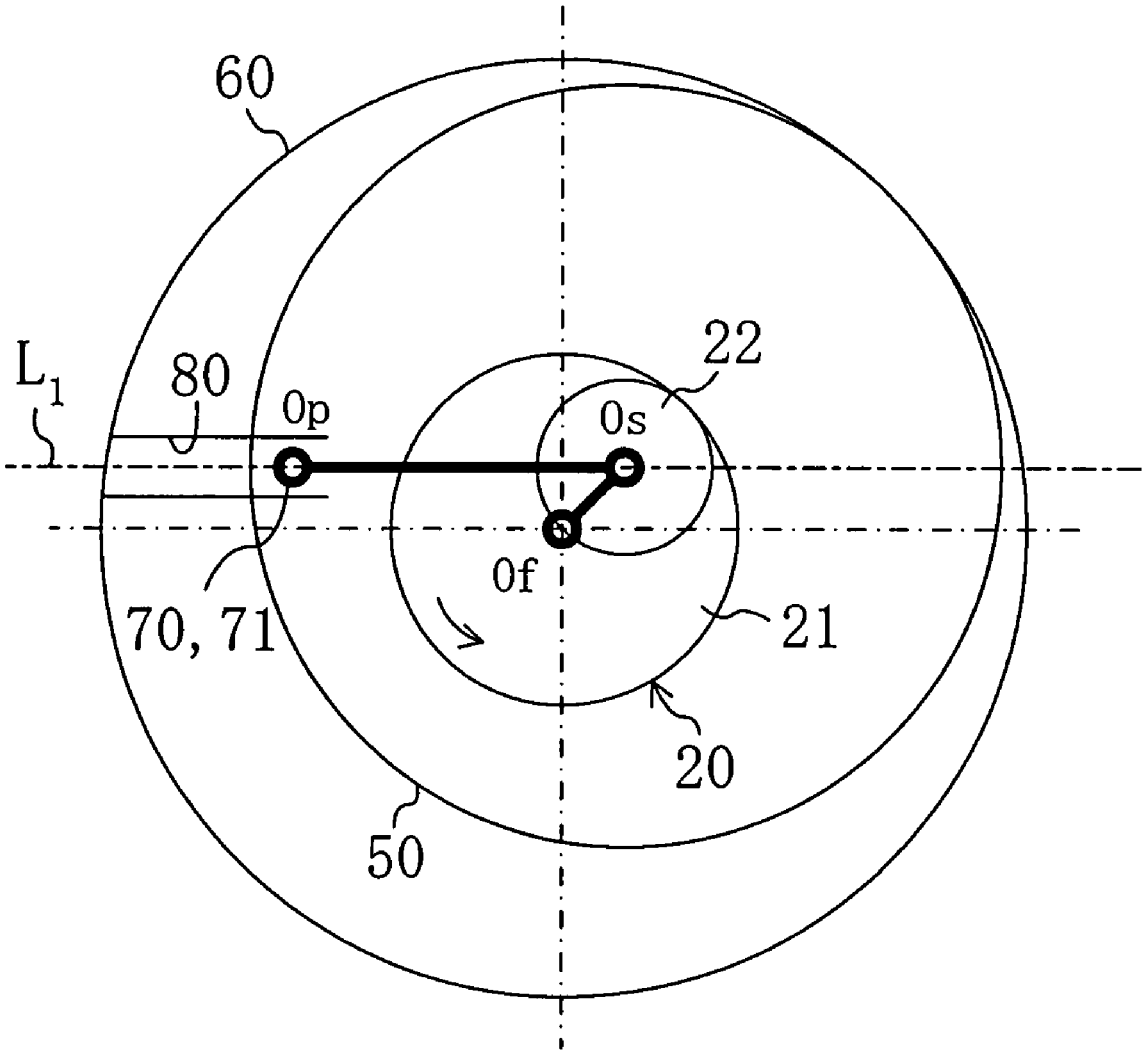
FIG. 17 is a schematic configuration diagram of a compression mechanism in a third variation of the second embodiment.

In the present embodiment, as shown in FIG. 17, the central line, $L_1$, of the slide groove (80) may form a predetermined acute angle with a straight line which is perpendicular to both the central axis of the main shaft portion (21) and the central axis of the columnar pin (71).

Referring now to FIG. 17 which corresponds to FIG. 13, the central axis position of the main shaft portion 21 is indicated by "Of"; the central axis position of the eccentric shaft portion (22) is indicated by "Os"; the central axis position of the columnar pin (71) constituting the pin shaft portion (70) is indicated by "Op"; and the widthwise central line of the slide groove (80) is indicated by "$L_1$". The straight line which is perpendicular to both the central axis of the main shaft portion (21) and the central axis of the columnar pin (71) is a straight line OpOf which passes through both the central axis position, Of, of the main shaft portion (21) and the central axis position, Op, of the columnar pin (71) in the figure. In the present variation, the angle formed between the central line, $L_1$, of the slide groove (80) and the straight line OpOf falls below 90 degrees.

In accordance with the present variation, it becomes possible to reduce the rotation angle of the movable scroll (50) to a further extent in comparison with the case where the central line of the slide groove (80) is perpendicular to both the central axis of the main shaft portion (21) and the central axis of the columnar pin (71). Consequently, it becomes possible to reduce variation in the thickness of each of the movable and fixed side wraps (52, 63) associated with rotation of the movable scroll (50), thereby facilitating ensuring the rigidity of the movable side wrap (52) and the fixed side wrap (63).

Third Embodiment of the Invention

Description will be made in regard to a third embodiment of the present invention. The present embodiment is a modification of the first embodiment in that the pin shaft portion (70) and the slide groove (80) are modified in configuration. Hereinafter, in regard to the scroll compressor (10) of the present embodiment, the difference from the first embodiment is described.

Figure 18:
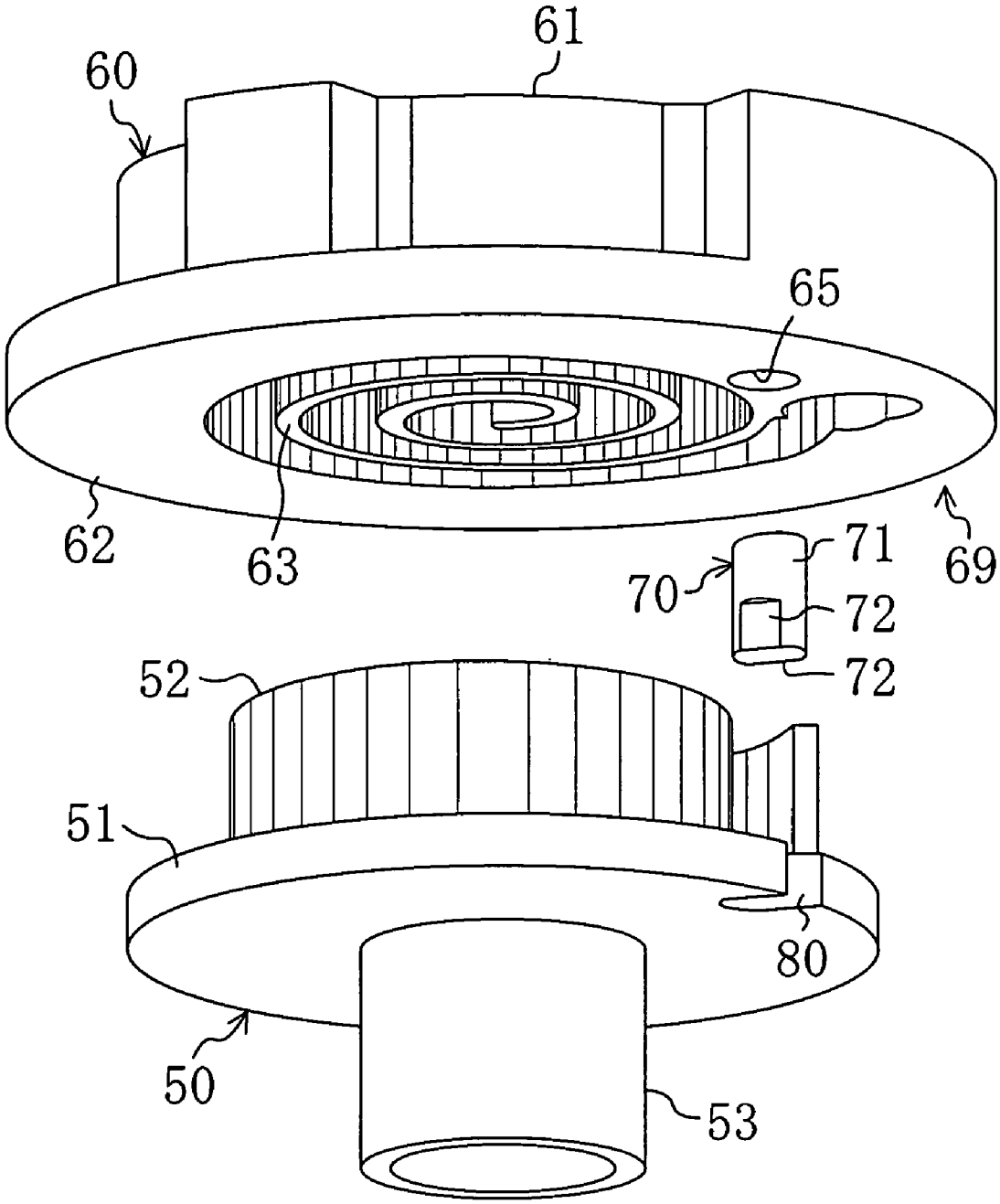
FIG. 18 is a perspective view, as viewed obliquely from below, of a fixed scroll and a movable scroll in a third embodiment of the present invention.

As shown in FIG. 18, the columnar pin (71) constituting the pin shaft portion (70) of the present embodiment is provided with a pair of sliding contact surfaces (72). Each sliding contact surface (72) is a flat surface formed by partially chipping off the side surface of the columnar pin (71) and is formed over approximately half of the height of the columnar pin (71) from the lower end thereof. In addition, each sliding contact surface (72) is a flat surface in parallel with the central axis of the columnar pin (71) and is situated opposite to the other across the central axis of the columnar pin (71).

In the present embodiment, the base end of the columnar pin (71) (upper end in FIG. 18) is freely engaged into an engagement hole (65) formed in the fixed scroll (60). More specifically, the diameter of the engagement hole (65) is slightly greater than the diameter of the base end of the columnar pin (71). The columnar pin (71) inserted into the engagement hole (65) is rotatable relative to the fixed scroll (60).

In addition, in the present embodiment, the slide groove (80) passes completely through the movable side end plate portion (51) of the movable side wrap (52). The slide groove (80) is formed by cutting away the movable side end plate portion (51) from the outer peripheral surface towards the center thereof. The slide groove (80) has a width slightly greater than the distance between the sliding contact surfaces (72) of the columnar pin (71). The tip of the columnar pin (71) (lower end in FIG. 18) is engaged into the slide groove (80). The sliding contact surfaces (72) formed in the tip of the columnar pin (71) slidingly contact the side surface of the slide groove (80).

Running Operation

The scroll compressor (10) of the present embodiment compresses refrigerant by the same operations as are carried out in the first embodiment. Hereinafter, description will be made in regard to the movement of the movable scroll (50) with reference to FIG. 19. By the terms "clockwise rotation" and "counterclockwise rotation" as used in the description are meant, respectively, "clockwise rotation" and "counterclockwise rotation" in FIG. 19.

Figure 19:
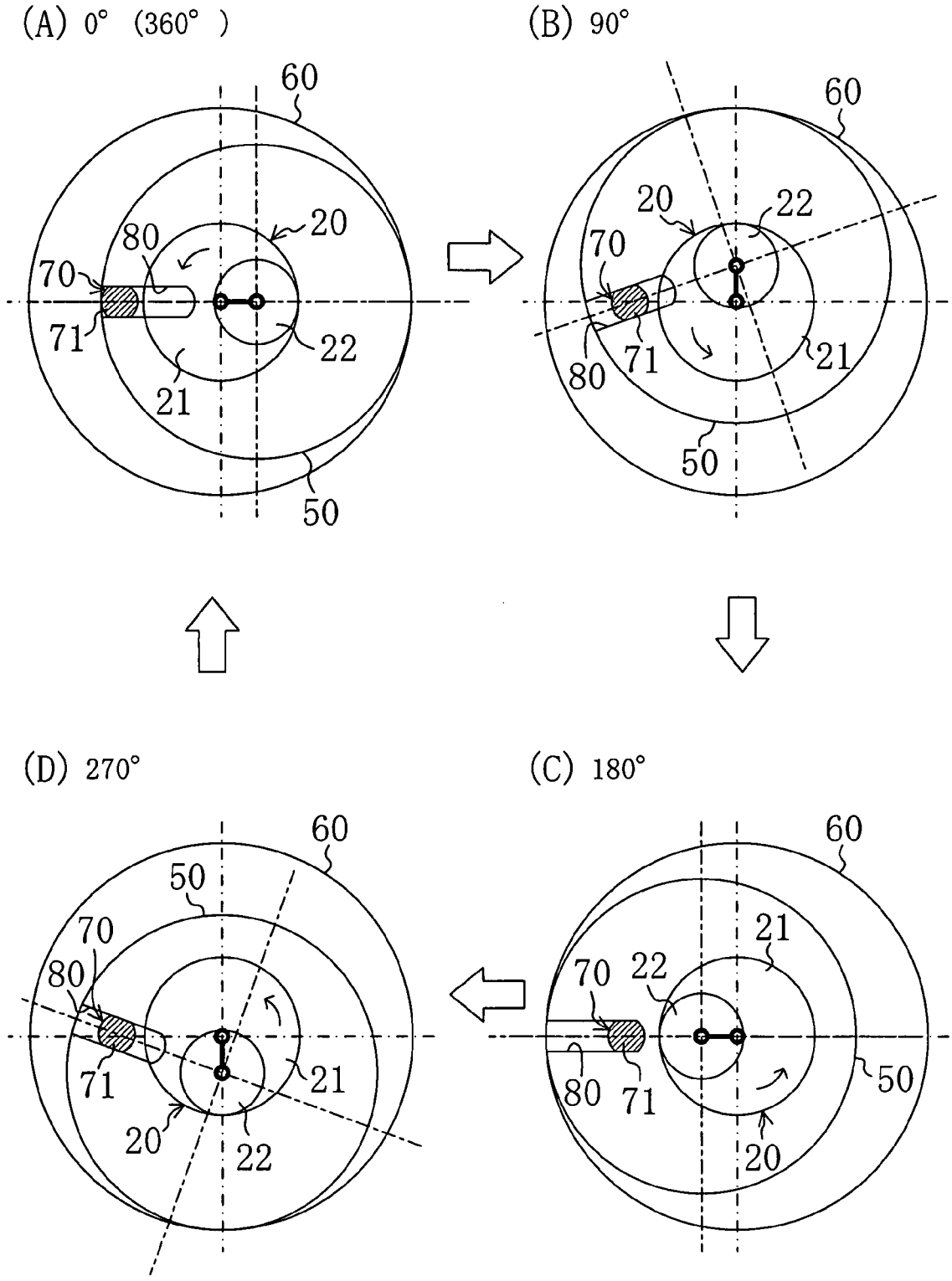
FIG. 19 is a schematic configuration diagram of a compression mechanism illustrating the movement of a movable scroll of the third embodiment.

FIG. 19 corresponds to FIG. 6. That is, FIG. 19(A) shows a state of the driving shaft (20) when its rotation angle is at 0 or 360 degrees. FIG. 19(B) shows another state of the driving shaft (20) when its rotation angle is at 90 degrees. FIG. 19(C) shows yet another state of the driving shaft (20) when its rotation angle is at 180 degrees. FIG. 19(D) shows still another state of the driving shaft (20) when its rotation angle is at 270 degrees.

When the driving shaft (20) rotates counterclockwise, the movable scroll (50) orbitally moves around the central axis of the main shaft portion (21), during which the side surface of the slide groove (80) slidingly contacts the side surface of the columnar pin (71), whereby rotation of the movable scroll (50) is restricted.

More specifically, as the rotation angle of the driving shaft (20) increases from zero degrees, the movable scroll (50) rotates counterclockwise. At this time, the pin shaft portion (70) also rotates counterclockwise in association with rotation of the movable scroll (50). Thereafter, upon reaching a predetermined value of the rotation angle of the driving shaft (20), the movable scroll (50) now starts rotating clockwise. At this time, the pin shaft portion (70) also rotates clockwise in association with rotation of the movable scroll (50). At the point of time when the rotation angle of the driving shaft (20) reaches 180 degrees, the rotation angle of the movable scroll (50) and the columnar pin (71) becomes zero degrees, as in when the rotation angle of the driving shaft (20) is at zero degrees.

When the driving shaft (20) continues to rotate counterclockwise to reach a rotation angle of 360 degrees, the rotational angle of the driving shaft (20) returns to the same state as when the rotation angle of the driving shaft (20) is at zero degrees (see FIG. 19(A)). During all that time, the side surface of the slide groove (80) slidingly contacts the side surface of the columnar pin (71), whereby rotation of the movable scroll (50) is restricted.

More specifically, as the rotation angle of the driving shaft (20) increases from 180 degrees, the movable scroll (50) rotates clockwise. At this time, the pin shaft portion (70) also rotates clockwise in association of the rotation of the movable scroll (50). Thereafter, upon reaching a predetermined value of the rotation angle of the driving shaft (20), the movable scroll (50) now starts rotating counterclockwise. At this time, the pin shaft portion (70) also rotates counterclockwise in association with rotation of the movable scroll (50). At the point of time when the rotation angle of the driving shaft (20) reaches 360 degrees, the rotation angle of the movable scroll (50) and the columnar pin (71) becomes zero degrees, as in when the rotation angle of the driving shaft (20) is at zero degrees.

Advantageous Effects of the Third Embodiment

In accordance with the present embodiment, in addition to the effects provided by the first embodiment, the following advantageous effects are obtained.

In the present embodiment, the columnar pin (71) constituting the pin shaft portion (70) is provided with the sliding contact surfaces (72) which are flat surfaces, and a force for restricting rotation of the movable scroll (50) acts on the sliding contact surfaces (72) of the columnar pin (71). Consequently, it becomes possible to reduce contact stress acting on the sliding contact surfaces (72) of the columnar pin (71) and on the side surface of the slide groove (80) during orbital movement of the movable scroll (50), thereby making it possible to improve the state of lubrication between the sliding contact surfaces (72) of the columnar pin (71) and the side surface of the slide groove (80). Therefore, in accordance with the present embodiment, it is possible to ensure lubrication between the sliding contact surfaces (72) of the columnar pin (71) and the side surface of the slide groove (80), and the reliability of the scroll compressor (10) is enhanced by reducing the possibility of occurrence of troubles such as seizing, wear et cetera.

First Variation of the Third Embodiment

Figure 20:
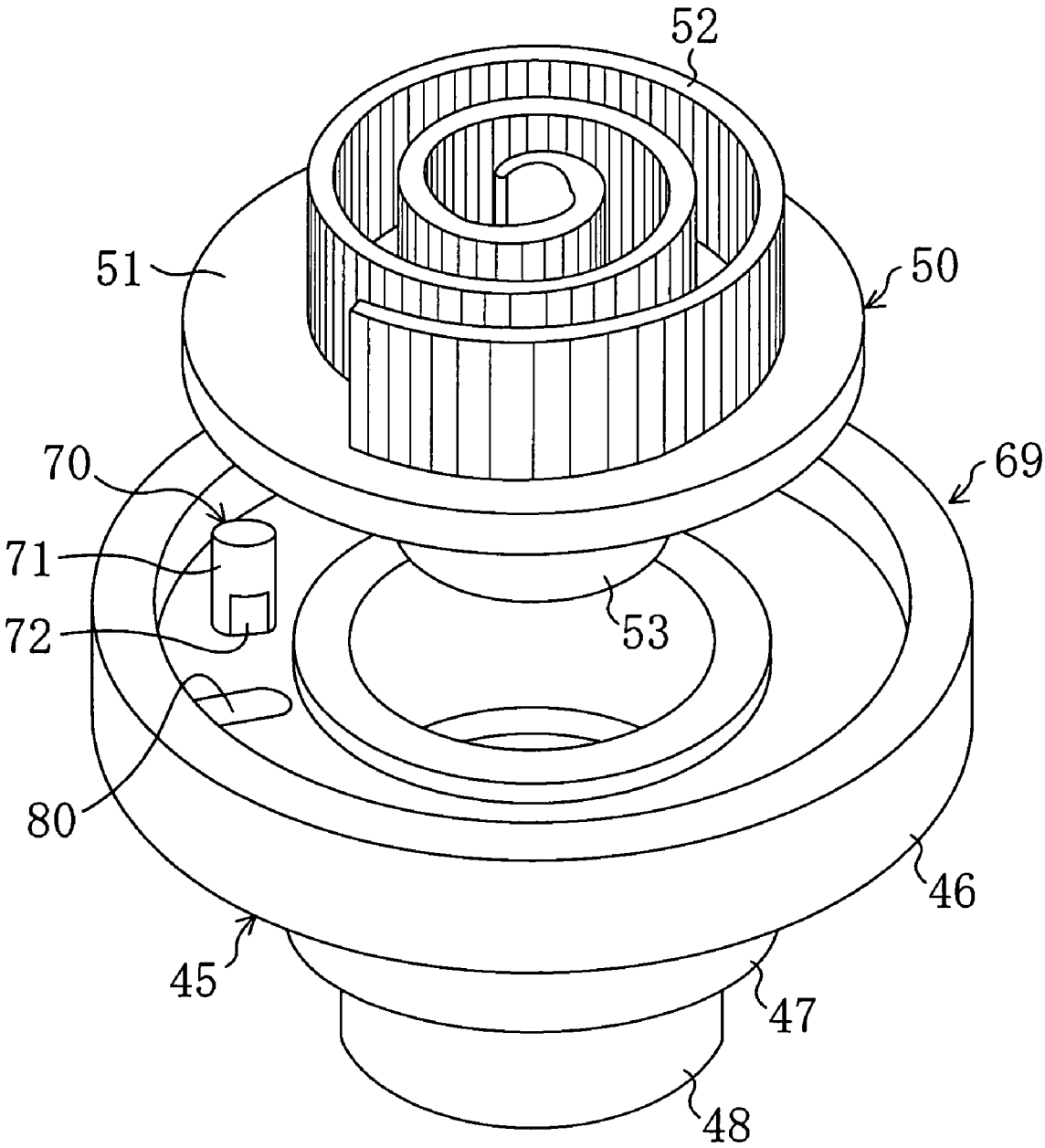
FIG. 20 is a perspective view, as viewed obliquely from above, of a movable scroll and a housing in a first variation of the third embodiment.

As shown in FIG. 20, the present embodiment may be modified such that the columnar pin (71) constituting the pin shaft portion (70) is mounted to the movable scroll (50) and the slide groove (80) is formed in the housing (45).

The movable scroll (50) of the present variation is provided with an engagement hole (not shown in the drawing) for insertion of the columnar pin (71) thereinto. The engagement hole is formed in the movable side end plate portion (51) and is open at the back surface (lower surface in FIG. 20) of the movable side end plate portion (51). The base end (upper end in FIG. 20) of the columnar pin (71) at which no sliding contact surface (72) is formed is freely engaged into the engagement hole of the movable side end plate portion (51), in other words the columnar pin (71) is rotatable relative to the movable scroll (50).

The slide groove (80) of the present variation is formed in the upper portion (46) of the housing (45). The slide groove (80) is a concave groove which is open at the upper surface of the bottom of the upper portion (46). The tip (lower end in FIG. 20) of the columnar pin (71) constituting the pin shaft portion (70) in which the sliding contact surfaces (72) are formed is engaged into the slide groove (80). The sliding contact surfaces (72) of the columnar pin (71) slidingly contact the side surface of the slide groove (80).

In the present variation, the slide groove (80) is formed in the housing (45). Alternatively, the slide groove (80) may be formed not in the housing (45) but in the fixed scroll (60). In this case, the slide groove (80) is a concave groove which is open at the lower surface of the rim portion (62) of the fixed scroll (60). In addition, the columnar pin (71) constituting the pin shaft portion (70) is mounted such that it projects on the side of the front surface of the movable side end plate portion (51).

Second Variation of the Third Embodiment

In the present embodiment, the sliding contact surface (72) formed in the columnar pin (71) may be a tapered surface. More specifically, the sliding contact surface (72) of the columnar pin (71) may be inclined at 5/1000 or less (preferably about 1/1000) towards the direction of sliding contact with the slide groove (80). If the sliding contact surface (72) of the columnar pin (71) is tapered, this provides a "wedge effect" by lubricating oil entered into a gap between the sliding contact surface (72) and the side surface of the slide groove (80), thereby making it possible to positively produce an oil film reactive force in the gap. Consequently, it becomes possible to ensure lubrication between the sliding contact surface (72) of the columnar pin (71) and the side surface of the slide groove (80), whereby friction loss between the columnar pin (71) and the slide groove (80) is further assuredly reduced.

Third Variation of the Third Embodiment

The present embodiment may be modified such that the sliding contact surface is omitted in the columnar pin (71) constituting the pin shaft portion (70). In other words, the columnar pin (71) formed in a simple cylindrical shape may be rotatably mounted to the fixed scroll (60).

The columnar pin (71) of the present variation rotates while slidingly contacting the side surface of the slide groove (80). Therefore, in comparison with the case where the columnar pin (71) is forbidden to rotate, the speed of sliding contact between the columnar pin (71) and the side surface of the slide groove (80) is lowered. Consequently, it becomes possible to ensure lubrication between the columnar pin (71) and the side surface of the slide groove (80), thereby reducing the possibility of occurrence of troubles such as seizing, wear et cetera. Therefore, in accordance with the present variation, it becomes possible to enhance the reliability of the scroll compressor (10).

Fourth Embodiment of the Invention

Description will be made in regard to a fourth embodiment of the present invention. The present embodiment is a modification of the first embodiment in that the pin shaft portion (70) is modified in configuration. Hereinafter, in regard to the scroll compressor (10) of the present embodiment, the difference from the first embodiment is described.

Figure 21:
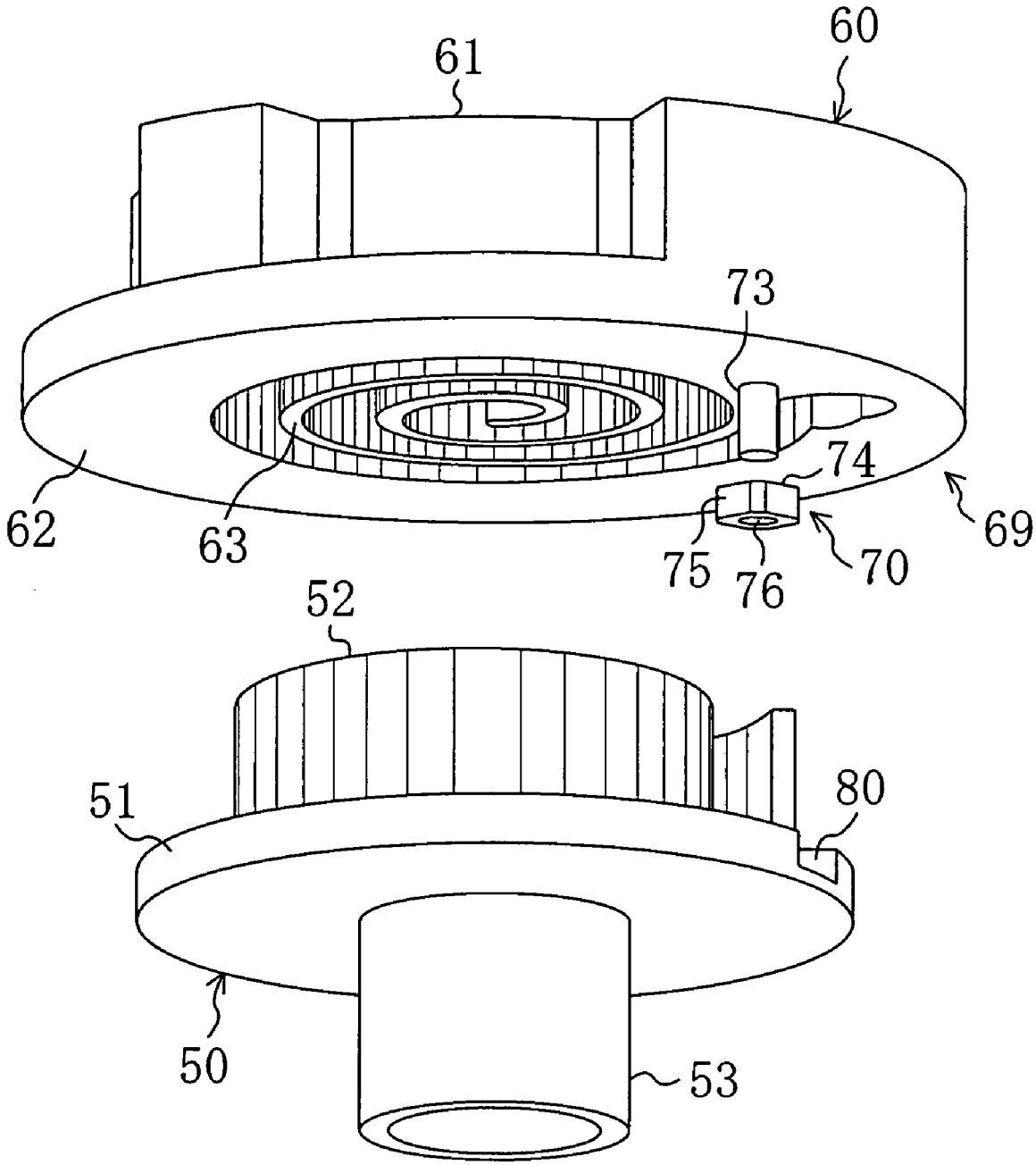
FIG. 21 is a perspective view, as viewed obliquely from below, of a fixed scroll and a movable scroll in a fourth embodiment of the present invention.

As shown in FIG. 21, the pin shaft portion (70) of the present embodiment is made up of the body member (73) and the bush member (74).

The body member (73) is formed in a cylindrical shape. The base end (upper end in FIG. 21) of the body member (73) is embedded into the rim portion (62) of the fixed scroll (60). More specifically, the rim portion (62) is provided with a preformed hole for insertion of the body member (73) thereinto and the body member (73) is press fitted into the hole. In other words, the body member (73) of the pin shaft portion (70) is firmly secured to the fixed scroll (60) and is therefore forbidden to make a relative movement with respect to the fixed scroll (60). In the pin shaft portion (70) of the present embodiment, the central axis of the body member (73) is the central axis of the pin shaft portion (70).

The bush member (74) is formed in a shape obtained by chamfering a relatively short quadratic prism along its four axial sides. In other words, the bush member (74) has a cross section shaped like an octagon having parallel opposing sides. Of the side surfaces of the bush member (74), a pair of opposing side surfaces serve as sliding contact surfaces (75).

In addition, the bush member (74) is provided with a through hole (76) which passes completely through the bush member (74) in the height direction (vertical direction in FIG. 21) thereof. The through hole (76) is a hole having a circular cross section and formed coaxially with the bush member (74). The tip (lower end in FIG. 21) of the body member (73) is freely engaged into the through hole (76) of the bush member (74). In other words, the through hole (76) has a diameter slightly greater than the outer diameter of the body member (73). The body member (73) is inserted through the through hole (76) of the bush member (74), and the bush member (74) is rotatable relative to the body member (73).

In the present embodiment, the slide groove (80) formed in the movable side end plate portion (51) has a width slightly greater than the distance between the sliding contact surfaces (75) of the bush member (74). The bush member (74) of the pin shaft portion (70) of the present embodiment is engaged into the slide groove (80), and the sliding contact surfaces (75, 75) of the bush member (74) slidingly contact the side surface of the slide groove (80).

Running Operation

The scroll compressor (10) of the present embodiment compresses refrigerant by the same operations as are carried out in the first embodiment. During orbital movement of the movable scroll (50), the bush member (74) of the pin shaft portion (70) slidingly contacts the side surface of the slide groove (80), whereby rotation of the movable scroll (50) is restricted. And, in association with rotation of the movable scroll (50), the bush member (74) rotates about the central axis of the body member (73).

Advantageous Effects of the Fourth Embodiment

The present embodiment provides, in addition to the advantageous effects of the first embodiment, the following advantageous effects.

In the first place, in the present embodiment, the bush member (74) as a separate body from the body member (73) is brought into sliding contact with the side surface of the slide groove (80). Therefore, in accordance with the present embodiment, it becomes possible to form the body member (73) and the bush member (74) with different materials, thereby making it possible to achieve improvement in reliability by forming the bush member (74) with a material superior in sliding contact performance, lubrication performance et cetera.

In addition, in the present embodiment, the bush member (74) is provided with the sliding contact surface (75) which is a flat surface, and a force for restricting rotation of the movable scroll acts on the sliding contact surface (75) of the bush member (74). Consequently, it becomes possible to reduce contact stress acting on the bush member (74) of the pin shaft portion (70) and on the side surface of the slide groove (80) during orbital movement of the movable scroll, thereby making it possible to improve the state of lubrication between the sliding contact surface (75) of the bush member (74) and the side surface of the slide groove (80). Therefore, in accordance with the present embodiment, it is ensured that lubrication between the sliding contact surface (75) of the bush member (74) and the side surface of the slide groove (80) is carried out without fail, and the reliability of the scroll compressor (10) is ensured by reducing the possibility of occurrence of troubles such as seizing, wear et cetera.

First Variation of the Fourth Embodiment

Figure 22:
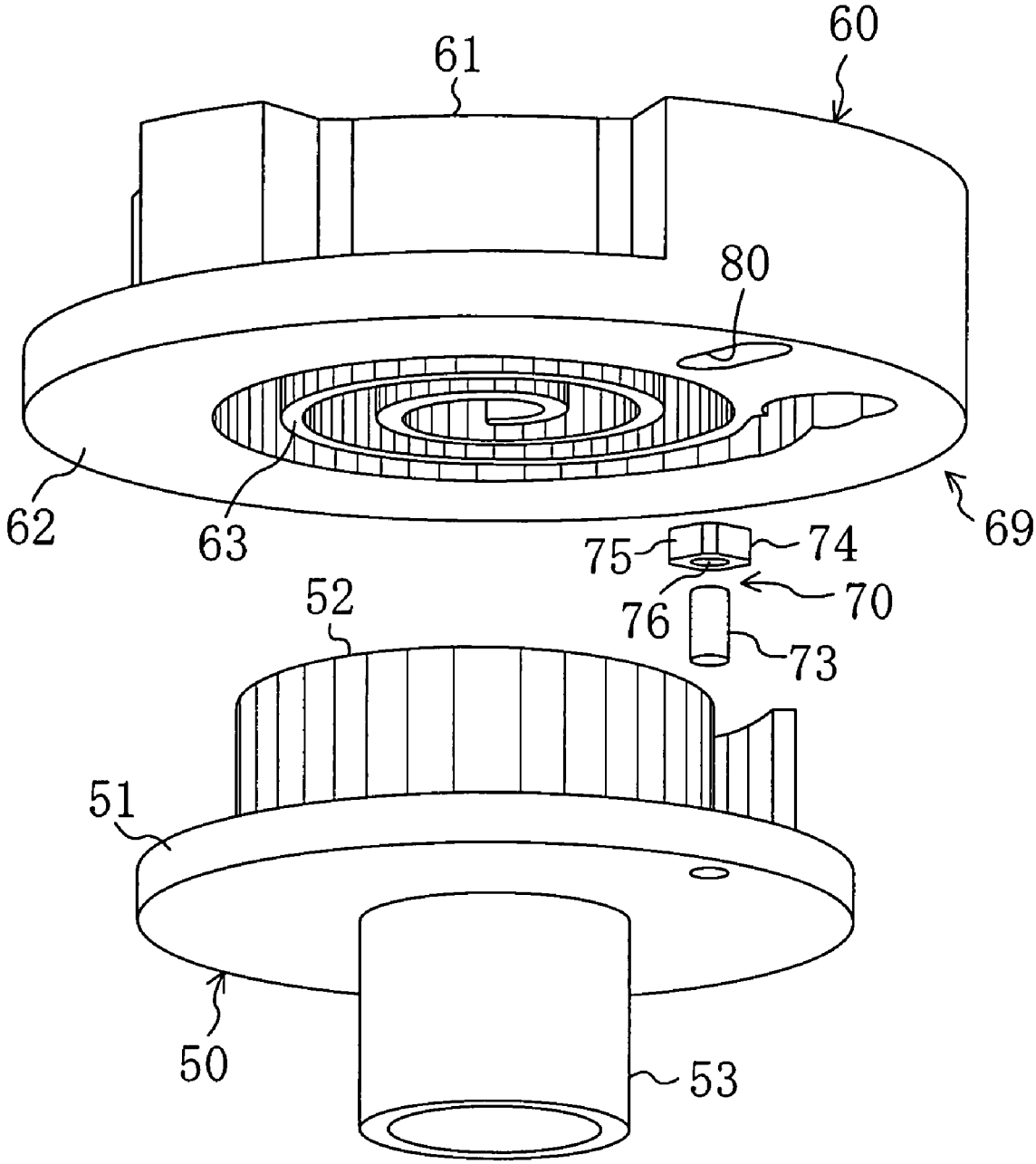
FIG. 22 is a perspective view, as viewed obliquely from below, of a fixed scroll and a movable scroll in a first variation of the fourth embodiment.

The present embodiment may be modified such that the pin shaft portion (70) is provided in the movable scroll (50) and the slide groove (80) is formed in the fixed scroll (60), as shown in FIG. 22.

In the present variation, the body member (73) of the pin shaft portion (70) is press fitted into a hole which is preformed in the movable side end plate portion (51), and projects on the side of the front surface (upper surface in FIG. 22) of the movable side end plate portion (51). Inserted into the through hole (76) of the bush member (74) is a portion of the body member (73) that projects on the side of the front surface of the movable side end plate portion (51). Also in the present variation, the bush member (74) is rotatable relative to the body member (73).

The slide groove (80) of the present variation is formed in the rim portion (62) of the fixed scroll (60). The slide groove (80) is a concave groove which is open at the lower surface of the rim portion (62). The bush member (74) of the pin shaft portion (70) is engaged into the slide groove (80), and the sliding contact surface (75) of the bush member (74) slidingly contacts the side surface of the slide groove (80).

In addition, in the present variation, the slide groove (80) is formed in the fixed scroll (60). Alternatively, the slide groove (80) may be formed not in the fixed scroll (60) but in the housing (45). In this case, the slide groove (80) is a concave groove which is open at the upper surface of the bottom of the upper portion (46) of the housing (45). In addition, the body member (73) of the pin shaft portion (70) is mounted such that it projects on the side of the back surface of the movable side end plate portion (51), and the lower end of the body member (73) is inserted into the through hole (76) of the bush member (74).

Second Variation of the Fourth Embodiment

In the present embodiment, the sliding contact surface (75) formed in the bush member (74) may be a tapered surface. More specifically, the sliding contact surface (75) of the bush member (74) may be inclined at $5/1000$ or less (preferably about $1/1000$) towards the direction of sliding contact with the slide groove (80). If the sliding contact surface (75) of the bush member (74) is tapered, this provides a "wedge effect" by lubricating oil entered into a gap between the sliding contact surface (75) and the side surface of the slide groove (80), thereby making it possible to positively produce an oil film reactive force in the gap. Consequently, it becomes possible to ensure lubrication between the sliding contact surface (75) of the bush member (74) and the side surface of the slide groove (80), whereby friction loss between the bush member (74) and the slide groove (80) is further assuredly reduced.

Third Variation of the Fourth Embodiment

The third embodiment may be modified such that the sliding contact surface is omitted in the bush member (74) of the pin shaft portion (70). In other words, it may be arranged such that the bush member (74) is formed in a simple tubular shape and is mounted rotatably relative to the fixed scroll (60).

The bush member (74) of the present variation rotates while slidingly contacting with the side surface of the slide groove (80). Therefore, in comparison with the case where the bush member (74) is forbidden to rotate, the speed of sliding contact between the bush member (74) and the side surface of the slide groove (80) is lowered. Consequently, it becomes possible to ensure lubrication between the bush member (74) and the side surface of the slide groove (80), thereby reducing the possibility of occurrence of troubles such as seizing, wear et cetera. Therefore, in accordance with the present variation, it becomes possible to enhance the reliability of the scroll compressor (10).

Fourth Variation of the Fourth Embodiment

The present embodiment may be modified such that the bush member (74) is firmly secured to the body member (73) and the body member (73) is freely engaged into a hole formed in the fixed scroll (60). In other words, in the present variation, the body member (73) is press fitted into the through hole (76) of the bush member (74), and movement of the bush member (74) with respect to the body member (73) is forbidden. The body member (73), to which the bush member (74) is mounted, is provided rotatably relative to the fixed scroll (60).

In addition, in the case where the pin shaft portion (70) is mounted to the movable scroll (50) as in the first variation, it may be arranged such that the body member (73) of the pin shaft portion (70) is firmly secured to the movable side end plate portion (51) and the bush member (74) is rotatably mounted to the body member (73) firmly secured to the movable side end plate portion (51).

Fifth Embodiment of the Invention

Description will be made in regard to a fifth embodiment of the present invention. The present embodiment is a modification of the first embodiment in that the pin shaft portion (70) and the slide groove (80) are modified in configuration. Hereinafter, in regard to the scroll compressor (10) of the present embodiment, the difference from the first embodiment will be described.

Figure 23:
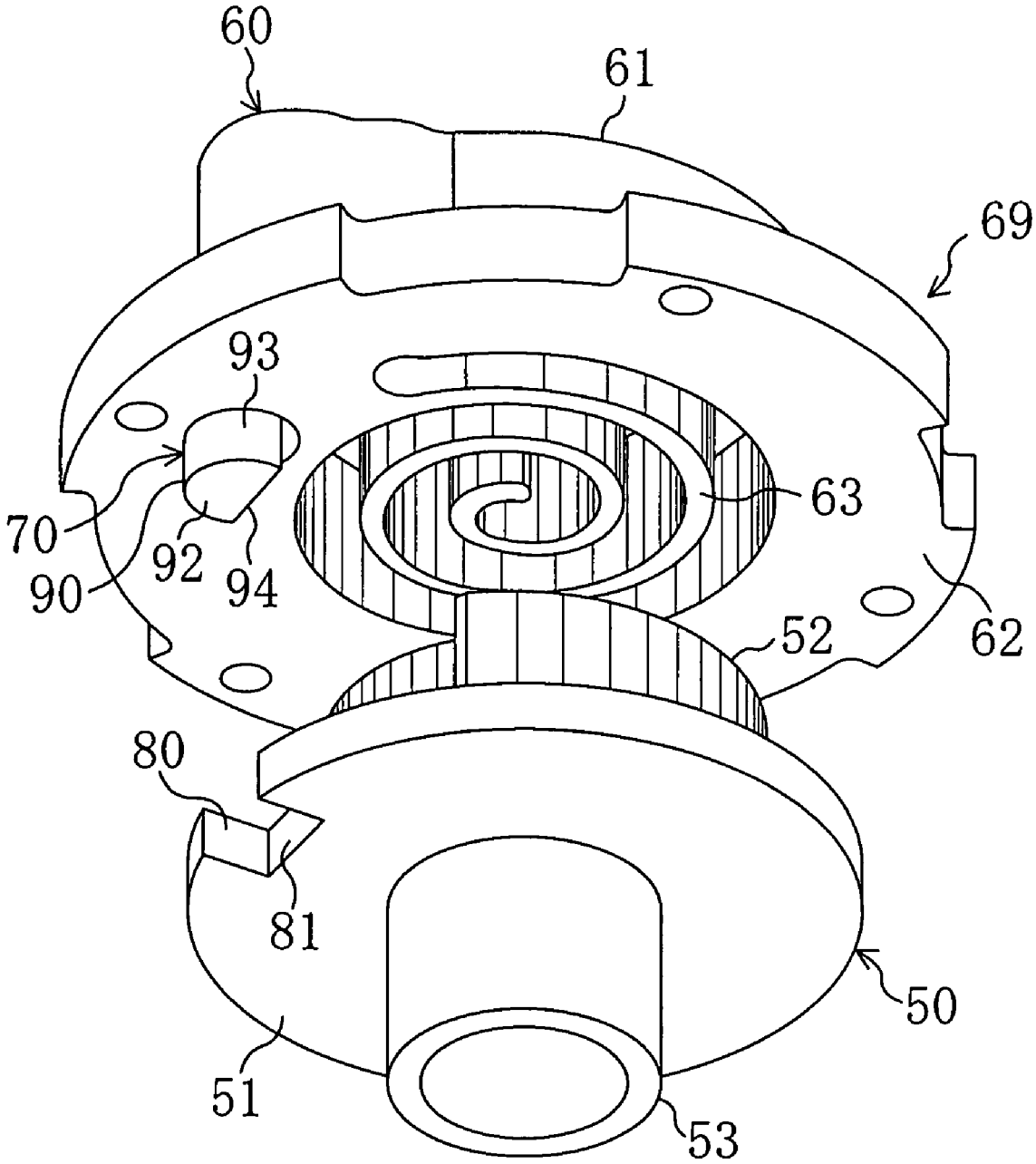
FIG. 23 is a perspective view, as viewed obliquely from below, of a fixed scroll and a movable scroll in a fifth embodiment of the present invention.
Figure 24:
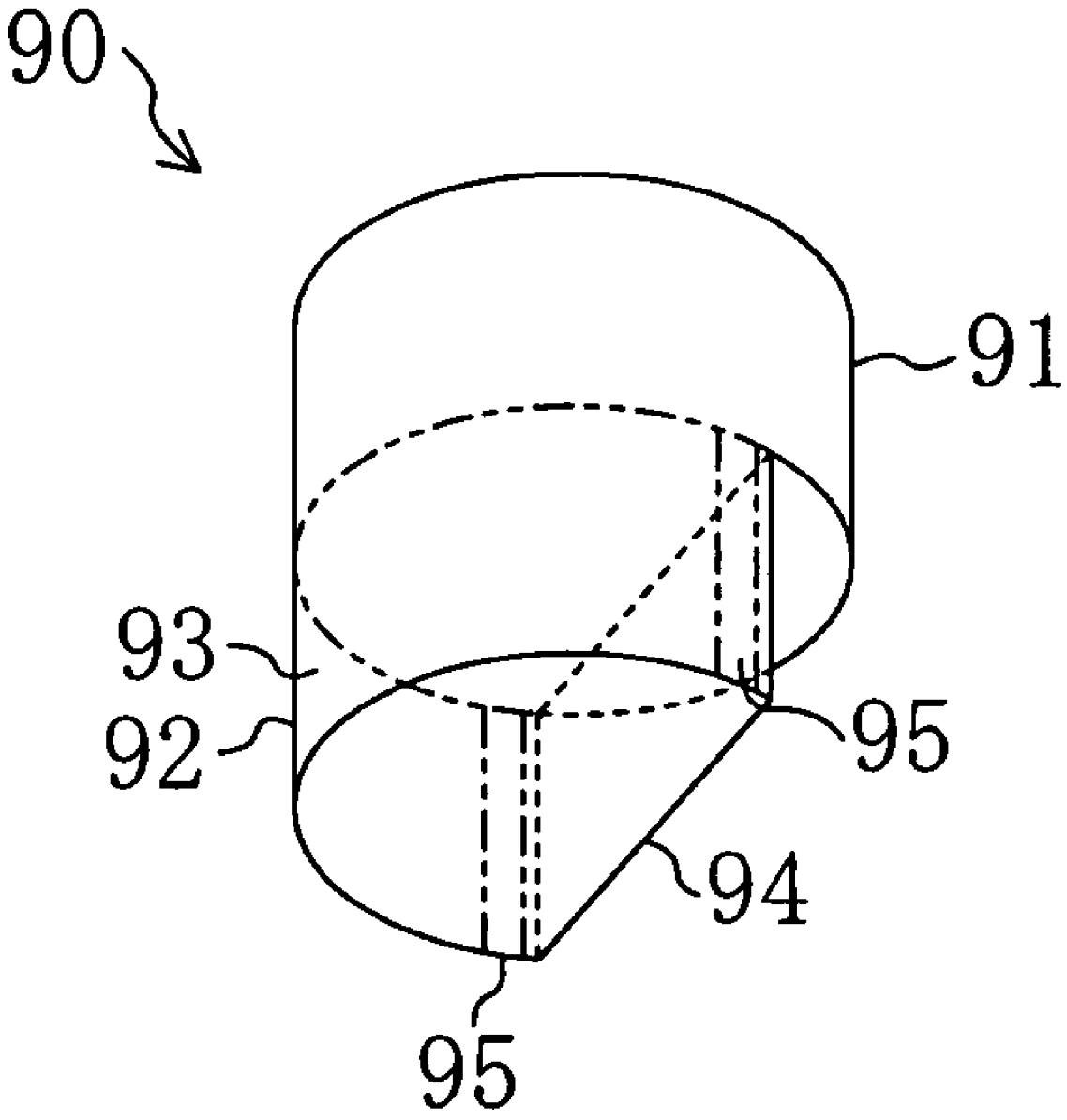
FIG. 24 is a perspective view, as viewed obliquely from below, of a pin member of the fifth embodiment.

As shown in FIG. 23 and FIG. 24, the pin shaft portion (70) of the present embodiment is formed by a single pin member (90). The pin member (90) is made up of a base end (91) formed in a cylindrical shape and a projection (92) which projects from one end of the base end (91) in the axial direction thereof. The pin member (90) has an entire shape in the form of a cylinder with its portion cut away.

Figure 25:
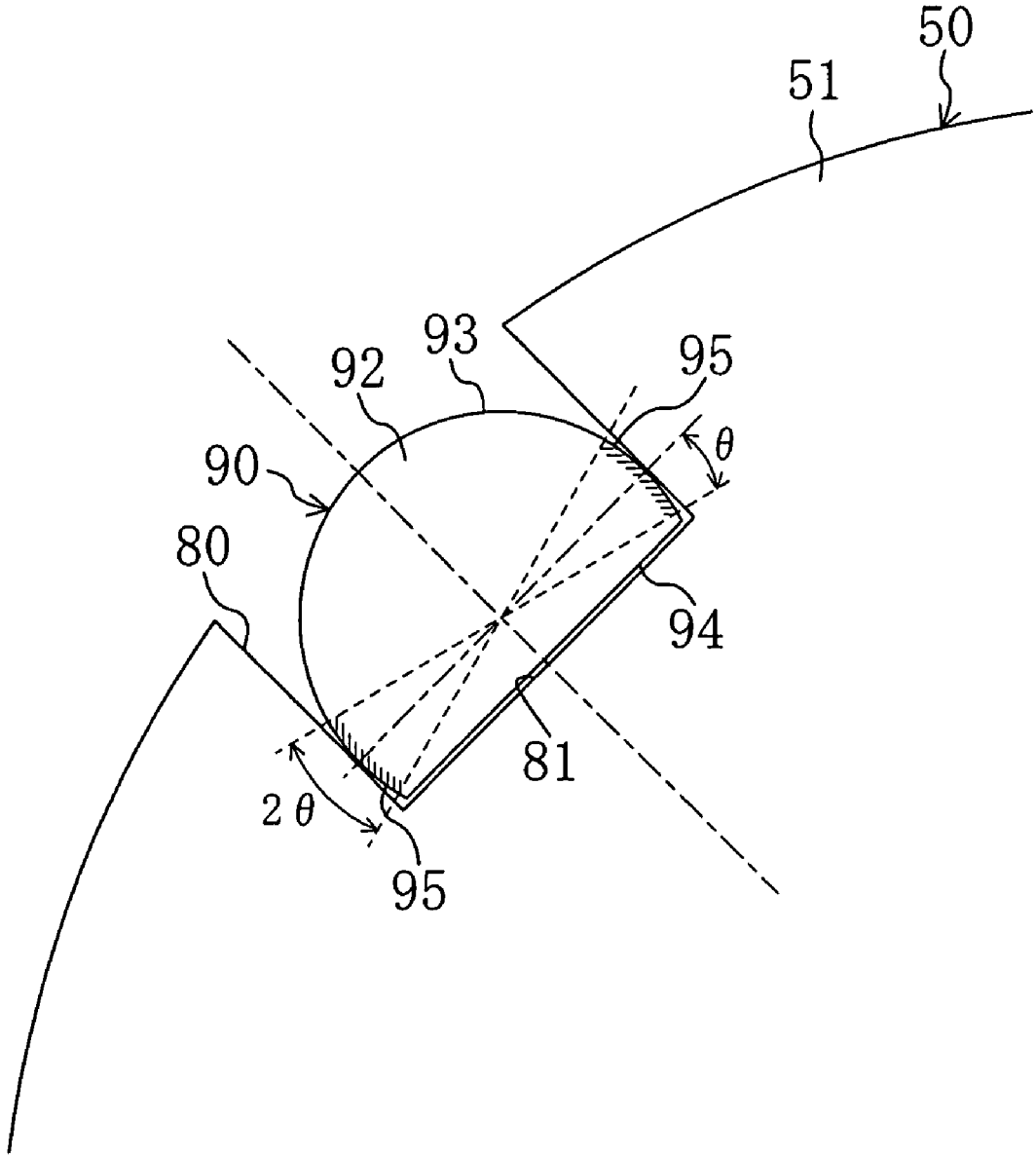
FIG. 25 is a chief portion enlarged diagram of a compression mechanism of the fifth embodiment.

The base end (91) has a height approximately equal to the thickness of the rim portion (62) of the fixed scroll (60), and is press fitted into a hole preformed in the rim portion (62). As shown in FIG. 25, the end surface (cross section which is perpendicular to the central axis of the pin member (90)) of the projected portion (92) has a shape composed of a circular arc whose central angle exceeds 180 degrees and a chord of the circular arc. The side surface of the projected portion (92) is composed of a circular arc side surface (93) which is a circular arc surface and a flat side surface (94) which is a flat surface. In addition, the diameter of the pin member (90) is about twice the diameter of the columnar pin (71) of the first embodiment.

As shown in FIG. 25, in the projected portion (92) of the pin member (90), a portion (hatched in FIG. 25) of the circular arc side surface (93) situated nearer to the flat side surface (94) serves as a sliding contact surface (95), and the sliding contact surface (95) comes into sliding contact with the wall surface of the slide groove (80). More specifically, in the circular arc side surface (93) of the projected portion (92), the sliding contact surface (95) is formed by a first region which is situated nearer to the flat side surface (94) and whose central angle is 2θ and a second region which is situated opposite (180 degrees) to the first region across the center of curvature of the circular arch side surface (93). Preferably, the position of the pin member (90) and the position of the slide groove (80) are determined so that θ (half of the central angle of the sliding contact surface (95)) is 5 degrees or less.

Figure 27:
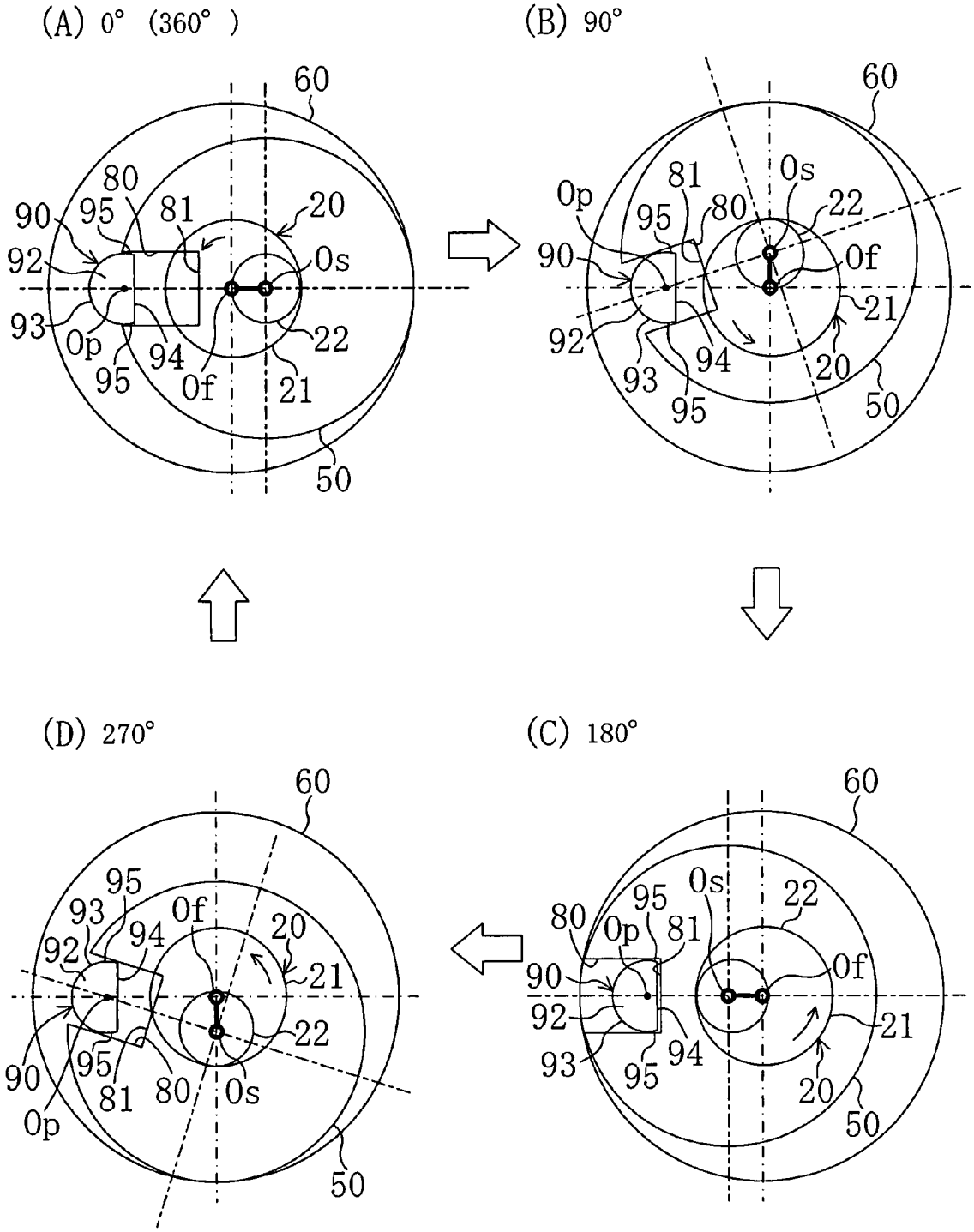
FIG. 27 is a schematic configuration diagram of a compression mechanism illustrating the movement of a movable scroll of the fifth embodiment.

The pin member (90) is firmly secured to the rim portion (62) of the fixed scroll (60), with the flat side surface (94) oriented towards the center of the fixed scroll (60). As shown in FIG. 27, the flat side surface (94) of the pin member (90) is substantially perpendicular to the straight line OpOf passing through both the central axis position, Op, of the pin member (90) and the central axis position, Of, of the main shaft portion (21) of the driving shaft (20). The pin member (90) constituting the pin shaft portion (70) is formed in such a shape that its portion nearer to the driving shaft (20) than the sliding contact surface (95) is cut away.

Figure 26:
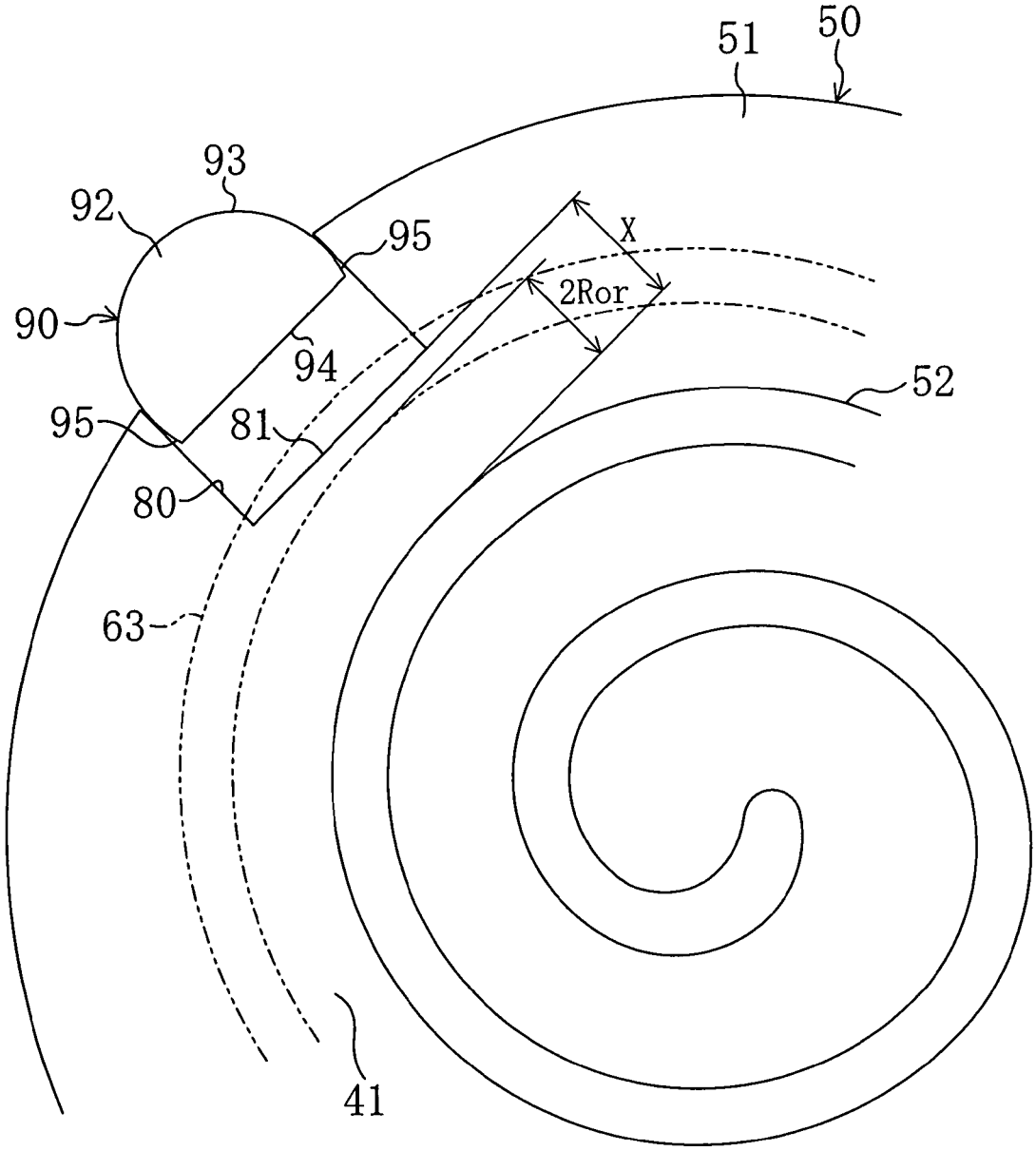
FIG. 26 is a chief portion enlarged diagram of a compression mechanism of the fifth embodiment.

As shown in FIG. 23 and FIG. 26, the slide groove (80) passes completely through the movable side end plate portion (51) in the thickness direction thereof. The slide groove (80) linearly extends from the outer peripheral surface of the movable side end plate portion (51) in the radial direction thereof. As shown in FIG. 27, the direction in which the slide groove (80) extends substantially agrees with the straight line OpOs passing through both the central axis position, Op, of the pin member (90) and the central axis position, Os, of the eccentric shaft portion (22) of the driving shaft (20).

The slide groove (80) has a width slightly greater than the diameter of the pin member (90). A wall surface (wall surface on the side of the movable side wrap (52)) of the slide groove (80) situated innermost constitutes a back side wall surface (81). The back side wall surface (81) is a flat surface facing the flat side surface (94) of the pin member (90). In addition, as shown in FIG. 26, the distance, X, from the back side wall surface (81) of the slide groove (80) to the outer peripheral surface of the movable scroll (50) is longer than twice the radius of orbital movement, Ror, of the movable scroll (50), i.e., X>2Ror. Preferably, the distance, X, is longer than 2Ror by from 1 to 2 mm or by more than that.

Running Operation

In the scroll compressor (10) of the present embodiment, the movable scroll (50) operates in approximately the same way as the first embodiment.

The pin member (90) mounted to the fixed scroll (60) engages the slide groove (80) formed in the movable scroll (50), and the movable scroll (50) is guided by the pin member (90), whereby rotation of the movable scroll (50) is restricted. As shown in FIG. 27, the movable scroll (50) orbitally moves around the central axis of the main shaft portion (21) while simultaneously rotating around the central axis of the eccentric shaft portion (22) within an angle range of ±θ.

During operation of the scroll compressor (10), in the projected portion (92) of the pin member (90), only the sliding contact surface (95) which is a portion of the circular arc side surface (93) slidingly contacts the wall surface of the slide groove (80). In other words, the rest of the circular arc side surface (93) other than the sliding contact surface (95) do not come into sliding contact with the side wall of the slide groove (80).

Advantageous Effects of the Fifth Embodiment

The present embodiment provides, in addition to the advantageous effects of the first embodiment, the following advantageous effects.

The condition of lubrication at the time of sliding contact between the sliding contact surface (95) of the pin member (90) and the wall surface of the slide groove (80) becomes severe as the curvature radius of the sliding contact surface (95) in the pin member (90) decreases. Accordingly, in order to ensure lubrication in this portion to thereby avoid troubles such as seizing et cetera, it is preferred that the curvature radius of the sliding contact surface (95) in the pin member (90) is made as long as possible.

FIG. 28 shows results of the comparison between when the pin member (90) (i.e., the curvature radius of the sliding contact surface (95)) has a diameter of 10 mm and when the pin member (90) has a diameter of 20 mm. More specifically, estimation by assumption of the material of the pin member (90), the material of the movable scroll (50), and the magnitude of load acting on the pin member (90) shows that Hertz stress which is a contact stress allowing for member deformation is reduced about 28% and EHL oil film thickness which is an oil film thickness calculated based on EHL (elastohydrodynamic lubrication) theory is increased about 34%.

As explained above, in order to accomplish improved lubrication between the sliding contact surface (95) of the pin member (90) and the wall surface of the slide groove (80), it is preferred that the curvature radius of the sliding contact surface (95) is increased. However, if the pin shaft portion (70) is formed by a member in a simple cylindrical shape and the curvature radius of the sliding contact surface (95) is increased by thickening the member, this may cause the movable side wrap (52) and the fixed side wrap (63) to interfere with the pin shaft portion (70).

On the other hand, in the pin member (90) of the present embodiment, the projected portion (92) is formed in such a cylindrical shape that its portion nearer to the movable side wrap (52) is cut away. Therefore, in accordance with the present embodiment, the fixed side wrap (63) which engages the movable side wrap (52) is prevented from interfering with the pin member (90) and the curvature radius of the sliding contact surface (95) in the pin member (90) is increased to improve the condition of lubrication.

In addition, in the present embodiment, the distance, X, from the back side wall surface (81) of the slide groove (80) to the outer side surface of the movable side wrap (52) is longer than twice the radius of orbital movement, Ror, of the movable scroll (50). On the other hand, the distance between the movable side wrap (52) and the fixed scroll (60) is twice the radius of orbital movement, Ror, of the movable scroll (50) at most. Consequently, in the present embodiment, during orbital movement of the movable side wrap (52), the inner side surface of the fixed side wrap (63) never reaches to the outer peripheral side beyond the back side wall surface (81) of the slide groove (80) (see FIG. 26).

In the scroll compressor (10), the movable side wrap (52) and the fixed side wrap (63) engage with each other to form the compression chamber (41). If, during orbital movement of the movable side wrap (52), the inner side surface of the fixed side wrap (63) reaches to the outer peripheral side beyond the back side wall surface (81) of the slide groove (80), the compression chamber (41) defined between the outer side surface of the movable side wrap (52) and the inner side surface of the fixed scroll (60) fluidly communicates with the slide groove (80). As a result, refrigerant in the compression chamber (41) leaks into the slide groove (80).

On the contrary, in the compression mechanism (40) of the present embodiment, the inner side surface of the fixed side wrap (63) never reaches to the outside beyond the back side wall surface (81) of the slide groove (80). Therefore, in accordance with the present embodiment, it becomes possible to prevent refrigerant from leaking into the slide groove (80) from the compression chamber (41), thereby making it possible to avoid a drop in the efficiency of the scroll compressor (10).

First Variation of the Fifth Embodiment

The present embodiment may be modified such that the slide groove (80) formed in the movable scroll (50) is formed in a concave groove shape. In the present variation, the slide groove (80) is a concave groove which is open at the front surface (upper surface in FIG. 23) of the movable side end plate portion (51) on the side of the movable side wrap (52). In addition, the height of the projected portion (92) in the pin member (90) is slightly shorter than the depth of the slide groove (80).

Second Variation of the Fifth Embodiment

Figure 29:
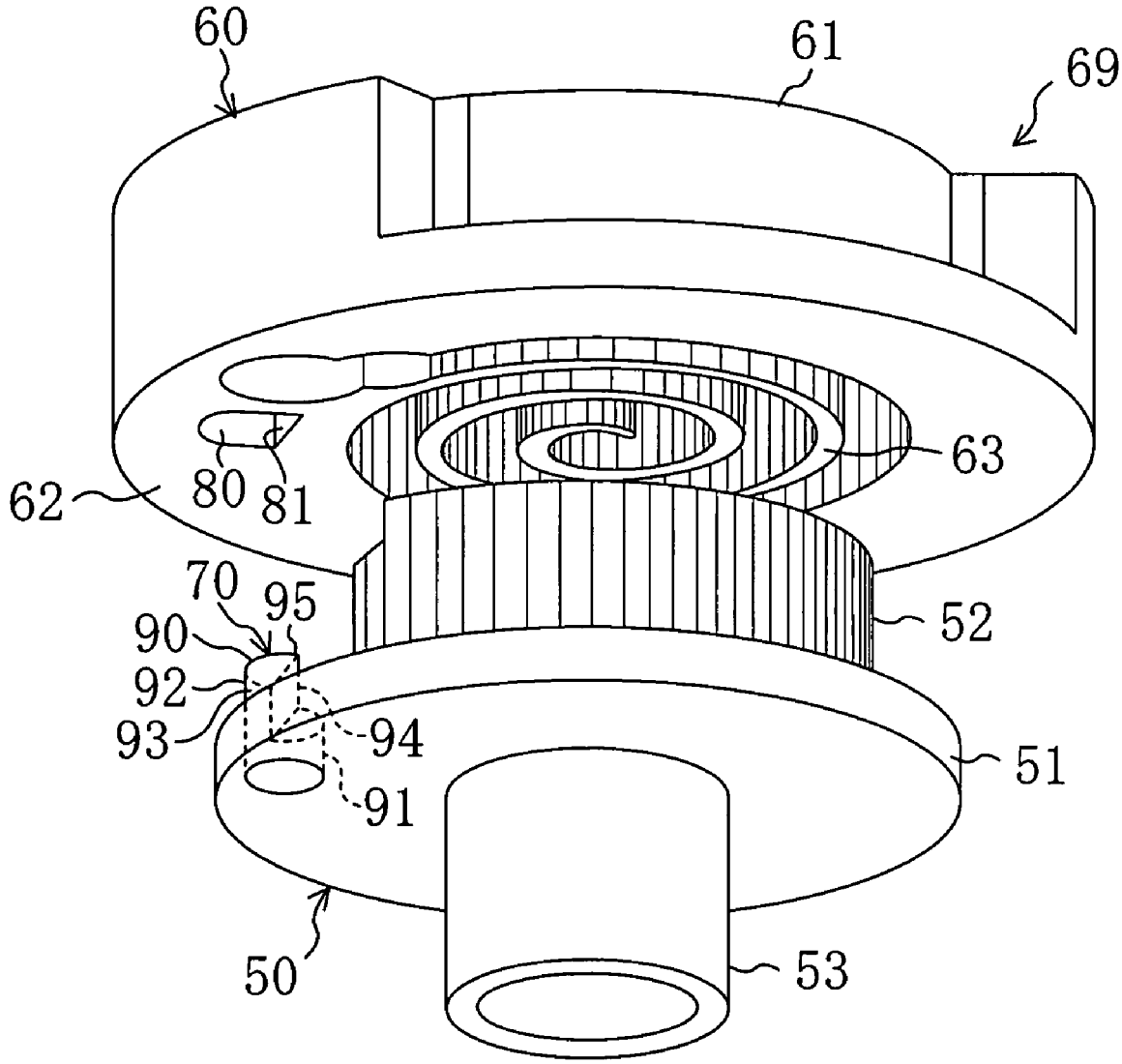
FIG. 29 is a perspective view, as viewed obliquely from below, of a fixed scroll and a movable scroll in a second variation of the fifth embodiment.

The present embodiment may be modified such that, as shown in FIG. 29, the pin member (90) constituting the pin shaft portion (70) is mounted to the movable scroll (50) and the slide groove (80) is formed in the fixed scroll (60).

The movable scroll (50) of the present variation is provided with a mounting hole for mounting of the pin member (90). This mounting hole passes completely through the movable side end plate portion (51) in the thickness direction thereof. The cylindrical base end (91) of the pin member (90) is press fitted into the mounting hole of the movable side end plate portion (51), with the tip projected on the side of the front surface of the movable side end plate portion (51).

The slide groove (80) of the present variation is formed in the rim portion (62) of the fixed scroll (60). The slide groove (80) is a concave groove which is open at the lower surface of the rim portion (62). The projected portion (92) of the pin member (90) is inserted into the slide groove (80). The sliding contact surface (95) of the pin member (90) slidingly contacts the wall surface of the slide groove (80).

In the present variation, the slide groove (80) is formed in the fixed scroll (60). Alternatively, the slide groove (80) may be formed not in the fixed scroll (60) but in the housing (45). In this case, the slide groove (80) is a concave groove which is open at the upper surface of the bottom of the upper portion (46) in the housing (45). In addition, the columnar pin (71) constituting the pin shaft portion (70) is mounted such that it projects on the side of the back surface of the movable side end plate portion (51).

Other Embodiments of the Invention

Each of the above-described embodiments of the present invention may be configured as follows.

First Variation

Figure 30:
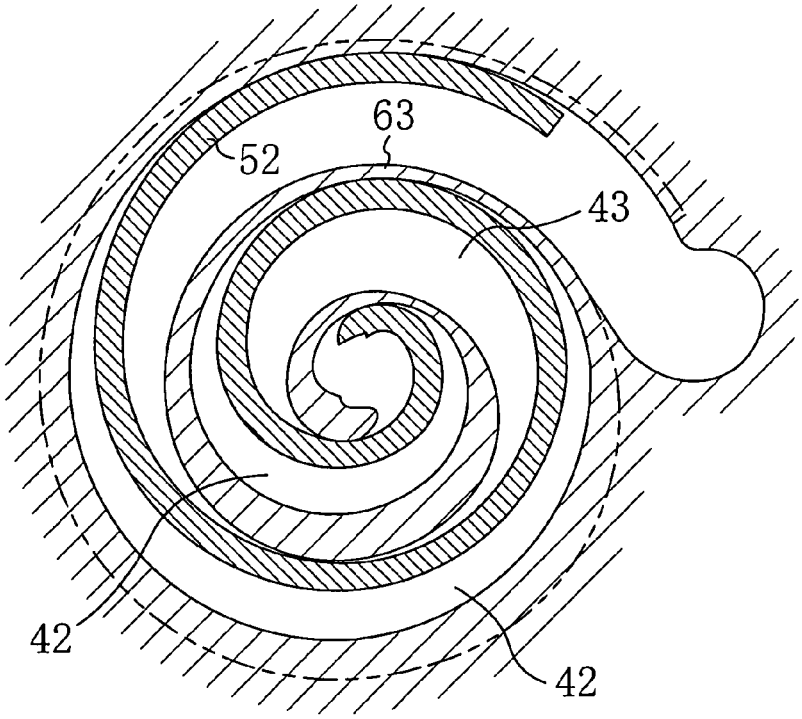
FIG. 30 is a chief portion cross sectional view showing a transverse cross section of a compression mechanism in a first variation of another embodiment of the present invention.

Each of the above-described embodiments may be modified, as shown in FIG. 30. That is, the movable side wrap (52) is shaped like a spiral wall of constant thickness. In the present variation, the movable side wrap (52) is formed into the same shape as its counterpart in a scroll fluid machine of the general type whose movable scroll is completely forbidden to rotate. In the present variation, the shape of the fixed side wrap (63) is matched to movement of the movable scroll (50) by varying the thickness of the fixed side wrap (63).

More specifically, the inside and outer side surfaces of the fixed side wrap (63), i.e., all the wrap surfaces of the fixed side wrap (63), are shaped differently from scroll fluid machines of the general type. The fixed side wrap (63) of the present embodiment is provided with a first portion the thickness of which gradually increases from the inner to the outer peripheral side end and a second portion the thickness of which gradually decreases from the inner to the outer peripheral side, wherein the first and second portions are alternately formed. The inner side surface of the fixed side wrap (63) becomes an enveloping surface for the outer side surface of the movable side wrap (52) while on the other hand the outer side surface of the fixed side wrap (63) becomes an enveloping surface for the inner side surface of the movable side wrap (52).

In the present variation, the movable side wrap (52) is formed into the same shape as its counterpart in a scroll fluid machine of the general type whose movable scroll is completely forbidden to rotate. Consequently, it becomes possible to allow application of movable scrolls intended for scroll fluid machinery of the general type, and the scroll compressor (10) is less expensive to manufacture than conventional scroll fluid machines.

Second Variation

Figure 31:
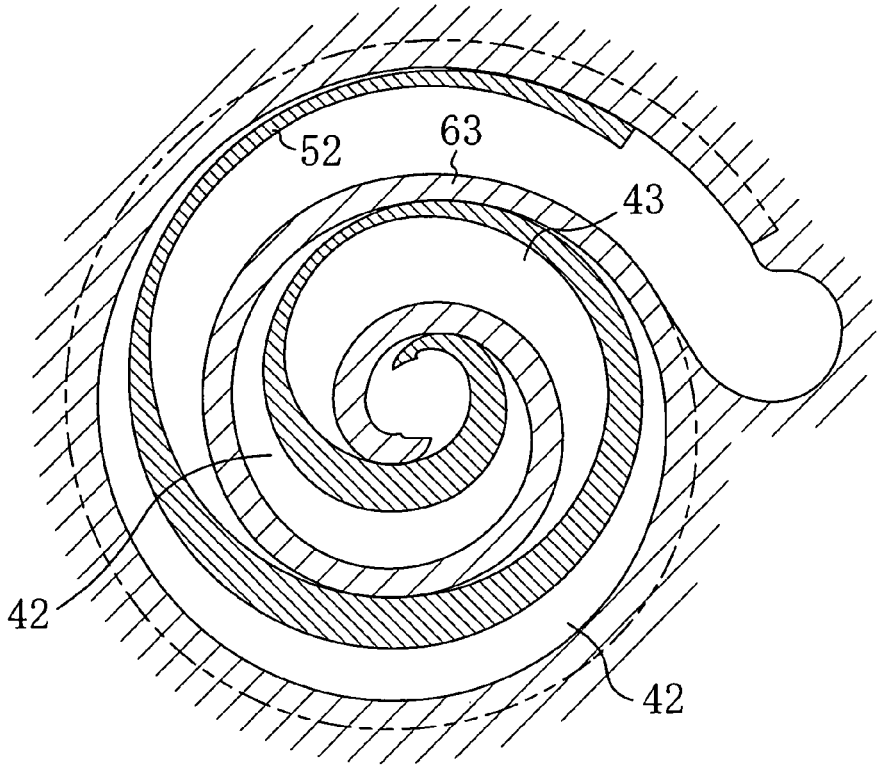
FIG. 31 is a chief portion cross sectional view showing a transverse cross section of a compression mechanism in a second variation of the embodiment.

Each of the above-described embodiments of the present invention may be modified as shown in FIG. 31. That is, the movable side wrap (52) is shaped like a spiral wall of constant thickness. In the present variation, the fixed side wrap (63) is formed into the same shape as its counterpart in a scroll fluid machine of the general type whose movable scroll is completely forbidden to rotate. In the present variation, the shape of the movable side wrap (52) is matched to movement of the movable scroll (50) by varying the thickness of the movable side wrap (52).

More specifically, the inside and outer side surfaces of the movable side wrap (52), i.e., all the wrap surfaces of the movable side wrap (52), are shaped differently from scroll fluid machines of the general type. The movable side wrap (52) of the present variation is provided with a first portion the thickness of which gradually increases from the inner to the outer peripheral side end and a second portion the thickness of which gradually decreases from the inner to the outer peripheral side, wherein the first and second portions are alternately formed. The inner side surface of the fixed side wrap (63) becomes an enveloping surface for the outer side surface of the movable side wrap (52) while on the other hand the outer side surface of the fixed side wrap (63) becomes an enveloping surface for the inner side surface of the movable side wrap (52).

In the present variation, the fixed side wrap (63) is formed into the same shape as its counterpart in a scroll fluid machine of the general type whose movable scroll is completely forbidden to rotate. Consequently, it becomes possible to allow application of fixed scrolls intended for scroll fluid machinery of the general type, and the scroll compressor (10) is less expensive to manufacture than conventional scroll fluid machines.

Third Variation

Figure 32:
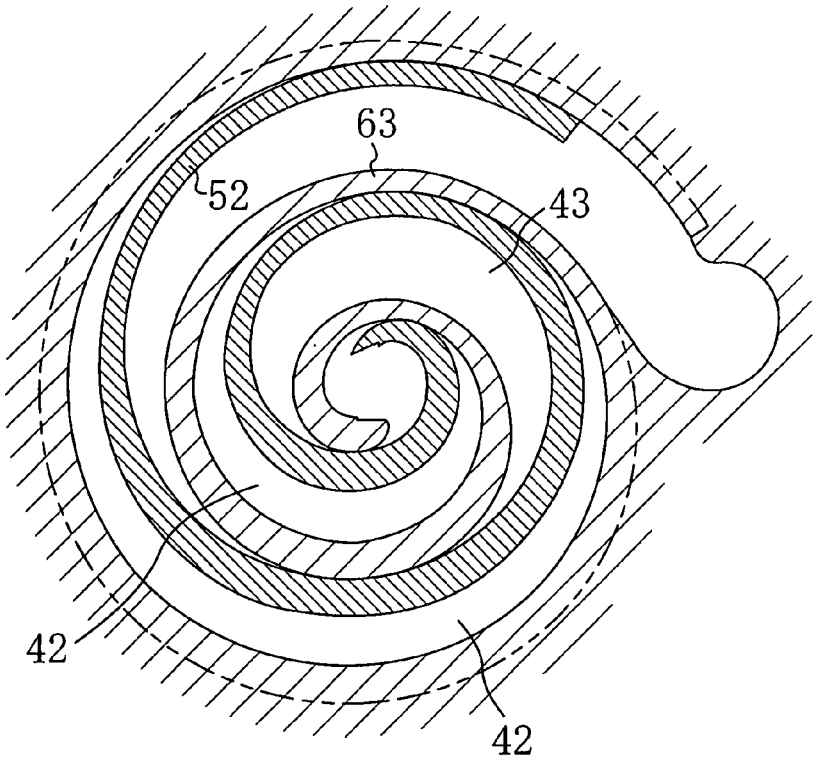
FIG. 32 is a chief portion cross sectional view showing a transverse cross section of a compression mechanism in a third variation of the embodiment.

Each of the above-described embodiments of the present invention may be modified as shown in FIG. 32. That is, the movable and fixed side wraps (52, 63) each have an inner side surface formed in a shape which draws a simple involute curve while on the other hand the movable and fixed side wraps (52, 63) each have an outer side surface formed in a shape different from one that draws an involute curve, whereby the shape of each of the movable and fixed side wraps (52, 63) is matched to movement of the movable scroll (50).

The movable side wrap (52) of the present variation is provided with a first portion the thickness of which gradually increases from the inner to the outer peripheral side end and a second portion the thickness of which gradually decreases from the inner to the outer peripheral side, wherein the first and second portions are alternately formed. In addition, the fixed side wrap (63) of the present variation is provided with a first portion the thickness of which gradually increases from the inner to the outer peripheral side end and a second portion the thickness of which gradually decreases from the inner to the outer peripheral side, wherein the first and second portions are alternately formed. The inner side surface of the fixed side wrap (63) becomes an enveloping surface for the outer side surface of the movable side wrap (52) while on the other hand the outer side surface of the fixed side wrap (63) becomes an enveloping surface for the inner side surface of the movable side wrap (52).

Fourth Variation

Figure 33:
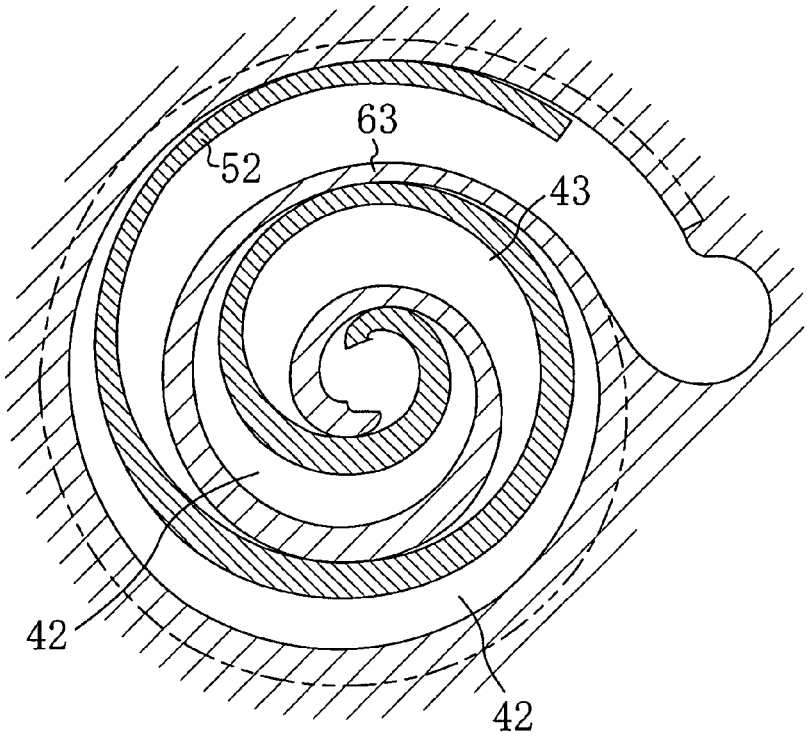
FIG. 33 is a chief portion cross sectional view showing a transverse cross section of a compression mechanism in a fourth variation of the embodiment.

Each of the above-described embodiments of the present invention may be modified as shown in FIG. 33. That is, the movable and fixed side wraps (52, 63) each have an outer side surface formed in a shape which draws a simple involute curve while on the other hand the movable and fixed side wraps (52, 63) each have an inner side surface formed in a shape different from one that draws an involute curve, whereby the shape of each of the movable and fixed side wraps (52, 63) is matched to movement of the movable scroll (50).

The movable side wrap (52) of the present variation is provided with a first portion the thickness of which gradually increases from the inner to the outer peripheral side end and a second portion the thickness of which gradually decreases from the inner to the outer peripheral side, wherein the first and second portions are alternately formed. In addition, the fixed side wrap (63) of the present variation is provided with a first portion the thickness of which gradually increases from the inner to the outer peripheral side end and a second portion the thickness of which gradually decreases from the inner to the outer peripheral side, wherein the first and second portions are alternately formed. The inner side surface of the fixed side wrap (63) becomes an enveloping surface for the outer side surface of the movable side wrap (52) while on the other hand the outer side surface of the fixed side wrap (63) becomes an enveloping surface for the inner side surface of the movable side wrap (52).

Fifth Variation

Figure 34:
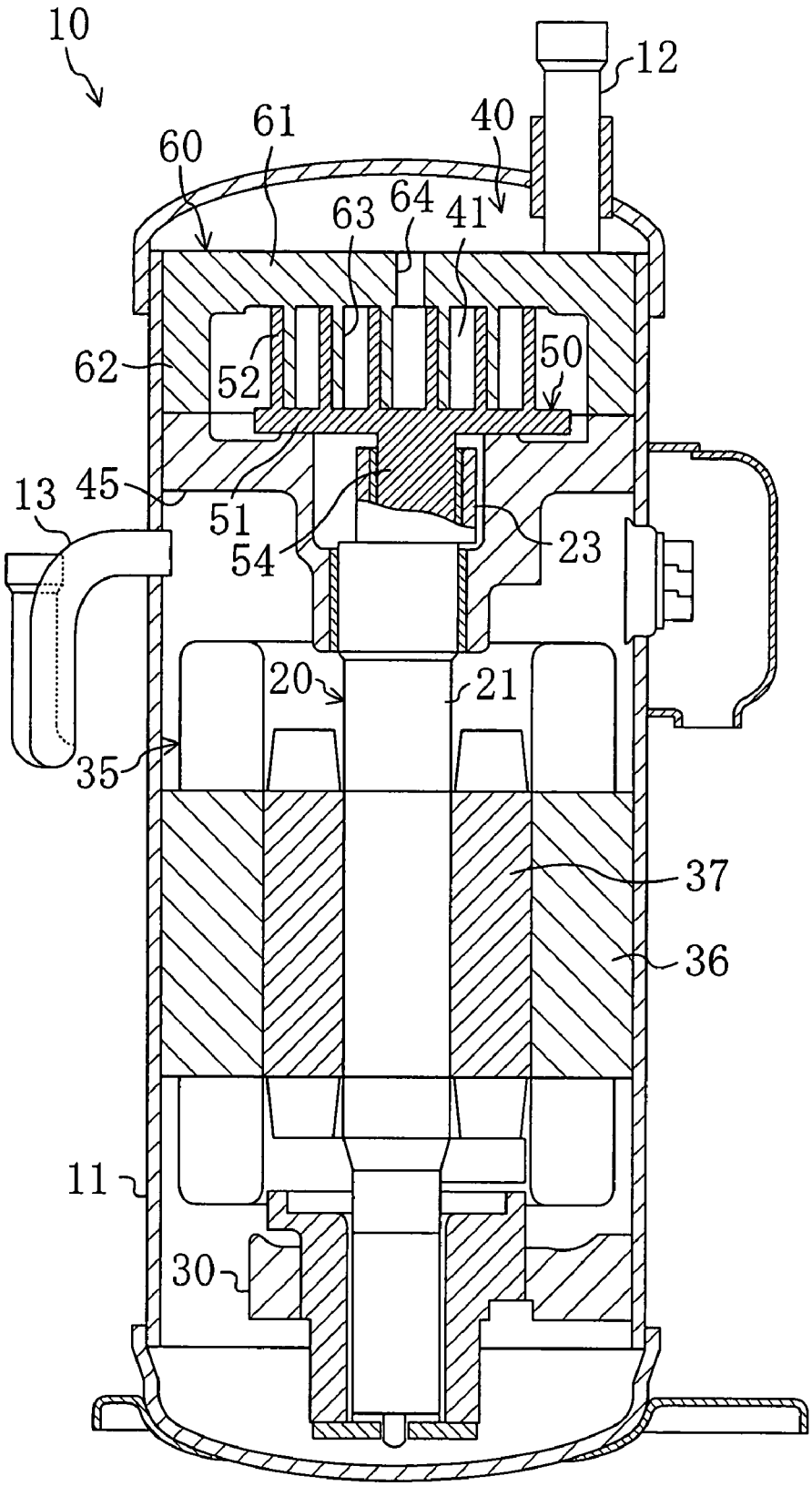
FIG. 34 is a chief portion cross sectional view showing a transverse cross section of a compression mechanism in a fifth variation of the embodiment.

Each of the above-described embodiments of the present invention may be modified as shown in FIG. 34. That is, the driving shaft (20) is provided, as a substitute for the eccentric shaft portion (22), with an eccentric tubular portion (23) and, in addition, the movable scroll (50) is provided, as a substitute for the projected tubular portion (53), with a projected shaft portion (54).

More specifically, in the driving shaft (20) of the present variation, the eccentric tubular portion (23) is formed at the upper end of the main shaft portion (21). The eccentric tubular portion (23) is formed in a tubular shape which is open at its upper end surface. The central axis of the eccentric tubular portion (23) is eccentric relative to the central axis of the main shaft portion (21). In the present variation, the eccentric tubular portion (23) constitutes an eccentric portion. On the other hand, in the movable scroll (50) of the present variation, the projected shaft portion (54) is projectingly mounted on the back surface of the movable side end plate portion (51). The projected shaft portion (54) is formed in a cylindrical shape and is inserted into the eccentric tubular portion (23) of the driving shaft (20) from above.

Sixth Variation

In each of the above-described embodiments of the present invention, the fixed scroll (60) firmly secured to the casing (11) serves as a non-orbiting scroll. It is not necessary for this non-orbiting scroll to be a member which is firmly secured to the housing (11) to be completely immobilized. For example, the non-orbiting scroll may be a member capable of movement in the axial direction of the driving shaft (20) (vertical direction in FIG. 1).

Generally, as the scroll compressor (10), there is a type of scroll compressor whose capacity can be varied by displacing the non-orbiting scroll which engages the movable scroll (50) in the axial direction of the driving shaft (20). In such a scroll compressor (10), the amount of refrigerant which is discharged out of the scroll compressor (10) is varied by controlling the duty ratio between the length of time for which the non-orbiting scroll is pressed toward the movable scroll (50) and the length of time for which the non-orbiting scroll is drawn away from the movable scroll (50).

More specifically, when the non-orbiting scroll is held in the state of being pressed towards the movable scroll (50), refrigerant is compressed in the compression mechanism (40) and compressed refrigerant is discharged out of the compression mechanism (40). On the other hand, when the non-orbiting scroll is held in the state of being drawn away from the movable scroll (50), there is formed a clearance between the wrap tip of the non-orbiting scroll and the end plate portion (51) of the movable scroll (50) or between the wrap tip of the movable scroll (50) and the end plate portion of the non-orbiting scroll. Consequently, even when the movable scroll (50) orbits in this state, refrigerant is not compressed in the compression mechanism (40), and no refrigerant is discharged out of the compression mechanism (40). Accordingly, if the ratio of the length of time for which the non-orbiting scroll is pressed against the movable scroll (50) to the length of time for which the non-orbiting scroll is drawn away from the movable scroll (50) is made to vary, this accordingly causes the discharge amount of refrigerant from compression mechanism (40) to vary.

In the scroll compressor (10) of this type, the amount of movement of the non-orbiting scroll is of the order of several millimeters at most. Accordingly, if the length of the pin shaft portion (70) is increased by the amount of movement of the non-orbiting scroll, the pin shaft portion (70) is kept in engagement with the slide groove (80) even when the non-orbiting scroll displaces.

Seventh Variation

Each of the above-described embodiments of the present invention may employ a material, which has a higher strength than the material of the member in which the slide groove (80) is formed, to form the pin shaft portion (70).

More specifically, the first embodiment may employ a material, which has a higher strength than the material of the movable scroll (50) in which the slide groove (80) is formed, to form the columnar pin (71) constituting the pin shaft portion (70). In addition, the second embodiment may employ a material, which has a higher strength than the material of the fixed scroll (60) in which the slide groove (80) is formed, to form the columnar pin (71) constituting the pin shaft portion (70). Furthermore, the fifth embodiment may employ a material, which has a higher strength than the material of the movable scroll (50) in which the slide groove (80) is formed, to form the pin member (90) constituting the pin shaft portion (70). Additionally, the second variation of the fifth embodiment may employ a material, which has a higher strength than the material of the fixed scroll (60) in which the slide groove (80) is formed, to form the pin member (90) constituting the pin shaft portion (70).

For example, in the case where the material of the member in which the slide groove (80) is formed (i.e., the movable scroll (50) or the fixed scroll (60)) is FC250, SKH51 may be used as a material of which the pin shaft portion (70) is made.

Eighth Variation

Each of the above-described embodiments of the present invention may be modified such that a resinous coating capable of functioning as a solid lubricant is formed on the member in which the slide groove (80) is formed as well as on the sliding contact surface of the pin shaft portion (70). As this type of resinous coating, there is, for example, one composed of a fluororesin such as polytetrafluoroethylene (PTFE) of extremely low frictional coefficient and a binder.

More specifically, the first embodiment may be modified such that resinous coating is applied to either one or both of the columnar pin (71) constituting the pin shaft portion (70) and the wall surface of the slide groove (80) in the movable scroll (50). In addition, the second embodiment may be modified such that resinous coating is applied to either one or both of the columnar pin (71) constituting the pin shaft portion (70) and the wall surface of the slide groove (80) in the fixed scroll (60). Furthermore, the fifth embodiment may be modified such that resinous coating is applied to either one or both of the pin member (90) constituting the pin shaft portion (70) and the wall surface of the slide groove (80) in the movable scroll (50). Additionally, the second variation of the fifth embodiment may be modified such that resinous coating is applied to either one or both of the pin member (90) constituting the pin shaft portion (70) and the wall surface of the slide groove (80) in the fixed scroll (60).

Ninth Variation

Any one of the above-described embodiments is a scroll compressor formed by a scroll fluid machine according to the present invention. However, the application of the scroll fluid machines of the present invention is not limited to the field of compressors, and it may be possible to constitute a scroll expander by the use of a scroll fluid machine of the present invention.

INDUSTRIAL APPLICABILITY

As has been described above, the present invention finds its utility in the filed of scroll fluid machines.

What is claimed is:

1. A fluid machine of the scroll type, comprising:

an orbiting scroll having a spiral orbiting wrap and a slide groove having a back side wall surface;

a non-orbiting scroll provided with a spiral non-orbiting wrap;

a rotating shaft, the rotating shaft having an eccentric portion which is eccentric relative to the axis of rotation of the rotating shaft, wherein the orbiting scroll engages the eccentric portion moving orbitally around the axis of rotation of the rotating shaft;

a housing member in which a bearing for supporting the rotating shaft is mounted and which constitutes a non-orbiting member together with a non-orbiting scroll;

a columnar shaped pin shaft portion mounted to either one or both of the non-orbiting scroll and the housing member and having a sliding contact surface, formed in a circular arc shape, for sliding contact with the wall surface of the slide groove, the distance from the central axis of the pin shaft portion to the central axis of the rotating shaft being longer than the radius of orbital movement of the orbiting scroll, wherein a portion of the pin shaft nearer to the rotating shaft than the sliding contact surface which slidingly contacts the wall surface of the slide groove is cut away forming a flat side surface, and the flat side surface remains substantially perpendicular to a straight line that passes through the central axis of the pin shaft portion and the central axis of the rotating shaft;

wherein rotation of the orbiting scroll is restricted by sliding contact of a wall surface of the slide groove and the sliding contact surface of the pin shaft portion during orbital movement of the orbiting scroll; and wherein the back side wall surface of the slide groove never crossed an inner side surface of the spiral non-orbiting wrap.

2. The scroll fluid machine of claim 1, wherein the slide groove is formed in a linear shape; and wherein the central line of the slide groove is perpendicular to both the central axis of the pin shaft portion and the central axis of the eccentric portion.

3. The scroll fluid machine of claim 1, wherein the orbiting scroll includes an orbiting end plate portion which is shaped like a flat plate and the spiral orbiting wrap is mounted in a standing manner on the orbiting end plate portion; and wherein the slide groove is a groove which passes completely through the orbiting end plate portion in its thickness direction.

4. The scroll fluid machine of claim 1, wherein the orbiting scroll includes an orbiting end plate portion which is shaped like a flat plate and the spiral orbiting wrap is mounted in a standing manner on the orbiting end plate portion;

wherein the slide groove is a groove which passes completely through the orbiting end plate portion in its thickness direction; and wherein the distance from an end of the slide groove on the side of the orbiting wrap to an outer side surface of the orbiting wrap is longer than twice the radius of orbital movement of the orbiting wrap.

5. The scroll fluid machine of claim 1, wherein the pin shaft portion is firmly secured to the non-orbiting scroll as the non-orbiting member, wherein the orbiting scroll includes an orbiting end plate portion which is shaped like a flat plate and the spiral orbiting wrap is mounted in a standing manner on the orbiting end plate portion;

wherein the slide groove is a concave groove which is open at a front surface of the orbiting end plate portion on the side of the orbiting wrap; and wherein the distance from an end of the slide groove on the side of the orbiting wrap to an outer side surface of the orbiting wrap is longer than twice the radius of orbital movement of the orbiting wrap.

6. The scroll fluid machine of claim 1, wherein the orbiting scroll includes an orbiting end plate portion which is shaped like a flat plate and the spiral orbiting wrap is mounted in a standing manner on the orbiting end plate portion; and wherein in the orbiting end plate portion the slide groove is formed in the vicinity of an outer peripheral side end of the orbiting wrap.

7. The scroll fluid machine of claim 1, wherein the orbiting scroll includes an orbiting end plate portion which is shaped like a flat plate and the spiral orbiting wrap which is mounted in a standing manner on the orbiting end plate portion; and wherein in the orbiting end plate portion the slide groove is formed at a position further ahead of an outer peripheral side end of the orbiting wrap along a direction in which the orbiting wrap elongates.

8. The scroll fluid machine of claim 1, the spiral orbiting wrap is of constant thickness; and the spiral non-orbiting wrap gradually repeatedly increases and decreases its thickness in a direction from an inner to an outer peripheral side end thereof.

9. The scroll fluid machine of claim 1, the spiral orbiting wrap gradually repeatedly increases and decreases its thickness in a direction from an inner to an outer peripheral side end thereof; and the spiral non-orbiting wrap is of constant thickness.

10. The scroll fluid machine of claim 1, the spiral orbiting wrap gradually repeatedly increases and decreases its thickness in a direction from an inner to an outer peripheral side end thereof; and the spiral non-orbiting wrap gradually repeatedly increases and decreases its thickness in a direction from an inner to an outer peripheral side end thereof.

11. The scroll fluid machine of claim 1, wherein the non-orbiting wrap has an outer peripheral side end which is elongated to near an outer peripheral side end of the orbiting wrap.

* * * * *